US005849423A

United States Patent [19]

Urakawa et al.

[11] Patent Number: 5,849,423

[45] Date of Patent: Dec. 15, 1998

[54] ZINCIFEROUS PLATED STEEL SHEET AND METHOD FOR MANUFACTURING SAME

[75] Inventors: Takayuki Urakawa; Toru Imokawa; Michitaka Sakurai; Jun-ichi Inagaki, all of Fukuyama; Masaaki Yamashita, Yokohama; Shuji Nomura, Fukuyama, all of Japan

[73] Assignee: NKK Corporation, Tokyo, Japan

[21] Appl. No.: 751,679

[22] Filed: Nov. 18, 1996

[30] Foreign Application Priority Data

| | | | |
|---|---|---|---|
| Nov. 21, 1995 | [JP] | Japan | 7-303131 |
| Nov. 21, 1995 | [JP] | Japan | 7-303132 |
| Nov. 22, 1995 | [JP] | Japan | 7-304072 |
| Jan. 31, 1996 | [JP] | Japan | 8-015406 |
| Jan. 31, 1996 | [JP] | Japan | 8-038960 |
| Feb. 16, 1996 | [JP] | Japan | 8-029682 |
| Mar. 26, 1996 | [JP] | Japan | 8-070750 |

[51] Int. Cl.[6] ..... B32B 3/10; B32B 15/18; C25D 3/56; C25D 5/34

[52] U.S. Cl. ..... 428/614; 428/639; 428/659; 428/687; 428/935; 205/112; 205/177; 205/181; 205/184; 205/255

[58] Field of Search ..... 428/639, 659, 428/939, 935, 680, 684, 614, 687; 148/537; 205/112, 177, 181, 184, 255

[56] References Cited

U.S. PATENT DOCUMENTS

| | | | |
|---|---|---|---|
| 4,663,245 | 5/1987 | Yoshida et al. | 428/659 |
| 4,670,354 | 6/1987 | Polard et al. | 428/659 |
| 4,835,066 | 5/1989 | Taisuke et al. | 428/659 |
| 4,853,295 | 8/1989 | Shindo et al. | 428/659 |
| 5,409,553 | 4/1995 | Sagiyama et al. | 148/516 |
| 5,447,802 | 9/1995 | Tobiyama et al. | 428/659 |

FOREIGN PATENT DOCUMENTS

| | | | |
|---|---|---|---|
| 53-60332 | 5/1978 | Japan . | |
| 58-67885 | 4/1983 | Japan . | |
| 63-243282 | 10/1988 | Japan | 428/659 |
| 1-119651 | 5/1989 | Japan . | |
| 2-190483 | 7/1990 | Japan . | |
| 3-17282 | 1/1991 | Japan . | |
| 3-191093 | 8/1991 | Japan . | |
| 4-41683 | 2/1992 | Japan . | |
| 4-48082 | 2/1992 | Japan . | |
| 4-88196 | 3/1992 | Japan . | |
| 2161499 | 1/1986 | United Kingdom | 428/659 |
| WO96/10103 | 4/1996 | WIPO . | |

*Primary Examiner*—John J. Zimmerman
*Attorney, Agent, or Firm*—Frishauf, Holtz, Goodman, Langer & Chick, P.C.

[57] ABSTRACT

A method for manufacturing a zinciferous plated steel sheet, comprises: forming a zinciferous plating layer on a steel sheet; and forming an Fe—Ni—O film on the zinciferous plating layer. The Fe—Ni—O film is formed by carrying out electrolysis with the steel sheet as a cathode in an aqueous solution, dipping the steel sheet in an aqueous solution, or spraying a mist on a surface of the zinciferous plating layer.

52 Claims, 9 Drawing Sheets

ZINCIFEROUS PLATED STEEL SHEET AND METHOD FOR MANUFACTURING SAME

BACKGROUND OF THE INVENTION

1. Field of the Invention

The present invention relates to a zinciferous plated steel sheet, and more particularly, to a zinciferous plated steel sheet excellent in press formability, spot weldability, and adhesiveness, and a method for manufacturing same.

2. Description of the Related Arts

Zinciferous plated steel sheets are widely applied as various rust-prevention steel sheets because they have many excellent properties. In order to use the zinciferous plated steel sheets as rust-preventive steel sheets for automobiles, it is important for the sheets to be excellent in press formability, spot weldability and adhesiveness as properties required in the body forming process, in addition to corrosion resistance and painting adaptability.

In general, however, the zinciferous plated steel sheet has a defect of being inferior to a cold-rolled steel sheet in press formability. This is attributable to a larger sliding resistance between the zinciferous plated steel sheet and a press die than that for the cold-rolled steel sheet: a larger sliding resistance makes it difficult for the portion of the zinciferous plated steel sheet near the bead portion of the die to flow into the press die, leading to easier occurrence of fracture of the steel sheet.

For the purpose of improving press formability of the zinciferous plated steel sheet, a method of applying a high-viscosity lubricant is commonly employed. This method however involves problems of occurrence of a painting defect caused by defective degreasing in the painting process which follows due to the high viscosity of lubricant, and press properties becoming unstable as a result of lubricant shortage. There is therefore an increasing demand for improvement of press formability of the zinciferous plated steel sheet.

In the zinciferous plated steel sheet, on the other hand, a brittle alloy layer is easily formed through reaction between a copper electrode and molten zinc during spot welding. This results in serious wear of the copper electrode, leading to a short service life, and hence to a problem of an inferior continuous spot weldability as compared with the cold-rolled steel sheet.

In the manufacturing process of an automobile body, furthermore, various adhesives are used for rust prevention and inhibitation of vibration. An inferior adhesiveness of the zinciferous plated steel sheet to that of the cold-rolled steel sheet has recently been clarified.

As a method for solving these problems, Japanese Unexamined Patent Publications No. 53-60,332 and No. 2-190,483 disclose a method of improving weldability or workability, through forming of an oxide film mainly comprising ZnO, by applying an electrolytic treatment, a dipping treatment, a coating/oxidation treatment or a heat treatment onto the surface of the zinciferous plated steel sheet (hereinafter referred to as the "prior art 1").

Japanese Unexamined Patent Publication No. 4-88,196 discloses a method of improving press formability and chemical treatability through forming of an oxide film mainly comprising P oxide on the surface of a zinciferous plated steel sheet by dipping the plated steel sheet in an aqueous solution having a pH of from 2 to 6 containing from 5 to 60 g/l sodium phosphate, or by electrolysis, or by sprinkling said aqueous solution (hereinafter referred to as the "prior art 2").

Japanese Unexamined Patent Publication No. 3-191,093 discloses a method of improving press formability and chemical treatability by forming Ni oxide (hereinafter referred to as the "prior art 3"), and Japanese Unexamined Patent Publication No. 58-67,885 discloses a method of improving corrosion resistance by forming a metal such as Ni and Fe through electroplating or chemical plating which is not limitative on the surface of a zinciferous plated steel sheet (hereinafter referred to as the "prior art 4").

The foregoing prior art 1 involves the following problem. This prior art, which is a method of forming an oxide film mainly comprising ZnO on the surface of the plating layer by any of various treatments, provides only a limited effect of reducing sliding resistance between the press die and the plated steel sheet, resulting in a limited effect of improving press formability. The oxide film mainly comprising ZnO causes deterioration of adhesiveness.

The prior art 2, which is a method of forming an oxide film mainly comprising P oxide on the surface of a zinciferous plated steel sheet, while providing a remarkable improvement effect of press formability and chemical treatability, has a drawback of causing deterioration of spot weldability and adhesiveness.

The prior art 3, which forms a film comprising a single phase of Ni oxide, has a problem of deterioration of adhesiveness, although it permits improvement of press formability.

The prior art 4, which is a method of forming only metals such as Ni, improves corrosion resistance. The improving effect of press formability and spot weldability is not however sufficient because of strong metallic properties of the film, and a low wettability of metals relative to an adhesive makes it unavailable as a sufficient adhesiveness.

SUMMARY OF THE INVENTION

It is an object of the present invention to provide a zinciferous plated steel sheet excellent in press formability, spot weldability and adhesiveness, and a method for manufacturing same.

To attain the object, the present invention provides a method for manufacturing a zinciferous plated steel sheet, comprising the steps of: forming a zinciferous plating layer on a steel sheet; and forming an Fe—Ni—O film on the zinciferous plating layer.

First, said step of forming the Fe—Ni—O film can comprise carrying out electrolysis with the steel sheet, on which the zinciferous plating layer is formed, as a cathode in an aqueous solution containing nickel sulfate, ferrous sulfate and ferric sulfate. The aqueous solution has a total concentration of the nickel sulfate, the ferrous sulfate and the ferric sulfate, a ratio of concentration (mol/l) of an $Fe^{3+}$ to a sum of concentration of an $Fe^{2+}$ and the $Fe^{3+}$ and a pH, said total concentration is within a range of from 0.3 to 2 mol/l, said ratio of concentration (mol/l) is within a range of from 0.5 to less than 1.0, and a pH is within a range of from 1 to 2.

Secondly, the step of forming the Fe—Ni—O film can comprise carrying out electrolysis with the steel sheet, on which the zinciferous plating layer is formed, as a cathode in a plating solution containing nickel sulfate and ferrous sulfate. The plating solution has a total concentration of the nickel sulfate and the ferrous sulfate and a pH, the total concentration is within a range of from 0.1 to 2 mol/l and the pH is within a range of from 1 to 3. The electrolysis is carried out on conditions satisfying the following equation:

$$50 \leqq I_K/(U^{1/2} \cdot M) \leqq 150$$

where M represents a sum of the concentrations (mol/l) of nickel ions and ferrous ions in the plating solution; U represents a mean flow rate (m/s) of the plating solution; and $I_K$ represents a current density ($A/dm^2$) in the electrolysis.

Thirdly, the step of forming the Fe—Ni—O film can comprise dipping the steel sheet, on which the zinciferous plating layer is formed, in an aqueous solution containing at least one of ferrous sulfate and ferrous nitrate and at least one of nickel sulfate and nickel nitrate. A sum of an iron content (mol/l) and a nickel content (mol/l) in the aqueous solution is within a range of from 0.1 to 3.0 mol/l, a ratio of the iron content (mol/l) to the sum of the iron content (mol/l) and the nickel content (mol/l) in the aqueous solution is within a range of from 0.004 to 0.9, pH is within a range of from 1.0 to 3.5, and temperature is within a range of from 20° to 70° C.

Fourthly, t he step of forming the Fe—Ni—O film can be performed after treating the steel sheet, on which the zinciferous plating layer is formed, in an alkaline solution having a pH of at least 10 for a period within a range of from 2 to 30 seconds. The step of forming the Fe—Ni—O film can comprise treating the steel sheet, on which the zinciferous plating layer is formed, in an aqueous solution containing $FeCl_2$ and $NiCl_2$ and having a pH within a range of from 2.0 to 3.5 and a temperature within a range of from 20° to 70° C. The step of forming the Fe—Ni—O film can comprise treating the steel sheet, on which the zinciferous plating layer is formed, in an aqueous solution containing $FeCl_2$ and $NiCl_2$ and having a pH within a range of from 2.0 to 3.5, a temperature within a range of from 20° to 70° C., and a ratio of Fe content (wt. %) to the sum of the Fe content (wt. %) and a Ni content (wt. %) being within a range of from 0.004 to 0.9.

Fifthly, the step of forming the Fe—Ni—O film can comprise: spraying a mist solution containing Fe ions and Ni ions and having pH of 1 to 3.5 on a surface of the zinciferous plating layer which is formed on the steel sheet; maintaining the steel sheet at a temperature of 20° to 70° C. for 1 second or more; and heating the steel sheet. Thereby the Fe—Ni—O film having a coating weight within the range of 10 to 1500 $mg/m^2$ in terms of the total weight of the metallic elements, a rate of coating within the range of 30 to 90%, and an island-like or mosaic distribution is formed on the zinciferous plating layer.

Sixthly, the step of forming the Fe—Ni—O film can comprise: temper rolling the steel sheet, on which the zinciferous plating layer is formed, to form fine irregularities on the zinciferous plating layer; and forming the Fe—Ni—O film on the zinciferous plating layer. Thereby the Fe—Ni—O film having a coating weight within the range of 10 to 1500 $mg/m^2$ in terms of the total weight of the metallic elements, a rate of coating within the range of 30 to 90%, and an island-like or mosaic distribution is formed on the zinciferous plating layer.

Seventhly, said step of forming the Fe—Ni—O film can comprise: temper rolling the steel sheet, on which the zinciferous plating layer is formed, to form a new surface on the zinciferous plating layer; and forming the Fe—Ni—O film on the zinciferous plating layer. Thereby the Fe—Ni—O film having a coating weight within the range of 10 to 1500 $mg/m^2$ in terms of the total weight of the metallic elements, a rate of coating within the range of 30 to 90%, and an island-like or mosaic distribution is formed on the zinciferous plating layer.

Eighthly, said step of forming the Fe—Ni—O film can comprise: dipping the steel sheet, on which the zinciferous plating layer is formed, in an acid solution or an alkaline solution to dissolve an air oxide film existing on a surface of the zinciferous plating layer and to form active and inactive portions on the surface of the zinciferous plating layer; and forming the Fe—Ni—O film on the zinciferous plating layer on which the active and inactive portions are formed.

Ninthly, said step of forming the Fe—Ni—O film can comprise: performing an anodic electrolysis in an acid solution or an alkaline solution to the steel sheet, on which the zinciferous plating layer is formed, to dissolve an air oxide film existing on a surface of the zinciferous plating layer and to form active and inactive portions on the surface of the zinciferous plating layer; and forming the Fe—Ni—O film on the zinciferous plating layer on which the active and inactive portions are formed.

Tenthly, said step of forming the Fe—Ni—O film can comprise: temper rolling the steel sheet, on which the zinciferous plating layer is formed, within the range of an elongation rate of 0.3 to 5.0%; performing an alkali treatment to the temper-rolled steel sheet in an alkaline solution having a pH of 10 or more for the period of 2 to 30 seconds; and forming the Fe—Ni—O film on the surface of the zinciferous plating layer for which the alkali treatment is performed.

Eleventhly, said step of forming the Fe—Ni—O film can comprise: performing an alkali treatment to the steel sheet, on which the zinciferous plating layer is formed, in an alkaline solution having a pH of 10 or more for the period of 2 to 30 seconds; temper rolling the steel sheet, for which the alkali treatment is performed, within the range of an elongation rate of 0.3 to 5.0%; and forming the Fe—Ni—O film on the surface of the plating layer of the temper rolled steel sheet.

Further, the present invention provides a zinciferous plated steel sheet comprising: a steel sheet; a zinciferous plating layer which is formed on the steel sheet; and an Fe—Ni—O film which is formed on the zinciferous plating layer.

The Fe—Ni—O film has an island-like or mosaic form, a coating weight within the range of 10 to 1500 $mg/m^2$ in terms of the total weight of metallic elements in the Fe—Ni—O film, and a rate of surface coating within the range of 30 to 90%.

The zinciferous plating layer is an alloyed zinc dip-plating layer,and said alloyed zinc dip-plating layer comprises 6 to 11 wt. % Fe and the balance being Zn and inevitable impurities and has a coating weight of 20 to 100 $g/m^2$. The Fe—Ni—O film is formed on the surface of the alloyed zinc dip-plating layer. Said Fe—Ni—O film has a coating weight within the range of 10 to 1500 $mg/m^2$ in terms of the total weight of metallic elements in the Fe—Ni—O film; and a ratio of the Fe content (wt %) to the total of the Fe content (wt %) and a Ni content (wt %) which is within the range of 0.004 to 0.9; and an oxygen content which is within the range of 0.5 to 10 wt %.

The zinciferous plating layer is an alloyed zinc dip-plating layer; said alloyed zinc dip-plating layer comprises 9 to 14 wt. % Fe and the balance being Zn and inevitable impurities, and has a surface alloy phase which is δ1 alloy phase and a coating weight of 20 to 100 $g/m^2$. The Fe—Ni—O film is formed on the surface of the alloyed zinc dip-plating layer. Said Fe—Ni—O film has a coating weight within the range of 10 to 1500 $mg/m^2$ in terms of the total weight of metallic elements in the Fe—Ni—O film; and a ratio of the Fe content (wt %) to the total of the Fe content (wt %) and a Ni content (wt %) which is within the range of 0.004 to 0.9; and an oxygen content which is within the range of 0.5 to 10 wt %.

DESCRIPTION OF THE EMBODIMENT

EMBODIMENT 1

Figure 1:
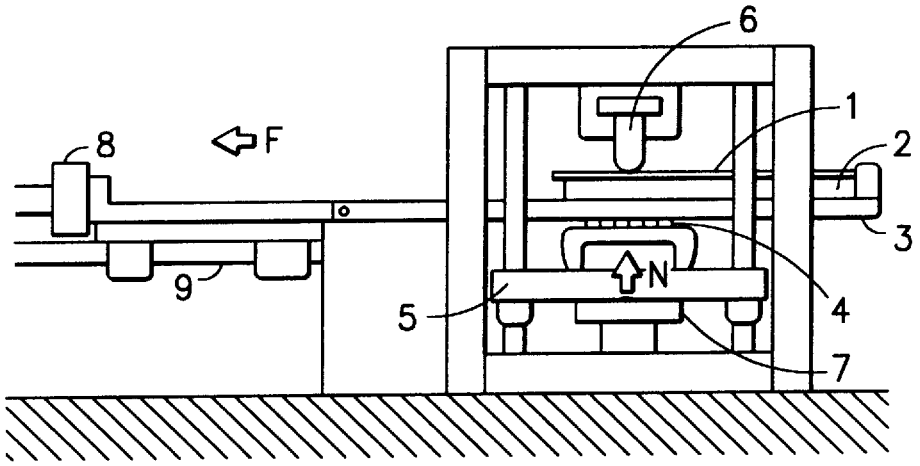
FIG. 1 is a schematic front view of a frictional coefficient measuring apparatus.

The present inventors carried out extensive studies to solve the above-mentioned problems, and found the possibility of largely improving press formability, spot weldability and adhesiveness by forming an appropriate Fe—Ni—O film on the surface of a plating layer of a zinciferous plated steel sheet.

The findings thus obtained reveal that the appropriate Fe—Ni—O film should satisfy the following conditions (1) to (3):

(1) The coating weight of the film is within a range of from 10 to 1,500 mg/m$^2$;

(2) The ratio of Fe content (wt. %) to the total content of Fe and Ni (wt. %) in this film (hereinafter referred to as the "Fe ratio in film" and expressed as "Fe/(Fe+Ni)" is within a range of from 0.05 to 0.9, or more preferably, from 0.1 to 0.5; and (3) The oxygen content in this film is within a range of from 0.5 to 10 wt. %.

The zinciferous plated steel sheet is inferior to the cold-rolled steel sheet in press formability because, under a high surface pressure, zinc having a low melting point sticks to the die, leading to an increase in sliding resistance. In order to avoid this inconvenience, it is effective to form a film having a higher hardness and a higher melting point than a zinc or zinc alloy plating layer on the surface of the plating layer of the zinciferous plated steel sheet, which reduces sliding resistance between the surface of the plating layer and the press die during press forming, and enables the zinciferous plated steel sheet to more easily slip into the press die, thus improving press formability.

The zinciferous plated steel sheet is inferior to the cold-rolled steel sheet in continuous spot weldability because, during welding, molten zinc comes into contact with the copper electrode and forms a brittle alloy layer which causes a more serious deterioration of the electrode. A method of forming a film having a high melting point on the surface of the plating layer is believed to be effective for the purpose of improving continuous spot weldability. To improve spot weldability of the zinciferous plated steel sheet, the present inventors found it particularly effective to use Ni metal as a result of studies on various films. Although the reason is not clear, conceivable causes are the high melting point and the high electric conductivity of Ni metal.

While the zinciferous plated steel sheet has been known to be inferior to the cold-rolled steel sheet in adhesiveness, the cause has not as yet been clarified. As a result of studies on the cause of this inferiority, the present inventors elucidated that adhesiveness was governed by the chemical composition of the oxide film on the surface of the zinciferous plating layer. More specifically, while the oxide film on the surface of the cold-rolled steel sheet mainly comprises Fe oxide, the film on the surface of the zinciferous plating layer mainly comprises Zn oxide. Adhesiveness varies with the chemical composition of the oxide film: Zn oxide are inferior to Fe oxide in adhesiveness. It is now possible therefore to improve adhesiveness by forming a film containing Fe oxide on the surface of the zinciferous plated steel sheet, as in the present invention.

The present invention was developed on the basis of the findings as described above, and provides a method of manufacturing a zinciferous plated steel sheet excellent in press formability, spot weldability and adhesiveness by appropriately forming an Fe—Ni—O film on the surface of a plating layer of the zinciferous plated steel sheet.

It suffices that the Fe—Ni—O film has a microscopic structure and a form such that the film comprises a mixture containing at least Ni and Fe metals and oxides of Ni and Fe, irrespective of the binding condition of elements constituting the film.

The method of manufacturing a zinciferous plated steel sheet in Embodiment 1 is characterized in that it comprises the step of carrying out electrolysis with a zinciferous plated steel sheet as a cathode in an aqueous solution containing nickel sulfate, ferrous sulfate and ferric sulfate, thereby forming a film on a surface of a plating layer of the zinciferous plated steel sheet, wherein an Fe—Ni—O film is formed by conducting electrolysis in the aqueous solution in which the total concentration of nickel sulfate, ferrous sulfate and ferric sulfate is within a range of from 0.3 to 2.0 mol/l, the ratio of concentration (mol/l) of $Fe^{3+}$ to the sum of concentration of $Fe^{2+}$ and $Fe^{3+}$ is within a range of from 0.5 to under 1.0, and pH is from 1.0 to 2.0. The plating layer of the zinciferous plated steel sheet can be an alloyed dip-plating layer having an iron content within a range of from 7 to 15 wt. %. The plating layer of the zinciferous plated steel sheet can be a zinc electroplating layer or a zinc dip-plating layer.

In the present invention, nickel sulfate, ferrous sulfate and ferric sulfate are used as components of the aqueous solution for forming an Fe—Ni—O film on the surface of a plating layer of the zinciferous plated steel sheet (hereinafter referred to as the "electrolytic solution") because electrolysis carried out with the zinciferous plated steel sheet to have the Fe—Ni—O film formed thereon as the cathode is suitable for forming the film effectively containing Fe, Ni and O.

The total concentration of nickel sulfate, ferrous sulfate and ferric sulfate should be within a range of from 0.3 to 2.0 mol/l for the following reason.

If the total concentration of these three chemical components is under 0.3 mol/l, the low electric conductivity of the electrolytic bath results in a higher electrolytic voltage. Even with a low current density, therefore, plating burn proceeds too far so that the oxygen content in the Fe—Ni—O film exceeds 10 wt. %, thus easily causing a decrease in spot weldability and chemical treatability.

With a total concentration of these components of over 2.0 mol/l, on the other hand, at a low temperature, the limit of solubility of nickel sulfate and/or ferrous sulfate is reached, thus causing precipitation of nickel sulfate and/or ferrous sulfate.

An aqueous solution having a pH of within a range of from 1.0 to 2.0 is used as the electrolytic solution for the following reason.

With a pH of the electrolytic solution of under 1.0, hydrogenation plays a main role in the cathodic reactions during electrolysis, leading to a large decrease in the current efficiency. With a pH of the electrolytic solution of over 2, on the other hand, ferric hydroxide is precipitated.

The ratio of $Fe^{3+}$ concentration (mol/l) to the sum of concentration (mol/l) of $Fe^{2+}$ and $Fe^{3+}$ in the electrolytic solution is limited within a high range of from 0.5 to under 1.0 for the following reason.

Oxygen in the Fe—Ni—O film is considered to mainly comprise oxygen existent in eutectic iron oxide. In order for the content of this oxygen in the film to be at least a prescribed value, it is advantageous to increase the concentration ratio of $Fe^{3+}$ precipitated with a low pH over that of $Fe^{2+}$ relative to the concentration ratio of $Fe^{2+}$. To achieve an oxygen content in the Fe—Ni—O film of at least 0.5 wt. %, the ratio of concentration (mol/l) of $Fe^{3+}$ to the sum of concentration (mol/l) of $Fe^{2+}$ and $Fe^{3+}$ must be at least 0.5. A higher ratio (mol/l) of the $Fe^{3+}$ concentration brings about a higher efficiency of achieving eutectic iron oxides in the Fe—Ni—O film. $Fe^{3+}$ produces hydroxides at a lower pH than that of $Fe^{2+}$ (for example, a concentration of 0.1 mol/l corresponds to a pH of 2.2 and 7.5, respectively), and this facilitates eutectic precipitation of oxides as a result of increase in pH on the surface due to electrolysis.

It is not necessary to limit the electrolytic bath temperature within a particular range. With a temperature of under 30° C., however, conductivity of the electrolytic bath becomes lower, leading to a higher electrolytic voltage. With a temperature of over 70° C., on the other hand, there is an increase in the amount of vapor of the electrolytic solution, thus making it difficult to control ion concentration of nickel and iron ions. It should therefore preferably be within a range of from 30° to 70° C.

There is no particular restrictions on current density of electrolytic plating. With a current density of under 1 $A/dm^2$, however, there occurs a considerable decrease in current efficiency because hydrogenation takes a main part in the cathodic reactions. With a current density of over 150 $A/dm^2$, on the other hand, burnt deposits proceeds, entrapping much hydroxides of nickel and iron, leading to a lower weldability. Current density should therefore be limited within a range of from 1 to 150 $A/dm^2$.

In the zinciferous plated steel sheet used for forming the Fe—Ni—O film on the surface thereof in the present invention, the surface of the plating layer should preferably comprise an alloyed dip-plating layer having an iron content of from 7 to 15 wt. %, an electroplating layer, or a dip-plating layer. The reason is that, because a zinciferous plated steel sheet having any of these plating layers is inferior to a cold-rolled steel sheet or a zinc-nickel alloy plated steel sheet in workability, or particularly, press formability, and spot weldability, formation of the Fe—Ni—O film of the present invention on the foregoing plating layer provides a remarkable improvement effect of press formability and spot weldability.

The electrolytic solution may contain cations such metals as Zn, Co, Mn, Mo, Al, Ti, Sn, W, Si, Pb, Nb and Ta, which are contained in the zinciferous plating layer, oxides and hydroxides of these metals, and anions other than chlorine cation.

The zinciferous plated steel sheet used in the present invention is a steel sheet on the surface of which a zinciferous plating layer is formed by any of the dip plating method, the electroplating method and the vapor plating method. The zinciferous plating layer comprises, in addition to pure zinc, a single-layer or a plurality of plating layers containing one or more of such metals as Fe, Ni, Co, Mn, Cr, Al, Mo, Ti, Si, W, Sn, Pb, Nb and Ta (Si is also regarded as a metal), or oxides thereof, or organic substances. The layer may contain furthermore such fine particles as $SiO_2$ and $Al_2O_3$. The zinciferous plating layer may comprise a plurality of layers, each containing the same ingredients with different contents. Furthermore, the zinciferous plating layer may comprise a plurality of layers, each containing the same ingredients of which the contents sequentially vary in the thickness direction, known as "functional gradient plating layers".

The Fe—Ni—O film formed on the surface of the plating layer of the zinciferous plated steel sheet under the foregoing limiting conditions eliminates sticking between the steel sheet and the die during press forming, reduces sliding resistance, improves flowing-in into the die, inhibits formation of a brittle alloy layer between the sheet and the copper electrode during spot welding, thus improving continuous spot weldability and improves adhesiveness under the effect of the film containing Fe oxides. With a coating weight of the Fe—Ni—O film (total conversion weight of metal elements in the film) of under 10 mg/m$^2$, the effect of improving press formability is unavailable. With a coating weight of over 1,500 mg/m$^2$, on the other hand, the improving effect of press formability is saturated. The coating weight (total conversion weight of metal elements in the film) of the Fe—Ni—O film should therefore preferably be within a range of from 10 to 1,500 mg/m$^2$.

The improving effect of adhesiveness cannot be achieved if the ratio of Fe content (wt. %) to the sum of Fe content and Ni content (wt. %) in the Fe—Ni—O film (Fe/(Fe+Ni) in the film) is under 0.05. When Fe/(Fe+Ni) in the film is over 0.9, on the other hand, the Ni content in the film decreases, resulting in a decreased ratio of Zn—Ni alloy of a high melting point formed during welding, and this results in more serious deterioration of the electrode, thus preventing achievement of the improving effect of spot weldability.

The ratio Fe/(Fe+Ni) in the film should therefore preferably be within a range of from 0.05 to 0.9, or more preferably, from 0.1 to 0.5.

The preferable range of the oxygen content in the Fe—Ni—O film is from 0.5 to 10 wt. %. With an oxygen content of under 0.5 wt. %, metal properties of the film becomes more apparent, reducing the improving effect of press formability. With an oxygen content of over 10 wt. %, on the other hand, the amount of oxides becomes too large, resulting in an increase in electric resistance of the surface, a decrease in weldability, and inhibited production of phosphate crystals, leading to deterioration of chemical treatability.

EXAMPLES

The zinciferous plated steel sheet before application of electrolysis by the method of the present invention or a comparative method is any of the following playing types GA, GI and EG formed thereon:

GA: There is formed an alloyed dip-plating layer comprising 10 wt. % Fe and the balance Zn in a coating weight of 60 g/m$^2$ for each of the both surfaces;

GI: There is formed a dip-plating layer in a coating weight of 90 g/m$^2$ for each of the both surfaces;

EG: There is formed an electroplating layer in a coating weight of 40 g/m$^2$ for each of the both surfaces.

With the zinciferous plated steel sheet as the cathode, an electrolytic treatment was applied in a mixed solution containing nickel sulfate, ferrous sulfate and ferric sulfate in prescribed concentrations, thereby forming an Fe—Ni—O film on the surface of the zinciferous plated steel sheet to prepare a sample. For some samples, electrolytic treatment was omitted.

Table 1 shows electrolytic conditions for Examples 1 to 20 subjected to electrolysis under conditions within the scope of the present invention, and Comparative Examples 2, 3 and 5 subjected to electrolysis under conditions, at least one of which was outside the scope of the present invention. For the Comparative Examples 1, 4 and 6 in Table 1, treatment was limited to dip into electrolytic solution without applying an electrolytic treatment. Table 1 shows also plating types of steel sheets before application of electrolytic treatment, chemical composition of electrolytic solution, pH, temperature, current density and time.

TABLE 1

| | | Electrolytic Condition for Film Forming | | | | | |
|---|---|---|---|---|---|---|---|
| | | Chemical Composition of Electrolyte | | | | | |
| Test Division | Type of Plating | Nickel Sulfate Content and Total (Ferrous Sulfate) + (Ferric Sulfate) Content | $Fe^{3+}/(Fe^{2+} + Fe^{3+})$ | pH | Current Temperature (°C.) | Turn-on Density (A/cm$^2$) | Period (sec) |
| Comparative Example 1 | GA | Nickel Sulfate: 1.0 mol/l Ferrous Sulfate + Ferric Sulfate: 0.2 mol/l | — | 2 | 50 | — | — |
| Comparative Example 2 | GA | | 0.4 | 2 | 50 | 5 | — |
| Example 1 | GA | | 0.5 | 2 | 50 | 5 | 1 |
| Example 2 | GA | | 0.6 | 2 | 50 | 5 | 1 |
| Example 3 | GA | | 0.7 | 2 | 50 | 5 | 1 |
| Example 4 | GA | | 0.8 | 2 | 50 | 5 | 1 |
| Example 5 | GA | | 0.9 | 2 | 50 | 5 | 1 |
| Example 6 | GA | | 0.99 | 2 | 50 | 5 | 1 |
| Comparative Example 3 | GA | Nickel Sulfate: 0.5 mol/l Ferrous Sulfate + Ferric Sulfate: 0.2 mol/l | 0.4 | 1.5 | 50 | 10 | 1 |
| Example 7 | GA | | 0.5 | 1.5 | 50 | 10 | 1 |
| Example 8 | GA | | 0.6 | 1.5 | 50 | 10 | 1 |
| Example 9 | GA | | 0.7 | 1.5 | 50 | 10 | 1 |
| Example 10 | GA | | 0.8 | 1.5 | 50 | 10 | 1 |
| Example 11 | GA | | 0.9 | 1.5 | 50 | 10 | 1 |
| Example 12 | GA | | 0.99 | 1.5 | 50 | 10 | 1 |
| Comparative Example 4 | EG | Nickel Sulfate: 1.5 mol/l Ferrous Sulfate + Ferric Sulfate: 0.4 mol/l | — | 1.2 | 60 | — | — |
| Comparative Example 5 | EG | | 0.4 | 1.2 | 60 | 20 | 1 |
| Example 13 | EG | | 0.5 | 1.2 | 60 | 20 | 1 |
| Example 14 | EG | | 0.6 | 1.2 | 60 | 20 | 1 |

TABLE 1-continued

| | | Electrolytic Condition for Film Forming | | | | | |
|---|---|---|---|---|---|---|---|
| | | Chemical Composition of Electrolyte | | | | | |
| Test Division | Type of Plating | Nickel Sulfate Content and Total (Ferrous Sulfate) + (Ferric Sulfate) Content | $Fe^{3+}/(Fe^{2+} + Fe^{3+})$ | pH | Current Temperature (°C.) | Turn-on Density ($A/cm^2$) | Period (sec) |
| Example 15 | EG | | 0.7 | 1.2 | 60 | 20 | 1 |
| Example 16 | EG | | 0.8 | 1.2 | 60 | 20 | 1 |
| Example 17 | EG | | 0.9 | 1.2 | 60 | 20 | 1 |
| Example 18 | EG | | 0.99 | 1.2 | 60 | 20 | 1 |
| Comparative Example 6 | GI | Nickel Sulfate: 1.5 mol/l Ferrous Sulfate + Ferric Sulfate: 0.4 mol/l | — | 2 | 50 | — | — |
| Comparative Example 7 | GI | | 0.4 | 2 | 50 | 5 | 1 |
| Example 19 | GI | | 0.5 | 2 | 50 | 5 | 1 |
| Example 20 | GI | | 0.9 | 2 | 50 | 5 | 1 |

The ratio of concentration of ferrous sulfate to ferric sulfate in the electrolytic solution was controlled by adjusting the concentration of chemicals added. When the ratio of ferrous sulfate to ferric sulfate varied according as electrolysis proceeds, however, the ratio was controlled by adding an oxidizing agent such as hydrogen peroxide into the electrolytic solution to oxidize ferrous ion into ferric ion, or by bringing ferric ion into contact with metallic iron to reduce it into ferrous ion.

For the Fe—Ni—O film formed on each sample treated by electrolysis as described above, the coating weight of the film (total conversion weight of metal elements in the film), the ratio of Fe content (wt. %) to the sum of Fe and Ni contents (wt. %) in the film, and oxygen content in the film were measured as follows.

[Measurement of coating weight of film (total conversion weight of metal elements in film) and Fe/(Fe+Ni) in film]

For the samples of plating types GI and EG, the coating weight of the Fe—Ni—O film (total conversion weight of metal elements in the film) and chemical composition were measured by dissolving the Fe—Ni—O film, together with the plating layer thereunder (zinciferous plating layer; the same applies also hereafter), with diluted hydrochloric acid to cause peeling, and performing quantitative analysis of Fe and Ni by the ICP method (abbreviation of Inductively Coupled Plasma Spectroscopic method). Then, the ratio Fe/(Fe+Ni) in the film was calculated.

For the samples of plating types GA, it was difficult to completely separate the component elements in the upper Fe—Ni—O film from those of the lower plating layer by the ICP method, since the lower plating layer contained the component elements of the Fe—Ni—O film. Therefore, only component elements of the Fe—Ni—O film not contained in the lower plating layer were quantitatively analyzed by the ICP method. Further, after Ar ion sputtering, the chemical composition distribution of the individual component elements in the Fe—Ni—O film in terms of the depth of the plating layer was measured by repeating measurement of the individual component elements of the Fe—Ni—O film by the XPS method(abbreviation of X-ray Photoelectron Spectroscopic method), starting from the film surface. In this measurement, the distance between the depth at which a component element of the Fe—Ni—O film not contained in the lower plating layer showed a maximum concentration and the position equal to a half the depth at which that element was no more detected was taken as the thickness of the Fe—Ni—O film. The coating weight of the Fe—Ni—O film (total conversion weight of metal elements in the film) and the chemical composition were calculated from the results of the ICP method and those of the XPS method. Then, the ratio Fe/(Fe+Ni) was calculated.

[Measurement of oxygen content in film]

The oxygen content in the film was determined from the result of analysis in the depth direction based on the Auger electron spectroscopy (AES).

Table 2 shows the results of measurement of the coating weight of the Fe—Ni—O film (total conversion weight of metal elements in the film), the ratio Fe/(Fe+Ni) in the film, and oxygen content in the film for the individual samples obtained from Examples 1 to 20 and Comparative Examples 1 to 7, i.e., samples Nos. 1 to 20 of the present invention and comparative samples Nos. 1 to 7.

TABLE 2

| Test Division | Sample | Fe—Ni—O Film: Coating Weight ($mg/m^2$) (Total Weight of Metal Elements in Film | Fe—Ni—O Film: Fe Ratio Fe/Fe + Ni) | Fe—Ni—O Film: Oxygen Content (wt. %) | Properties: Press Formability Frictional Coefficient (-): Bead Type: A | Properties: Press Formability Frictional Coefficient (-): Bead Type: B | Properties: Spot Weldability: Continuous Spot Weldability (-) | Properties: Adhesiveness Peeloff Strength (kgf/25 mm) |
|---|---|---|---|---|---|---|---|---|
| Comparative Example 1 | Comparative Sample 1 | 0 | — | — | 0.171 | 0.255 | 2900 | 6.8 |
| Comparative Example 2 | Comparative Sample 2 | 75 | 0.26 | 0.40 | 0.147 | 0.173 | 5200 | 9.5 |
| Example 1 | Sample of Invention 1 | 74 | 0.25 | 0.50 | 0.125 | 0.151 | 5100 | 12.0 |
| Example 2 | Sample of Invention 2 | 72 | 0.25 | 1.00 | 0.127 | 0.150 | 5100 | 12.1 |
| Example 3 | Sample of Invention 3 | 70 | 0.26 | 4.00 | 0.125 | 0.151 | 5200 | 12.4 |
| Example 4 | Sample of Invention 4 | 64 | 0.24 | 6.00 | 0.124 | 0.152 | 5400 | 12.3 |
| Example 5 | Sample of Invention 5 | 66 | 0.27 | 7.00 | 0.125 | 0.147 | 5200 | 12.5 |
| Example 6 | Sample of Invention 6 | 62 | 0.26 | 8.00 | 0.123 | 0.148 | 5100 | 12.4 |
| Comparative Example 3 | Comparative Sample 3 | 80 | 0.42 | 0.30 | 0.146 | 0.168 | 5000 | 8.6 |
| Example 7 | Sample of Invention 7 | 78 | 0.40 | 0.60 | 0.123 | 0.148 | 5100 | 12.2 |
| Example 8 | Sample of Invention 8 | 75 | 0.42 | 1.90 | 0.124 | 0.142 | 5000 | 12.1 |
| Example 9 | Sample of Invention 9 | 82 | 0.41 | 4.00 | 0.125 | 0.144 | 5200 | 12.2 |
| Example 10 | Sample of Invention 10 | 80 | 0.40 | 5.00 | 0.125 | 0.143 | 5200 | 12.1 |
| Example 11 | Sample of Invention 11 | 82 | 0.44 | 7.00 | 0.125 | 0.142 | 5200 | 12.6 |
| Example 12 | Sample of Invention 12 | 83 | 0.40 | 9.00 | 0.126 | 0.144 | 5000 | 12.9 |
| Comparative Example 4 | Comparative Sample 4 | 0 | — | — | 0.224 | 0.306 | 1900 | 5.6 |
| Comparative Example 5 | Comparative Sample 5 | 100 | 0.61 | 0.30 | 0.146 | 0.168 | 3900 | 7.6 |
| Example 13 | Sample of Invention 13 | 105 | 0.60 | 0.60 | 0.126 | 0.146 | 4100 | 12.6 |
| Example 14 | Sample of Invention 14 | 105 | 0.62 | 1.50 | 0.124 | 0.146 | 4100 | 12.4 |
| Example 15 | Sample of Invention 15 | 110 | 0.62 | 3.60 | 0.124 | 0.145 | 4100 | 12.4 |
| Example 16 | Sample of Invention 16 | 102 | 0.62 | 4.20 | 0.123 | 0.144 | 4100 | 12.3 |
| Example 17 | Sample of Invention 17 | 100 | 0.60 | 6.60 | 0.125 | 0.148 | 4100 | 12.0 |
| Example 18 | Sample of Invention 18 | 100 | 0.61 | 8.50 | 0.124 | 0.145 | 4100 | 12.3 |
| Comparative Example 6 | Comparative Sample 6 | 0 | — | — | 0.210 | 0.320 | 900 | 3.8 |
| Comparative Example 7 | Comparative Sample 7 | 70 | 0.25 | 0.40 | 0.151 | 0.175 | 3800 | 8.0 |
| Example 19 | Sample of Invention 19 | 72 | 0.25 | 0.55 | 0.121 | 0.149 | 3900 | 12.1 |
| Example 20 | Sample of Invention 20 | 72 | 0.24 | 7.00 | 0.123 | 0.152 | 4000 | 12.1 |

Subsequently, measurement of frictional coefficient, a continuous spot weldability test and an adhesiveness test in spot welding were carried out in the manner as described below with a view to evaluating press formability, spot weldability and adhesiveness for samples of the invention Nos. 1 to 20 and comparative samples Nos. 1 to 7.

[Measurement of frictional coefficient]

FIG. 1 is a schematic front view illustrating the measuring apparatus of frictional coefficient. As shown in FIG. 1, a frictional coefficient measuring sample 1 taken from a sample was fixed on a sample stand 2 which was fixed on the upper surface of a horizontally movable sliding table 3. The lower surface of the sliding table 3 was provided with a vertically movable sliding table support 5 having rollers 4 in contact with the lower surface. A first load cell 7 for measuring a pressing load N onto a frictional coefficient measuring sample 1 by a bead 6 by pushing up the sliding table support 5 was attached to the sliding table support 5. Under the action of this pressing force, an end in the horizontally moving direction of the sliding table 3 is attached with a second load cell 8 for measuring sliding resistance F for horizontally moving the sliding table 3.

The frictional coefficient g between the sample and the bead was calculated by a formula: $\mu$=F/N. In this calculation, the pressing load was 400 kgf and a pulling speed of sample (horizontal moving speed of the sliding table 3) was 100 cm/minute. Beads of the following two kinds of size and shape were employed.

Figure 2:
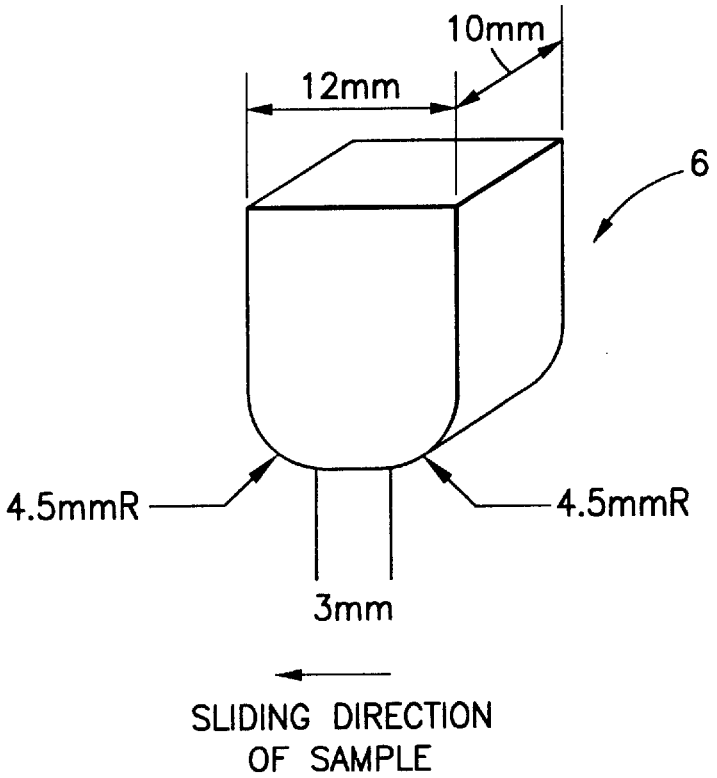
FIG. 2 is a schematic perspective view illustrating the shape and size of a first type bead (bead type A) shown in FIG. 1.

FIG. 2 is a schematic perspective view illustrating the shape and size of a bead of a first type (hereinafter referred to as the "bead type A"). Sliding is conducted in a state in which the lower surface of the bead 6 is pressed against the surface of the sample 1. The lower surface thereof has a plane with a width of 10 mm and a length of 3 mm in the sliding direction, and a ¼ cylinder surface having a radius of curvature of 4.5 mm is in contact with each of lines of a width of 10 mm on the front and back surfaces as shown in FIG. 2.

Figure 3:
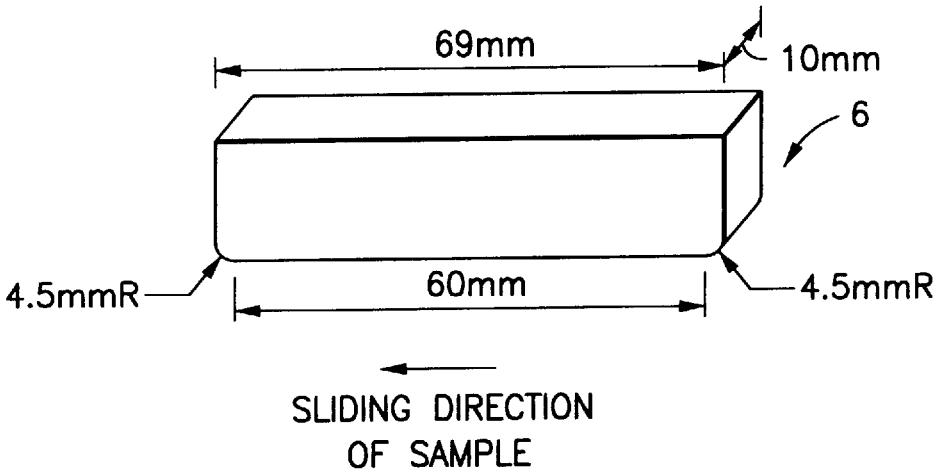
FIG. 3 is a schematic perspective view illustrating the shape and size of a second type bead (bead type B) shown in FIG. 1.

FIG. 3 is a schematic perspective view illustrating the shape and size of a bead of a second type (hereinafter referred to as the "bead type B"). In the bead type B, the length in the sliding direction of the sliding surface, which is 3 mm in the bead type A, is increased to 60 mm, and the other portions are the same as those in the bead type A.

In the both types A and B, NOX RUST 550 HN made by Nihon Perkerizing Co. Ltd. was applied as a lubricant oil onto the upper surface of the sample 1 for the measurement of frictional coefficient, and a test was carried out.

[Continuous spot weldability test]

Two samples of the same No. were placed one on top of the other between a pair of electrode chips of a spot welding machine, and electrifying the piled samples while applying a pressure to same, thereby continuously carrying out a resistance-welding with a concentrated welding current, i.e., a spot-welding, under the following conditions:

Electrode chip: A dome type chip having an end diameter of 6 mm

Pressing force: 250 kgf

Welding time: 12 cycles (60 Hz)

Welding current: 11.0 KA

Welding speed: 1 spot/sec

Continuous spot weldability was evaluated in terms of the number of continuous spot-welding runs performed before the diameter of a metallic portion having melted and solidified (hereinafter referred to as a "nugget") produced in a weld zone between the two piled samples during spot-welding becomes under $4\times t^{1/2}$ (t: thickness of a sample). This number of spots is hereinafter referred to as the "electrode life."

[Adhesiveness test]

The following adhesiveness test piece was prepared from each of the samples.

Figure 4:
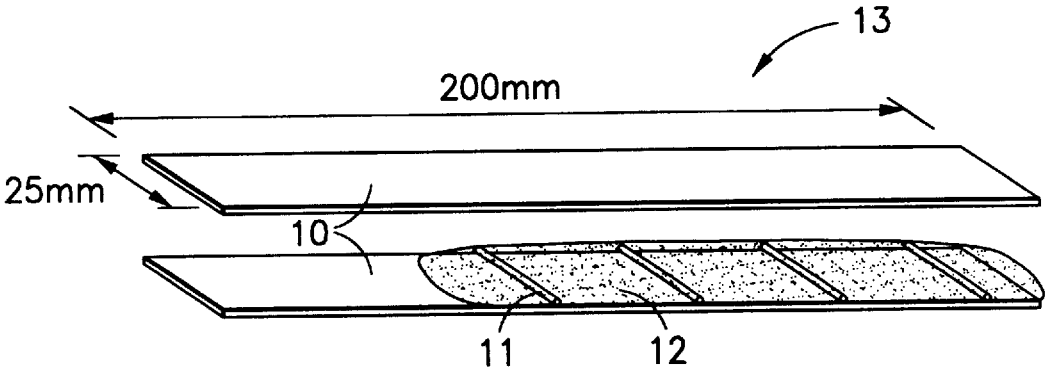
FIG. 4 is a schematic perspective view illustrating a process of assembly of a test piece for adhesiveness test.

FIG. 4 is a schematic perspective view illustrating the assembly process. As shown in FIG. 4, a test piece 13 was prepared by placing two samples 10 having a width of 25 mm and a length of 200 mm one on top of the other via a spacer 11 having a diameter of 0.15 mm in between so that the adhesive agent 12 had a thickness of 0.15 mm, and bonding these two samples. The thus prepared test piece was subjected to a baking treatment at 150° C. for ten minutes.

Figure 5:
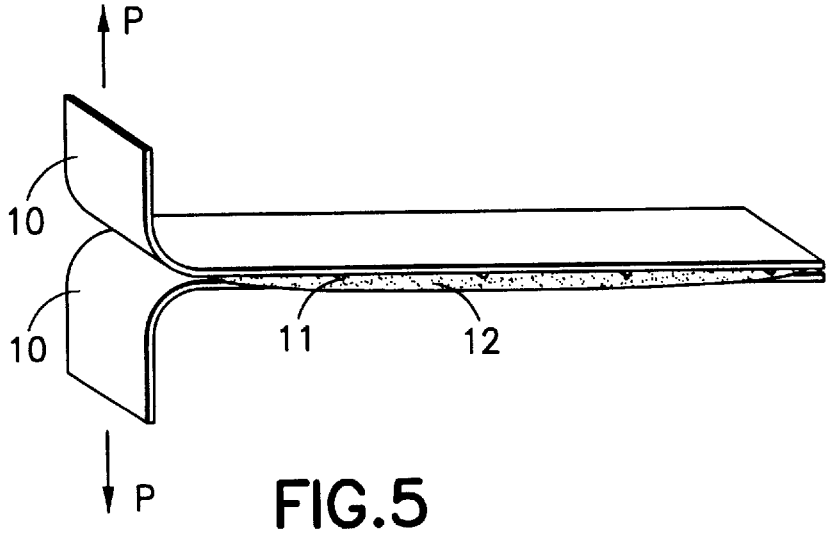
FIG. 5 is a schematic perspective view illustrating loading of a tensile load upon measuring peeloff strength in an adhesiveness test.

The thus prepared test piece was folded into a T shape as shown in FIG. 5, subjected to a tensile test at a speed of 200 mm/min by means of a tensile tester, and an average peeloff strength (n=3) was measured upon peeling of the test piece. Peeloff strength was calculated by determining an average load from a load chart of tensile load curve obtained upon peeling and the result was expressed in kgf/25 mm. In FIG. 5, P represents tensile load. As the adhesive agent, there was used a vinyl chloride resin type adhesive agent for hem-flange adhesion.

Table 2 shows the results of determination of frictional coefficient, continuous spot welding runs and peeloff strength of the individual samples obtained in the foregoing tests. From Table 2, the following points are evident.

All the samples of the invention Nos. 1 to 20 show a small frictional coefficient and a satisfactory press formability. In terms of the continuous spot welding runs, any of the samples of the invention Nos. 1 to 20 is larger in this number by at least 1,000 points than the comparative samples 1, 4 and 6 not subjected to electrolysis, leading to a longer electrode life. Any of the samples of the invention shows a peeloff strength of at least 12 kgf/25 mm, corresponding to a very good adhesiveness.

For all the comparative samples Nos. 1 to 7 outside the scope of the present invention, at least one of frictional coefficient, the continuous spot welding runs and peeloff strength is defective and is low in at least any of press formability, spot weldability and adhesiveness.

According to the present invention having the construction as described above, the Fe—Ni—O film formed on the surface of the plating layer of the zinciferous plated steel sheet has a higher hardness and a higher melting point than a zinc or zinc alloy plating layer. Presence of this film in an appropriate amount reduces sliding resistance between the surface of the plating layer and a press die during press forming of the zinciferous plated steel sheet, and enables the zinciferous plated steel sheet to easily flow into the die. The Fe—Ni—O film of a high melting point permits improvement of continuous spot weldability. Presence of Fe oxides in the Fe—Ni—O film improves peeloff strength of bonded substrates. Furthermore, as it is possible to adjust the oxygen content in the film to prevent it from exceeding a certain limit, a zinciferous plated steel sheet excellent in chemical treatability is available. According to the present invention, therefore, there is provided a zinciferous plated steel sheet excellent in press formability, spot weldability and adhesiveness, thus providing industrially very useful effects.

EMBODIMENT 2

The Inventors earnestly conducted research for solving the above-described problems. As a result, the Inventors have found that the press-formability, spot-weldability, and adhesiveness of a zinciferous plated steel sheet can be markedly improved by forming a proper Fe—Ni—O film on its surface.

According to the Inventor's findings, the proper Fe—Ni—O film satisfies the following requirements.

(1) The coating weight is within a range of 10 through 1500 mg/m$^2$ in terms of total weight of the metals in the film.

(2) The ratio of the Fe content (% by weight) against the sum of the Fe content and Ni content (% by weight) in the film is within a range of 0.05 through 0.9, and preferably, within a range of 0.1 through 0.5. [Hereinafter, this ratio may be referred to as Fe ratio in a film, and expressed by Fe/(Fe+Ni).]

(3) The oxygen content in the film is within a range of 0.5 through 10% by weight.

The cause of inferiority of zinciferous plated steel sheets to cold-rolled steel sheets in press-formability is the increased sliding resistance attributed to sticking between the die and zinc having a low melting point which occurs under a high surface pressure. What is effective to avoid this is to form, on the surface of a zinciferous plated steel sheet, a film which is harder than zinc or zinc-alloy plating layer and has a higher melting point. This decreases the sliding resistance between the surface of the plating layer and the press die during press forming, allows the zinciferous plated steel sheet to easily flow into the press mold, and therefore, improves press-formability.

Meanwhile, the cause of the inferiority of zinciferous plated steel sheets to cold-rolled steel sheets in continuous spot-weldability during spot welding is the rapid electrode deterioration attributed to a brittle alloy layer which is formed on the electrode by the contact of melted. zinc with electrode copper during welding. Here, it has been recognized as effective for improving the continuous spot-weldability of zinciferous plated steel sheets to form a film having a high melting point on their surfaces. The Inventors conducted research on various coats in order to improve the spot-weldability of zinciferous plated steel sheets, and as a result, they have found that a Ni metal is especially effective. Though the mechanism of this effectiveness has not yet been clarified in detail, it may be attributed to the high melting point and the high electric conductivity of the Ni metal.

Though the fact that zinciferous plated steel sheets are inferior to cold-rolled steel sheets in adhesiveness properties is already known, the reason for this has not been revealed yet. Under the circumstances, the Inventors conducted research on the reason. As a result, adhesiveness have been found to be controlled by the composition of the oxide film on the surface of the steel sheet. In cold-rolled steel sheets, the oxide film on the surface of the steel sheet principally consist of Fe oxides. In contrast, the principal ingredient in a zinciferous plated steel sheet is Zn oxide. Differences in adhesiveness depend on the composition of the oxide film, and the Zn oxide is inferior to the Fe oxide in adhesiveness. Consequently, improvement in the adhesiveness of zinciferous plated steel sheet has been accomplished by forming a film containing an Fe oxide on their surface in the manner of the present invention.

As described above, the oxygen content in the Fe—Ni—O film should essentially be within a range of 0.5 through 10 wt. %. The Inventors have also obtained the following findings to achieve the above essential requirement.

The Fe—Ni—O film contains oxygen principally in the iron oxide formed as eutectoid. For achieving such an eutectic iron oxide by cathode electrolysis, the deposition rate of the Fe—Ni—O film should be accelerated so that the diffusion rate of the metal ions cannot catch up with it, namely, a state of so-called burnt deposit should be generated. Specifically, the electrolysis should be performed essentially with a current density beyond the limiting current which is determined according to the composition of the electrolytic plating bath and the electrolysis conditions.

The present invention has been accomplished based on the above findings, provides a method for a zinciferous plated steel sheet excellent in press-formability, spot-weldability, and adhesiveness by properly forming an Fe—Ni—O film on the surface of the plating layer on a zinciferous plated steel sheet, and is illustrated below.

Here, as to the micro-texture and formation of the Fe—Ni—O film, the bonding conditions of elements constituting the film are not limited, as far as the film comprises a mixture containing at least metals of Ni and Fe, and oxides of Ni and Fe.

The method for manufacturing a zinciferous steel sheet according to Embodiment 2 comprises forming a film on the surface of the plating layer on a zinciferous plated steel sheet by electrolysis using the zinciferous plated steel sheet as a cathode in a plating solution which comprises an aqueous solution containing nickel sulfate and ferrous sulfate, wherein the electrolysis is performed under the following conditions to form an Fe—Ni—O film: Total concentration of nickel sulfate and ferrous sulfate in the plating solution is within a range of 0.1 through 2.0 mol/l, and preferably, within a range of 0.1 through 0.5 mol/l; the pH of the solution is within a range of 1.0 through 3.0; and the relationship between the sum of the concentrations of the nickel ions and ferrous ions in the plating solution, M (mol/l), the mean flow rate of the plating solution, U (m/s), and the current density in the electrolysis, $I_K$ (A/dm$^2$) satisfies the following equation (1).

$$I_K/(U^{1/2}M)=50 \text{ through } 150 \quad (1)$$

The plating layer on the surface of the steel sheet can be an alloyed zinc dip-plating layer containing iron in an amount within a range of 7 through 15 wt. %. Furthermore, the plating layer on the surface of the steel sheet can be a zinc electroplating layer or a zinc dip-plating layer.

Incidentally, in the present patent specification, the Fe—Ni—O film formed as an upper layer on the surface of the zinciferous plating layer is referred to as "film" distinguishingly from the zinc or zinciferous plating layer as an lower layer which is referred to as "plating layer".

Next, the reasons for the above-described limitation in the manufacturing conditions of the present invention will be illustrated.

In the present invention, nickel sulfate and ferrous sulfate are used as the ingredients of the plating solution used for formation of the Fe—Ni—O film on the surface of the plating layer on a zinciferous plated steel sheet since these sulfates are suitable for efficient introduction of Fe, Ni, and O into the film to be formed when the zinciferous plated steel sheet to be provided with the Fe—Ni—O film is allowed to be a cathode.

The following are basis for specifying the total concentration of nickel sulfate and ferrous sulfate to be 0.1 through 2.0 mol/l, and preferably, 0.1 through 0.5 mol/l.

With a total concentration below 0.1 mol/l, the voltage for electrolysis will be higher due to the lower conductivity of the plating bath, and therefore, a rectifier applicable to a higher voltage is required. For this reason, such a low concentration is unsuitable.

On the other hand, with a total concentration exceeding 2.0 mol/l, nickel sulfate and/or ferrous sulfate will precipitate at a lower temperature since the concentration will reach the upper limit of the solubility of nickel sulfate and/or ferrous sulfate. Further, the limiting current density will be large, and thereby, the state of burnt deposits cannot be achieved unless the electrolysis is carried out with a markedly higher current density. Moreover, in such a case, the electrolyzing time to obtain the optimum coating weight of the Fe—Ni—O film will be as remarkably short as below 1 second, and such electrolysis will be difficult to control. From these view points, the total concentration should be set below 2.0 mol/l, and preferably, 0.5 mol/l or less.

Additionally, the electrolytic solution may contain cations, hydroxides, and/or oxides such as of Zn, Co, Mn, Mo, Al, Ti, Sn, W, Si, Pb, Nb, and Ta, which may be contained in the plating layer on the zinciferous plated steel sheet to be used in the present invention, and also, the solution may contain anions which do not affect the electrolytic reaction and are not chloride ions, fluoride ions, bromide ions, nor iodide ions.

The following are the reasons for the use of the electrolytic solution which has a pH value within a range of 1.0 through 3.0.

With a pH value of the electrolytic solution below 1.0, hydrogen gas will be a principal resultant of the electrolytic reaction at the cathode while severely decreasing the current efficiency. On the other hand, with a pH value of the electrolytic solution exceeding 3, ferric hydroxide will precipitate.

The temperature of the plating bath may not necessarily be limited. However, with a temperature below 30° C., the conductivity of the plating bath will be lower, and thereby, the voltage for the electrolysis will be higher. In such a case, the oxygen content in the Fe—Ni—O film tends to be larger. On the other hand, the control of the concentration of nickel ions and ferrous ions will be difficult with a temperature exceeding 70° C. since the vaporizing amount of the electrolytic solution will be large. Consequently, the temperature of the plating bath should preferably be 30 through 70° C.

In general, the limiting current density $I_{kd}$, which is a limitation for non-occurrence of burnt deposits and which relates to ingredient metals, is expressed by the following equation (2), and is proportional to the diffusion coefficient D and the ionic concentration M of the metal to be deposited but is inversely proportional to the thickness δ of the diffusion layer to be formed on the surface of the steel sheets.

$$I_{kd}=nFD(M/\delta) \quad (2)$$

In the above equation, n is the number of the valency of the metal ion; F is the Faraday constant; D is the diffusion coefficient of the metal ion; and M is the ionic concentration of the metal to be deposited.

In contrast, the Inventors conducted a study on the relationship between the limiting current density $I_{kd}$, the ionic concentration M of the metal to be deposited, the mean flow rate U of the plating solution, and the temperature of the plating bath. As a result, the limiting current density $I_{kd}$ has been found to be proportional to the ionic concentration M of the metal to be deposited and to the square root of the mean flow rate U of the plating solution. Specifically, the relationship expressed by the following equation (3) has been found.

$$I_{kd}=k(U^{1/2}M) \quad (3)$$

$I_{kd}$: limiting current density ($A/dm^2$)

U: mean flow rate of the plating solution (m/s)

M: sum of the ionic concentrations of all metals in the plating solution (mol/l)

k: constant

The following equation (4) is obtained by modifying the equation (3).

$$I_{kd}/(U^{1/2}M)=k \quad (4)$$

As a result of further research, the Inventors have found that the constant k should be 50 or more to achieve 0.5 wt. % or more of the oxygen content in the Fe—Ni—O film, and that the constant k should be 150 or less to achieve 10 wt. % or less of the oxygen content.

Accordingly, to restrict the oxygen content in the Fe—Ni—O film within a range of 0.5 through 10 wt. %, the sum of ionic concentrations of all metals in the plating solution, M (mol/l), the mean flow rate of the plating solution, U (m/s), and the current density in the electrolysis, $I_K$ ($A/dm^2$) should satisfy the relationship expressed by the following equation (1).

$$I_K/(U^{1/2}M)=50 \text{ through } 150 \quad (1)$$

Here, the mean flow rate of the plating solution indicates the mean value of the flow rate at the middle point between the anode and the cathode.

Incidentally, in the present invention, a large part of the metal ions in the plating bath for deposition are nickel ions and ferrous ions, and other ions do not essentially affect the deposition of the Fe—Ni—O film except for ferric ions. The concentration of ferric ion should be limited to 0.09 mol/l or less since ferric ion decreases the deposition efficiency of the Fe—Ni—O film and causes deterioration of the zinciferous plated steel sheet.

As to the zinciferous plated steel sheet to be provided with an Fe—Ni—O film on the surface in the present invention, the plating layer on the surface should preferably comprise an alloyed zinc dip-plating layer containing 7 through 15 wt. % iron, zinc electroplating layer, or zinc dip-plating layer. The zinciferous plated steel sheets having such plating layer are inferior to cold-rolled steel sheets and zinc-nickel-alloy-plated steel sheets in processability, especially press-formability, and weldability or the like. Such a zinciferous plated steel sheet will, therefore, be considerably improved in press-formability and spot-weldability by forming the Fe—Ni—O film on the surface of the above-mentioned plating layer.

Incidentally, the zinciferous plated steel sheet to be used in the present invention is, in the state previous to formation of the Fe—Ni—O film, a steel sheet provided with a zinc plating layer on its surface by dip-plating, electroplating, vapor deposition, or the like. The ingredients of the zinc plating layer are, in addition to pure zinc, metals such as Fe, Ni, Co, Mn, Cr, Al, Mo, Ti, Si, W, Sn, Pb, and Ta (wherein Si is also regarded as a metal), or oxide thereof, or the plating layer may comprise a single or a plurality of layers containing one or more organic substances. Additionally, the above-mentioned plating layer may contain fine particles such as $SiO_2$ particles and $Al_2O_3$ particles. The zinciferous plating layer may comprise a plurality of layers, each containing the same ingredients with different contents. Furthermore, the zinciferous plating layer may comprise a plurality of layers, each containing the same ingredients of which the contents sequentially vary in the thickness direction, known as functional gradient plating layers.

When an Fe—Ni—O film is formed on the surface of the plating layer on a zinciferous plated steel sheet according to the specified conditions as described above, the following advantages or effects can be achieved: The sliding resistance will decrease since sticking between the steel sheet and the die will not occur during press forming, and therefore, the steel sheet will readily flow into the mold; on spot-welding, the continuous spot-weldability will be improved since the formation of a brittle alloy layer between the steel sheet and the electrode copper can be inhibited; and adhesiveness will be improved by the function of the film containing an Fe oxide.

The Fe—Ni—O film formed on the surface of the plating layer of a zinciferous plated steel sheet according to the specified conditions as described above brings about the following advantages and effects: Sticking between the steel sheet and the die during press forming does not occur, and therefore, sliding resistance decreases and the steel sheet readily flows into the mold; during spot-welding, the formation of the brittle alloy layer between the electrode copper and the steel is inhibited to improve continuous spot-weldability; and adhesiveness are improved by the function of the film containing an Fe oxide. However, when the coating weight of the Fe—Ni—O film is below 10$mg/m^2$, press-formability cannot be improved. On the other hand, with the coating weight exceeding 1500 $mg/m^2$, the improving effect in press-formability will be saturated. Accordingly, the coating weight of the Fe—Ni—O film should preferably be within a range of 10 through 1500 $mg/m^2$.

The improving effect in adhesiveness cannot be exhibited when the ratio of the Fe content (% by weight) to the sum of the Fe content and the Ni content (% by weight) in the Fe—Ni—O film, namely, the Fe/(Fe+Ni) in the film, is below 0.05. On the other hand, when the Fe/(Fe+Ni) in the film exceeds 0.9, the ratio of the Zn—Ni alloy which is formed during welding and which has a higher melting point will decrease since the content of Ni present in the film will decrease. As a result, the electrodes will rapidly deteriorate, and the improving effect in spot-weldability cannot be exhibited.

Consequently, the Fe/(Fe+Ni) in the film should be within a range of 0.05 through 0.9, and preferably, 0.1 through 0.5.

The oxygen content in the Fe—Ni—O film should preferably be within a range of 0.5 through 10 wt. %. With the oxygen content below 0.5 wt. %, the metal properties of the film will be predominant, and therefore, the effect of improving press-formability will be small. On the other hand, with the oxygen content exceeding 10 wt. %, the amounts of the oxides to be formed will be too much. As a result, electrical resistance will increase and weldability will deteriorate. Further, chemical treatability will deteriorate since the formation of phosphate crystals will be inhibited.

EXAMPLES

The zinciferous plated steel sheets each of which is provided with a plating layer of the GA, GI, or EG type below were used as the zinciferous plated steel sheets to be subjected to the electrolytic treatment according to methods of the present invention or comparative methods.

GA: alloyed zinc dip-plating layer comprising 10 wt. % Fe and the balance Zn is formed on both surfaces with a coating weight for each surface of 60 g/m$^2$.

GI: zinc dip-plating layer is formed on both surfaces with a coating weight for each surface of 90 g/m$^2$.

EG: electroplating layer is formed on both surfaces with a coating weight for each surface of 40 g/m$^2$.

Each zinciferous plated steel sheet as described above was set as a cathode, and an electrolytic treatment was performed in a mixture of a nickel sulfate solution and a ferrous sulfate solution having predetermined concentrations to form an Fe—Ni—O film on the surface of the zinciferous plated steel sheet. Here, some of the zinciferous plated steel sheets were merely dipped in the electrolytic solution without being subjected to the electrolytic treatment.

Tables 3 and 4 show the conditions for the electrolytic treatments in Example 1 through 30, which were subjected to the electrolytic treatments with the conditions in the scope of the present invention; those in Comparative Examples 2 through 12, 14, 15, 17, and 18, in each of which, at least one condition for the electrolytic treatment was out of the scope of the present invention; and the dipping conditions in Comparative Examples 1, 13, and 16, which were not subjected to electrolytic treatments. The tables also show the types of the plating layers on the steel sheets to be subjected to the electrolytic treatments; the ingredient contents, the pH values, and the temperatures of the electrolytic solutions; and the plating conditions.

As is obvious from Tables 3 and 4, the ingredient contents and the pH values of the electrolytic solutions were within the scope of the present invention both in the examples and the comparative examples. In all of the comparative examples, however, one requirement of the present invention, namely, the following equation (1), was not satisfied.

$$I_K/(U^{1/2}M)=50 \text{ through } 150$$

TABLE 3

| Test | | | | Plating Conditions | | | |
|---|---|---|---|---|---|---|---|
| No | Sample | Type of Plating | Ingredients, Contents, pH and Temperature of Electrolytic Solution | Current Density: $I_k$ (A/dm$^2$) | Flow Rate of Solution: Solution: U (m/S) | $\frac{I_k}{U^{1/2}M}$ | Plating Time (s) |
| 1 | Comparative Example 1 | GA | Nickel Sulfate: 0.08 mol/l | — | — | — | — |
| 2 | Comparative Example 2 | GA | Ferrous Sulfate 0.02 mol/l | 4 | 1 | 40 | 1 |
| 3 | Example 1 | GA | pH: 2 | 5 | 1 | 50 | 1 |
| 4 | Example 2 | GA | Temperature: | 8 | 1 | 80 | 1 |
| 5 | Example 3 | GA | 50° C. | 10 | 1 | 100 | 1 |
| 6 | Example 4 | GA | | 12 | 1 | 120 | 1 |
| 7 | Example 5 | GA | | 15 | 1 | 150 | 1 |
| 8 | Comparative Example 3 | GA | | 17 | 1 | 170 | 1 |
| 9 | Comparative Example 4 | GA | Nickel Sulfate: 0.16 mol/l | 8 | 1 | 40 | 1 |
| 10 | Example 6 | GA | Ferrous Sulfate | 10 | 1 | 50 | 1 |
| 11 | Example 7 | GA | 0.04 mol/l | 16 | 1 | 80 | 1 |
| 12 | Example 8 | GA | pH: 2 | 20 | 1 | 100 | 1 |
| 13 | Example 9 | GA | Temperature: | 24 | 1 | 120 | 1 |
| 14 | Example 10 | GA | 50° C. | 30 | 1 | 150 | 1 |
| 15 | Comparative Example 5 | GA | | 34 | 1 | 170 | 1 |
| 16 | Comparative Example 6 | GA | Nickel Sulfate: 0.4 mol/l | 20 | 1 | 40 | 1 |
| 17 | Example 11 | GA | Ferrous Sulfate | 25 | 1 | 50 | 1 |
| 18 | Example 12 | GA | 0.1 mol/l | 40 | 1 | 80 | 1 |
| 19 | Example 13 | GA | pH: 2 | 50 | 1 | 100 | 1 |
| 20 | Example 14 | GA | Temperature: | 60 | 1 | 120 | 1 |
| 21 | Example 15 | GA | 50° C. | 75 | 1 | 150 | 1 |
| 22 | Comparative Example 7 | GA | | 85 | 1 | 170 | 1 |

Note M: The sum of Ni ion concentration and ferrous ion concentration (mol/l)

TABLE 4

| Test No | Sample | Type of Plating | Ingredients, Contents, pH and Temperature of Electrolytic Solution | Plating Conditions: Current Density: $I_k$ (A/dm$^2$) | Flow Rate of Solution: Solution: U (m/S) | $\frac{I_k}{U^{1/2}M}$ | Plating Time (s) |
|---|---|---|---|---|---|---|---|
| 23 | Comparative Example 8 | GA | Nickel Sulfate: 0.16 mol/l | 12 | 2 | 42 | 0.5 |
| 24 | Example 16 | GA | Ferrous Sulfate | 20 | 2 | 53 | 0.5 |
| 25 | Example 17 | GA | 0.04 mol/l | 20 | 2 | 71 | 0.5 |
| 26 | Example 18 | GA | pH 2.8 | 25 | 2 | 88 | 0.5 |
| 27 | Example 19 | GA | Temperature: | 30 | 2 | 106 | 0.5 |
| 28 | Example 20 | GA | 50° C. | 40 | 2 | 141 | 0.5 |
| 29 | Comparative Example 9 | GA | | 50 | 2 | 178 | 0.5 |
| 30 | Comparative Example 10 | GA | Nickel Sulfate: 1.76 mol/l | 50 | 2 | 16 | 0.5 |
| 31 | Comparative Example 11 | GA | Ferrous Sulfate: 0.44 mol/l | 100 | 2 | 32 | 0.5 |
| 32 | Comparative Example 12 | GA | pH: 2 Temperature: 50° C. | 150 | 2 | 48 | 0.5 |
| 33 | Comparative Example 13 | EG | Nickel Sulfate: 0.16 mol/l | — | — | — | — |
| 34 | Comparative Example 14 | EG | Ferrous Sulfate 0.04 mol/l | 12 | 2 | 42 | 0.5 |
| 35 | Example 21 | EG | pH: 2.8 | 15 | 2 | 53 | 0.5 |
| 36 | Example 22 | EG | Temperature: | 20 | 2 | 71 | 0.5 |
| 37 | Example 23 | EG | 50° C. | 25 | 2 | 88 | 0.5 |
| 38 | Example 24 | EG | | 30 | 2 | 106 | 0.5 |
| 39 | Example 25 | EG | | 40 | 2 | 141 | 0.5 |
| 40 | Comparative Example 15 | EG | | 50 | 2 | 178 | 0.5 |
| 41 | Comparative Example 16 | GI | Nickel Sulfate: 0.16 mol/l | — | — | — | — |
| 42 | Comparative Example 17 | GI | Ferrous Sulfate 0.04 mol/l | 8 | 1 | 40 | 1 |
| 43 | Example 26 | GI | pH: 1.5 | 10 | 1 | 50 | 1 |
| 44 | Example 27 | GI | Temperature: | 16 | 1 | 80 | 1 |
| 45 | Example 28 | GI | 50° C. | 20 | 1 | 100 | 1 |
| 46 | Example 29 | GI | | 24 | 1 | 120 | 1 |
| 47 | Example 30 | GI | | 30 | 1 | 150 | 1 |
| 48 | Comparative Example 18 | GI | | 34 | 1 | 170 | 1 |

Note M: The sum of Ni ion concentration and ferrous ion concentration (mol/l)

On the Fe—Ni—O film of each specimen obtained in the above-described examples and comparative examples, the coating weight (in terms of the total weight of metals in the film), the ratio of the Fe content (% by weight) to the sum of the Fe content (% by weight) and the Ni content (% by weight), and the oxygen content were measured.

Tables 5 and 6 show the results of the above-described measurements performed on specimens obtained in Examples 1 through 30 and Comparative Examples 1 through 18.

TABLE 5

| Test No | Sample | Type of Plating | Fe—Ni—O Film: Coating Weight in Terms of Total Metal Weight (mg/m$^2$) | Fe Ratio Fe/Fe + Ni (-) | $O_2$ Content (wt. %) | Press-: Friction Coefficient Bead A | Friction Coefficient Bead B | Weldability: Continuous Spot-Welding Runs | Adhesion Properties: Peeloff Strength (kgf/25 mm) |
|---|---|---|---|---|---|---|---|---|---|
| 1 | Comparative Example 1 | GA | 0 | — | — | 0.171 | 0.255 | 2900 | 6.8 |
| 2 | Comparative Example 2 | GA | 40 | 0.28 | 0.20 | 0.148 | 0.173 | 4900 | 8.8 |
| 3 | Example 1 | GA | 56 | 0.29 | 0.50 | 0.125 | 0.151 | 5100 | 12.2 |
| 4 | Example 2 | GA | 82 | 0.29 | 1.00 | 0.127 | 0.150 | 5000 | 12.2 |
| 5 | Example 3 | GA | 120 | 0.30 | 4.00 | 0.125 | 0.151 | 5400 | 12.0 |
| 6 | Example 4 | GA | 140 | 0.30 | 6.00 | 0.126 | 0.150 | 5200 | 12.6 |
| 7 | Example 5 | GA | 182 | 0.29 | 9.00 | 0.125 | 0.147 | 5000 | 12.5 |

TABLE 5-continued

| No | Test Sample | Type of Plating | Fe—Ni—O Film: Coating Weight in Terms of Total Metal Weight ($mg/m^2$) | Fe—Ni—O Film: Fe Ratio Fe/Fe + Ni (-) | Fe—Ni—O Film: $O_2$ Content (wt. %) | Press-: Friction Coefficient Bead A | Press-: Friction Coefficient Bead B | Weldability: Continuous Spot-Welding Runs | Adhesion Properties: Peeloff Strength (kgf/25 mm) |
|---|---|---|---|---|---|---|---|---|---|
| 8 | Comparative Example 3 | GA | 200 | 0.27 | 12.00 | 0.128 | 0.152 | 4000 | 12.4 |
| 9 | Comparative Example 4 | GA | 90 | 0.25 | 0.30 | 0.146 | 0.169 | 5000 | 7.9 |
| 10 | Example 6 | GA | 110 | 0.26 | 0.60 | 0.124 | 0.148 | 5100 | 12.2 |
| 11 | Example 7 | GA | 170 | 0.26 | 1.20 | 0.124 | 0.148 | 5000 | 12.1 |
| 12 | Example 8 | GA | 260 | 0.26 | 5.00 | 0.124 | 0.146 | 5100 | 12.3 |
| 13 | Example 9 | GA | 310 | 0.25 | 6.80 | 0.126 | 0.145 | 5200 | 12.4 |
| 14 | Example 10 | GA | 390 | 0.24 | 9.50 | 0.125 | 0.144 | 4900 | 12.6 |
| 15 | Comparative Example 5 | GA | 420 | 0.24 | 13.00 | 0.126 | 0.142 | 3200 | 12.8 |
| 16 | Comparative Example 6 | GA | 220 | 0.28 | 0.30 | 0.145 | 0.165 | 5000 | 8.9 |
| 17 | Example 11 | GA | 250 | 0.28 | 0.60 | 0.122 | 0.142 | 5000 | 12.5 |
| 18 | Example 12 | GA | 430 | 0.26 | 1.30 | 0.123 | 0.142 | 5100 | 12.8 |
| 19 | Example 13 | GA | 640 | 0.25 | 6.20 | 0.124 | 0.143 | 5300 | 12.9 |
| 20 | Example 14 | GA | 760 | 0.27 | 7.00 | 0.123 | 0.140 | 5100 | 12.6 |
| 21 | Example 15 | GA | 1000 | 0.27 | 10.00 | 0.125 | 0.145 | 5000 | 12.8 |
| 22 | Comparative Example 7 | GA | 1100 | 0.28 | 15.00 | 0.124 | 0.145 | 3000 | 13.0 |

TABLE 6

| No | Test Sample | Type of Plating | Fe—Ni—O Film: Coating Weight in Terms of Total Metal Weight ($mg/m^2$) | Fe—Ni—O Film: Fe Ratio Fe/Fe + Ni (-) | Fe—Ni—O Film: $O_2$ Content (wt. %) | Press-: Friction Coefficient Bead A | Press-: Friction Coefficient Bead B | Weldability: Continuous Spot-Welding Runs | Adhesion Properties: Peel Strength (kgf/25 mm) |
|---|---|---|---|---|---|---|---|---|---|
| 23 | Comparative Example 8 | GA | 70 | 0.21 | 0.40 | 0.145 | 0.166 | 5200 | 7.7 |
| 24 | Example 16 | GA | 88 | 0.20 | 0.60 | 0.121 | 0.142 | 5200 | 12.8 |
| 25 | Example 17 | GA | 117 | 0.20 | 1.20 | 0.121 | 0.142 | 5100 | 13.0 |
| 26 | Example 18 | GA | 148 | 0.21 | 5.80 | 0.122 | 0.146 | 5200 | 13.0 |
| 27 | Example 19 | GA | 170 | 0.20 | 6.50 | 0.120 | 0.142 | 5100 | 13.0 |
| 28 | Example 20 | GA | 240 | 0.20 | 9.20 | 0.123 | 0.145 | 5100 | 12.9 |
| 29 | Comparative Example 9 | GA | 290 | 0.21 | 13.00 | 0.125 | 0.145 | 3200 | 13.2 |
| 30 | Comparative Example 10 | GA | 220 | 0.28 | 0.10 | 0.154 | 0.174 | 5200 | 8.8 |
| 31 | Comparative Example 11 | GA | 410 | 0.28 | 0.20 | 0.153 | 0.172 | 5100 | 9.0 |
| 32 | Comparative Example 12 | GA | 600 | 0.29 | 0.40 | 0.152 | 0.171 | 5100 | 8.5 |
| 33 | Comparative Example 13 | EG | 0 | — | — | 0.224 | 0.306 | 1900 | 5.6 |
| 34 | Comparative Example 14 | EG | 80 | 0.27 | 0.30 | 0.147 | 0.167 | 4100 | 8.0 |
| 35 | Example 21 | EG | 102 | 0.27 | 0.50 | 0.127 | 0.146 | 4200 | 12.2 |
| 36 | Example 22 | EG | 120 | 0.26 | 1.00 | 0.125 | 0.145 | 4200 | 12.2 |
| 37 | Example 23 | EG | 160 | 0.27 | 4.50 | 0.125 | 0.144 | 4200 | 12.2 |
| 38 | Example 24 | EG | 190 | 0.26 | 6.00 | 0.124 | 0.145 | 4100 | 12.4 |
| 39 | Example 25 | EG | 250 | 0.27 | 9.00 | 0.124 | 0.146 | 4200 | 12.4 |
| 40 | Comparative Example 15 | EG | 310 | 0.29 | 16.00 | 0.125 | 0.147 | 2500 | 12.6 |
| 41 | Comparative Example 16 | GI | 0 | — | — | 0.210 | 0.320 | 900 | 3.8 |
| 42 | Comparative Example 17 | GI | 80 | 0.20 | 0.40 | 0.148 | 0.169 | 3500 | 7.6 |
| 43 | Example 26 | GI | 100 | 0.21 | 0.60 | 0.125 | 0.149 | 3700 | 12.9 |
| 44 | Example 27 | GI | 162 | 0.23 | 1.10 | 0.125 | 0.149 | 3800 | 12.9 |
| 45 | Example 28 | GI | 240 | 0.21 | 5.00 | 0.126 | 0.147 | 3800 | 12.9 |
| 46 | Example 29 | GI | 290 | 0.21 | 6.50 | 0.126 | 0.147 | 4000 | 12.5 |
| 47 | Example 30 | GI | 365 | 0.23 | 9.50 | 0.128 | 0.147 | 4000 | 12.4 |
| 48 | Comparative Example 18 | GI | 400 | 0.23 | 18.00 | 0.129 | 0.149 | 1500 | 12.4 |

Next, on each of the above specimens, measurement of the friction coefficient, tests on continuous spot-weldability and adhesiveness were conducted to evaluate press-formability, spot-weldability, and adhesiveness. The results are shown also in Tables 5 and 6.

The results shown in Tables 5 and 6 clarified the following.

Here, the left side of the equation 1, $I_K/(U^{1/2}M)=50$ through 150, is replaced with X. Specifically, $$X=I_K/(U^{1/2}M) \quad (5)$$

As described above, only the X values are out of the scope of the present invention in the comparative examples, and:

(1) In each of Comparative Examples 2, 4, 6, 8, 10 through 12, 14, and 17 which has an X value below 50, the oxygen content in the Fe—Ni—O film is less than 0.5 wt. % while that of each example is within a range of 0.1 through 10 wt. %. Additionally, these comparative examples are inferior to the examples based on the present invention in adhesiveness regardless of the type of plating layer. Further, the comparative examples are inferior to the examples based on the present invention having the same type of plating layer in press-formability;

(2) In each of Comparative Examples 3, 5, 7, 9, 15, and 18 which has an X value exceeding 150, the oxygen content in the Fe—Ni—O film is greater than 10 wt. %. These comparative examples are inferior to the examples based on the present invention having the same type of plating layer in spot-weldability; and (3) All of Comparative Examples 1, 13 and 16, which were manufactured only by dipping in the electrolytic solution and have no Fe—Ni—O film, are inferior to the examples based on the present invention in all of press-formability, spot-weldability, and adhesiveness regardless of the type of plating layer.

As is obvious from Tables 5 and 6, the level of the characteristic values in press-formability, spot-weldability, and adhesiveness of the zinciferous plated steel sheets are dispersive in the products which were not subjected to the electrolytic treatment according to the present invention. Considering this, the characteristic values in Comparative Examples 1, 13, and 16, which were not subjected to the electrolytic treatment according to the present invention, are regarded as the standard values for the characteristic values of the products having plating layer of GA type, EG type, and GI type, respectively. Then, the ratio of each characteristic value in each of the examples based on the present invention and the other comparative examples to the standard value thus obtained was calculated and defined as the improvement index of each characteristic.

Tables 7 and 8 show the improvement indexes of press-formability, spot-weldability, and adhesiveness in the examples and the comparative examples, classifying them in terms of the type of plating layer.

TABLE 7

| Test | | Type of | Improvement Index Improvement Index of Press-formability Friction Coefficient | | Improvement Index of Spot-Weldability Continous | Improvement Index of Adhesion Properties Peeloff |
|---|---|---|---|---|---|---|
| No | Sample | Plating | Bead A | Bead B | Spot-Welding runs | Strength |
| 1 | Comparative Example 1 | GA | 1.000 | 1.000 | 1.000 | 1.000 |
| 2 | Comparative Example 2 | GA | 0.865 | 0.768 | 1.690 | 1.294 |
| 3 | Example 1 | GA | 0.731 | 0.592 | 1.759 | 1.794 |
| 4 | Example 2 | GA | 0.743 | 0.588 | 1.724 | 1.794 |
| 5 | Example 3 | GA | 0.731 | 0.592 | 1.862 | 1.764 |
| 6 | Example 4 | GA | 0.737 | 0.588 | 1.793 | 1.853 |
| 7 | Example 5 | GA | 0.731 | 0.576 | 1.724 | 1.838 |
| 8 | Comparative Example 3 | GA | 0.749 | 0.596 | 1.379 | 1.824 |
| 9 | Comparative Example 4 | GA | 0.854 | 0.663 | 1.724 | 1.162 |
| 10 | Example 6 | GA | 0.725 | 0.580 | 1.759 | 1.794 |
| 11 | Example 7 | GA | 0.725 | 0.580 | 1.724 | 1.779 |
| 12 | Example 8 | GA | 0.725 | 0.573 | 1.759 | 1.809 |
| 13 | Example 9 | GA | 0.737 | 0.569 | 1.793 | 1.824 |
| 14 | Example 10 | GA | 0.731 | 0.565 | 1.690 | 1.853 |
| 15 | Comparative Example 5 | GA | 0.737 | 0.557 | 1.103 | 1.882 |
| 16 | Comparative Example 6 | GA | 0.848 | 0.647 | 1.724 | 1.309 |
| 17 | Example 11 | GA | 0.713 | 0.557 | 1.724 | 1.838 |
| 18 | Example 12 | GA | 0.719 | 0.557 | 1.759 | 1.882 |
| 19 | Example 13 | GA | 0.725 | 0.561 | 1.828 | 1.897 |
| 20 | Example 14 | GA | 0.719 | 0.549 | 1.759 | 1.853 |
| 21 | Example 15 | GA | 0.731 | 0.569 | 1.724 | 1.883 |
| 22 | Comparative Example 7 | GA | 0.725 | 0.569 | 1.034 | 1.912 |

Note: Each improvement index of press-moldability, spot-weldability, or adhesion properties is the ratio of each characteristic observed in an example to that of the corresponding comparative example having the same type of deposit as the example without a Fe—Ni—O-type coat.

TABLE 8

| Test No | Sample | Type of Plating | Improvement Index Improvement Index of Press-formability Friction Coefficient Bead A | Bead B | Improvement Index of Spot-Weldability Continous Spot-Welding runs | Improvement Index of Adhesion Properties Peeloff Strength |
|---|---|---|---|---|---|---|
| 23 | Comparative Example 8 | GA | 0.847 | 0.651 | 1.793 | 1.000 |
| 24 | Example 16 | GA | 0.708 | 0.557 | 1.793 | 1.662 |
| 25 | Example 17 | GA | 0.708 | 0.557 | 1.759 | 1.688 |
| 26 | Example 18 | GA | 0.713 | 0.573 | 1.793 | 1.688 |
| 27 | Example 19 | GA | 0.702 | 0.557 | 1.759 | 1.688 |
| 28 | Example 20 | GA | 0.719 | 0.568 | 1.759 | 1.675 |
| 29 | Comparative Example 9 | GA | 0.731 | 0.568 | 1.103 | 1.714 |
| 30 | Comparative Example 10 | GA | 0.901 | 0.682 | 1.793 | 1.294 |
| 31 | Comparative Example 11 | GA | 0.895 | 0.675 | 1.759 | 1.324 |
| 32 | Comparative Example 12 | GA | 0.889 | 0.671 | 1.759 | 1.250 |
| 33 | Comparative Example 13 | EG | 1.000 | 1.000 | 1.000 | 1.000 |
| 34 | Comparative Example 14 | EG | 0.656 | 0.546 | 2.158 | 1.429 |
| 35 | Example 21 | EG | 0.567 | 0.477 | 2.211 | 2.179 |
| 36 | Example 22 | EG | 0.558 | 0.474 | 2.211 | 2.179 |
| 37 | Example 23 | EG | 0.558 | 0.471 | 2.211 | 2.179 |
| 38 | Example 24 | EG | 0.554 | 0.474 | 2.158 | 2.214 |
| 39 | Example 25 | EG | 0.554 | 0.477 | 2.211 | 2.214 |
| 40 | Comparative Example 15 | EG | 0.558 | 0.480 | 1.315 | 2.250 |
| 41 | Comparative Example 16 | GI | 1.000 | 1.000 | 1.000 | 1.000 |
| 42 | Comparative Example 17 | GI | 0.705 | 0.528 | 3.889 | 2.000 |
| 43 | Example 26 | GI | 0.595 | 0.466 | 4.111 | 3.395 |
| 44 | Example 27 | GI | 0.595 | 0.466 | 4.222 | 3.395 |
| 45 | Example 28 | GI | 0.600 | 0.459 | 4.222 | 3.395 |
| 46 | Example 29 | GI | 0.600 | 0.459 | 4.444 | 3.289 |
| 47 | Example 30 | GI | 0.610 | 0.459 | 4.444 | 3.263 |
| 48 | Comparative Example 18 | GI | 0.614 | 0.466 | 1.667 | 3.263 |

Note: Each improvement index of press-moldability, spot-weldability, or adhesion properties is the ratio of each characteristic observed in an example to that of the corresponding comparative example having the same type of deposit as the example without a Fe—Ni—O-type Coat.

As is obvious from the results shown in Tables 7 and 8, when press-formability, spot-weldability, and adhesiveness are evaluated in each group classified in terms of the type of plating layer, all of the examples based on the present invention are much more improved in each characteristic than in the comparative examples.

According to the present invention constructed as described above, the Fe—Ni—O film to be formed on the surface of the plating layer on a zinciferous plated steel sheet has a higher hardness and a higher melting point as compared with a zinc or alloyed zinc plating layer. With the presence of a proper amount of the film, the slide resistance between the surface of the plating layer and a press die during press forming decreases, and therefore, the zinciferous plated steel sheet can readily flow into the mold. Also, the presence of the Fe—Ni—O film having a higher melting point improves continuous spot-weldability in spot-welding. Further, the peeloff strength of a laminated steel sheet can be improved due to the presence of Fe oxide in the Fe—Ni—O film. Accordingly, the present invention can provides a zinciferous plated steel sheet excellent in press-formability, spot-weldability, and adhesiveness, namely, the present invention can bring about markedly advantageous effects from an industrial view.

EMBODIMENT 3

The present invention provides a method of manufacturing a zinciferous plated steel sheet excellent in press formability, spot weldability and adhesiveness by appropriately forming an Fe—Ni—O film on the surface of a plating layer of the zinciferous plated steel sheet.

The method of manufacturing a zinciferous plated steel sheet of the present invention comprises the step of dipping a zinciferous plated steel sheet in an aqueous solution containing at least one of ferrous sulfate and ferrous nitrate and at least one of nickel sulfate and nickel nitrate, thereby forming a film on the surface of a plating layer of the zinciferous plated steel sheet, wherein the sum of the iron content (mol/l) and the nickel content (mol/l) in that aqueous solution is within a range of from 0.1 to 3.0 mol/l, the ratio of the iron content (mol/l) to the sum of the iron content (mol/l) and the nickel content (mol/l) in the aqueous solution is within a range of from 0.004 to 0.9, pH is within a range of from 1.0 to 3.5, and temperature is within a range of from 20° to 70° C., and an Fe—Ni—O film is formed by dipping the zinciferous plated steel sheet in the aqueous solution.

In the present invention, the Fe—Ni—O film as an upper layer, formed on the surface of the plating layer of the zinciferous plated steel sheet of the present invention and in relation thereto shall be referred to as the "film," and on the other hand, the zinc or zinciferous plating layer as a lower layer shall be referred to as the "plating layer" for discrimination.

Now, reasons of limiting the manufacturing conditions in the present invention will be described below.

In the present invention, a zinciferous plated steel sheet is immersed in an aqueous solution containing at least one of $FeSO_4$ and $Fe(NO_3)_2$ and at least one of $NiSO_4$ and $Ni(NO_3)_2$ with a view to forming an Fe—Ni—O film on the surface of a plating layer of the zinciferous plated steel sheet. The reason is that Fe ion and Ni ion can be added to the solution in any of various forms of salt, but addition should be made in the form of a sulfate and/or nitrate because of the satisfactory solubility, a limited problem of corrosion of the facilities, the slight adverse effect on human health, and the favorable economic merits.

For the purpose of forming the Fe—Ni—O film, a spraying method of an aqueous film forming solution, or a roll-application method can give a similar effect as in the dipping method. However, an electroplating method results in a metallic film, and it is difficult to form the Fe—Ni—O film of the present invention, making it difficult to obtain a film excellent in press formability and adhesiveness. The electroplating method or the vapor plating method is not desirable in general because of the necessity of a huge amount of equipment cost and a high running cost leading to an increase in the manufacturing cost.

The sum of the iron content (mol/l) and the nickel content (mol/l) in the aqueous solution should be within a range of from 0.1 to 3.0. The reason is as follows. With a sum of under 0.1 mol/l, a decrease in the precipitation rate of Ni and Fe results in a decrease in productivity. With a sum of over 3.0, on the other hand, the metal salt concentration reaches the solubility at a low temperature, leading to precipitation of metal salts. In addition, the ratio of the Fe content (mol/l) to the sum of the Fe content (mol/l) and the Ni content (mol/l) in the aqueous solution should be within a range of from 0.004 to 0.9. The reason is that, with a ratio Fe/(Fe+Ni) of under 0.004, the improving effect of adhesiveness is unavailable, and with a ratio of over 0.9, the improvement effect of spot weldability is limited.

The aqueous solution should have a pH within a range of from 1.0 to 3.5. With a pH of under 1.0, there is an extreme increase in the amount of hydrogenation, resulting in a decrease in precipitation efficiency of Ni and Fe. Under conditions including constant salt concentration and dipping time, the coating weight of Ni and Fe is small, leading to a lower productivity. Furthermore, the film comprises mainly Ni and Fe metals, this making it impossible to obtain improving effect of press formability, spot weldability and adhesiveness. With a pH of over 3.5, the oxygen content in the film increases, resulting in a lower improving effect of weldability and in deterioration of chemical treatability.

Temperature of the aqueous solution should be within a range of from 20° to 70° C. At a solution temperature of under 20° C., the reaction rate is low and it takes a long period of time to ensure a sufficient coating weight of Ni and Fe necessary for improving film properties, resulting in a decrease in productivity. At a temperature of over 70° C., on the other hand, deterioration of treatment performance of the aqueous solution is accelerated, and necessity of facilities and energy for keeping a high temperature results in an increase in the manufacturing cost.

The electrolytic solution may contain cations, hydroxides and oxides of Zn, Co, Mn, Mo, Al, Ti, Sn, W, Si, Pb, Nb and Ta contained in the plating layer or the like of the zinciferous plated steel sheet used in the present invention, and anions other than chlorine cation.

In the present invention, the zinciferous plated steel sheet used for forming the Fe—Ni—O film on the surface thereof is a steel sheet having a plating layer formed by the dip plating method, the electroplating method, the vapor plating method or the like on a substrate. In terms of chemical composition, the zinciferous plating layer comprises, in addition to pure zinc, a single-layer or a plurality of layer plating layer containing one or more of such metals as Fe, Ni, Co, Mn, Cr, Al, Mo, Ti, Si, W, Sn, Pb, Nb and Ta (Si is also regarded as a metal), or oxides thereof, or organic substances. The layer may contain furthermore such fine particles as $SiO_2$ and $Al_2O_3$. As the zinciferous plated steel sheet, a plurality of layers plated steel sheet or a functional gradient plated steel sheet having a plating layer with a different chemical composition may be used.

The Fe—Ni—O film formed on the surface of the plating layer of the zinciferous plated steel sheet under the foregoing limiting conditions eliminates sticking between the steel sheet and the die during press forming, reduces sliding resistance, improves flowing-in into the die, inhibits formation of a brittle alloy layer between the sheet and the copper electrode during spot welding, thus improving continuous spot weldability and improves adhesiveness under the effect of the film containing Fe oxides.

In this case, the coating weight of the Fe—Ni—O film should preferably be within a range of from 10 to 1,500 $mg/m^2$ in the total conversion weight of metal elements in the film. With a total conversion weight of under 10 $mg/m^2$, the improving effect of press formability is unavailable, and a total conversion weight of over 1,500 $mg/m^2$ results in a deterioration of chemical treatability.

In order to adjust the coating weight within such a preferable range, it suffices, for an aqueous solution of a constant salt concentration, to adjust the dipping time, and when a constant dipping time must be kept because of restrictions in equipment such as capacity limit, to adjust the salt concentration, or finely adjust pH and temperature.

The preferable range of the oxygen content in the Fe—Ni—O film is from 0.5 to 10 wt. %. With an oxygen content of under 0.5 wt. %, metal properties of the film become more apparent, reducing the improving effect of press formability. With an oxygen content of over 10 wt. %, on the other hand, the amount of oxides becomes too large, resulting in an increase in electric resistance of the surface, a decrease in weldability, and inhibited production of phosphate crystals, leading to deterioration of chemical treatability.

The ratio of the Fe content (wt. %) to the sum of the Fe content and the Ni content in the film (wt. %) (hereinafter referred to as the "Fe ratio in film" and expressed by "Fe/(Fe+Ni)) should preferably be within a range of from 0.004 to 0.9, or more preferably, from 0.1 to 0.5. While presence of Fe in the film improves adhesiveness, a ratio Fe/(Fe+Ni) in the film of under 0.004, the improving effect of adhesiveness is unavailable. With a ratio Fe/(Fe+Ni) in the film of over 0.9, on the other hand, a decrease in the Ni content in the film results in a decrease in the ratio of Zn—Ni alloy having a high melting point formed during welding, and this causes more serious deterioration of the electrode, thus reducing the improving effect of spot weldability.

EXAMPLES

The zinciferous plated steel sheet before application of dip plating by the method of the present invention or a comparative method has any of the following plating seeds GA, GI, EG Zn—Fe, Zn—Ni, Zn—Cr and Zn—Al formed thereon:

GA: There is formed an alloyed zinc dip-plating layer comprising 10 wt. % Fe and the balance Zn in a coating weight of 60 g/m$^2$ for each of the both surfaces;

GI: There is formed a zinc dip-plating layer in a coating weight of 90 g/m$^2$ for each of the both surfaces;

EG: There is formed an electroplating layer in a coating weight of 40 g/m$^2$ for each of the both surfaces;

Zn—Fe: There is formed a Zn—Fe alloy electroplating layer comprising 15 wt. % Fe, in a coating weight 40 g/m$^2$ for each of the both surfaces;

Zn—Ni: There is formed a Zn—Ni alloy electroplating layer comprising 12 wt. % Ni, in a coating weight of 30 g/m$^2$ for each of the both surfaces;

Zn—Cr: There is formed a Zn—Cr alloy electroplating layer comprising 4 wt. % Cr, in a coating weight of 20 g/m$^2$ for each of the both surfaces;

Zn—Al: There is formed a Zn—Al alloy electroplating layer comprising 5 wt. % Al, in a coating weight of 60 g/m$^2$ for each of the both surfaces.

Examples of the invention and comparative examples were conducted by treating the foregoing zinciferous plated steel sheet under the manufacturing conditions within the scope of the present invention or manufacturing conditions outside the scope of the present invention shown in treatment Nos. 1 to 35 in Tables 9 and 10. Sample Nos. were assigned to samples determined by the combination of treatment conditions (treatment Nos. 1 to 35) and zinciferous plated steel sheets of any of the types of plating (7 types as above). The samples comprise examples Nos. 1 to 75 and comparative examples Nos. 1 to 31.

TABLE 9

| | Aqueous Solution | | | | | | | Dipping | |
|---|---|---|---|---|---|---|---|---|---|
| Treatment No. | FeSO4 (mol/l) | Fe(NO3)2 (mol/l) | NiSO4 (mol/l) | Ni(NO3)2 (mol/l) | pH | Temperature (°C.) | Fe/ (Fe + Ni) | Time (sec) | |
| 1 | — | — | — | — | — | — | — | — | Comparative Example |
| 2 | 0.0000 | 0.0000 | 1.5000 | 0.0000 | 2.5 | 55 | 0.000 | 10 | Comparative Example |
| 3 | 0.0045 | 0.0000 | 1.4955 | 0.0000 | 2.5 | 55 | 0.003 | 10 | Comparative Example |
| 4 | 0.0060 | 0.0000 | 1.4940 | 0.0000 | 2.5 | 55 | 0.004 | 10 | Example |
| 5 | 0.0150 | 0.0000 | 1.4850 | 0.0000 | 2.5 | 55 | 0.010 | 10 | Example |
| 6 | 0.0750 | 0.0000 | 1.4250 | 0.0000 | 2.5 | 55 | 0.050 | 10 | Example |
| 7 | 0.1500 | 0.0000 | 1.3500 | 0.0000 | 2.5 | 55 | 0.100 | 10 | Example |
| 8 | 0.3000 | 0.0000 | 1.2000 | 0.0000 | 2.5 | 55 | 0.200 | 10 | Example |
| 9 | 0.4500 | 0.0000 | 1.0500 | 0.0000 | 2.5 | 55 | 0.300 | 10 | Example |
| 10 | 0.7500 | 0.0000 | 0.7500 | 0.0000 | 2.5 | 55 | 0.500 | 10 | Example |
| 11 | 1.0500 | 0.0000 | 0.4500 | 0.0000 | 2.5 | 55 | 0.700 | 10 | Example |
| 12 | 1.3500 | 0.0000 | 0.1500 | 0.0000 | 2.5 | 55 | 0.900 | 10 | Example |
| 13 | 1.3800 | 0.0000 | 0.1200 | 0.0000 | 2.5 | 55 | 0.920 | 10 | Comparative Example |
| 14 | 1.5000 | 0.0000 | 0.0000 | 0.0000 | 2.5 | 55 | 1.000 | 10 | Comparative Example |

TABLE 10

| | Aqueous Solution | | | | | | | Dipping | |
|---|---|---|---|---|---|---|---|---|---|
| Treatment No. | FeSO4 (mol/l) | Fe(NO3)2 (mol/l) | NiSO4 (mol/l) | Ni(NO3)2 (mol/l) | pH | Temperature (°C.) | Fe/ (Fe + Ni) | Time (sec) | |
| 15 | 0.3000 | 0.0000 | 1.2000 | 0.0000 | 0.5 | 55 | 0.200 | 10 | Comparative Example |
| 16 | 0.3000 | 0.0000 | 1.2000 | 0.0000 | 0.9 | 55 | 0.200 | 10 | Comparative Example |
| 17 | 0.3000 | 0.0000 | 1.2000 | 0.0000 | 1.0 | 55 | 0.200 | 10 | Example |
| 18 | 0.3000 | 0.0000 | 1.2000 | 0.0000 | 1.5 | 55 | 0.200 | 10 | Example |
| 19 | 0.3000 | 0.0000 | 1.2000 | 0.0000 | 2.0 | 55 | 0.200 | 10 | Example |
| 20 | 0.3000 | 0.0000 | 1.2000 | 0.0000 | 2.1 | 55 | 0.200 | 10 | Example |
| 21 | 0.3000 | 0.0000 | 1.2000 | 0.0000 | 3.0 | 55 | 0.200 | 10 | Example |
| 22 | 0.3000 | 0.0000 | 1.2000 | 0.0000 | 3.5 | 55 | 0.200 | 10 | Example |
| 23 | 0.3000 | 0.0000 | 1.2000 | 0.0000 | 3.6 | 55 | 0.200 | 10 | Comparative Example |
| 24 | 0.3000 | 0.0000 | 1.2000 | 0.0000 | 4.0 | 55 | 0.200 | 10 | Comparative Example |
| 25 | 0.3000 | 0.0000 | 1.2000 | 0.0000 | 2.5 | 10 | 0.200 | 10 | Comparative Example |
| 26 | 0.3000 | 0.0000 | 1.2000 | 0.0000 | 2.5 | 19 | 0.200 | 10 | Comparative Example |
| 27 | 0.3000 | 0.0000 | 1.2000 | 0.0000 | 2.5 | 20 | 0.200 | 10 | Example |
| 28 | 0.3000 | 0.0000 | 1.2000 | 0.0000 | 2.5 | 40 | 0.200 | 10 | Example |
| 29 | 0.3000 | 0.0000 | 1.2000 | 0.0000 | 2.5 | 50 | 0.200 | 10 | Example |
| 30 | 0.3000 | 0.0000 | 1.2000 | 0.0000 | 2.5 | 60 | 0.200 | 10 | Example |
| 31 | 0.3000 | 0.0000 | 1.2000 | 0.0000 | 2.5 | 70 | 0.200 | 10 | Example |
| 32 | 0.3000 | 0.0000 | 1.2000 | 0.0000 | 2.5 | 71 | 0.200 | 10 | Comparative Example |
| 33 | 0.3000 | 0.0000 | 1.2000 | 0.0000 | 2.5 | 80 | 0.200 | 10 | Comparative Example |
| 34 | 0.1500 | 0.1500 | 0.6000 | 0.6000 | 2.5 | 55 | 0.200 | 10 | Example |
| 35 | 0.0000 | 0.3000 | 0.0000 | 1.2000 | 2.5 | 55 | 0.200 | 10 | Example |

Tables 11 to 15 show results of a state test of the Fe—Ni—O film formed on each sample and a property test of each sample.

TABLE 11

| | | Fe—Ni—O Film | | | Press | Weldability | Adhesiveness | | |
|---|---|---|---|---|---|---|---|---|---|
| Sample No. | Type of Plating | Coating Weight ($mg/m^2$) | Fe Ratio Fe/(Fe + Ni) | Oxygen (wt %) | Formability Frictional Coefficient | Continuous Spot Weldability | Peeloff Strength (kgf/25 mm) | Chemical Treat-ability | |
| 1 A | GA | 0 | — | — | 0.160 | 3000 | 5.6 | O | Comparative Example |
| 2 A | GA | 220 | 0.000 | 5.0 | 0.143 | 7000 | 4.0 | O | Comparative Example |
| 3 A | GA | 220 | 0.003 | 4.5 | 0.143 | 7000 | 7.0 | O | Example |
| 4 A | GA | 220 | 0.004 | 4.0 | 0.141 | 7000 | 10.0 | O | Example |
| 5 A | GA | 220 | 0.010 | 3.5 | 0.140 | 7000 | 10.5 | O | Example |
| 6 A | GA | 220 | 0.050 | 2.5 | 0.138 | 6750 | 11.0 | O | Example |
| 7 A | GA | 220 | 0.100 | 2.0 | 0.136 | 6750 | 12.0 | O | Example |
| 8 A | GA | 220 | 0.200 | 1.0 | 0.132 | 6500 | 13.5 | O | Example |
| 9 A | GA | 220 | 0.300 | 1.0 | 0.134 | 6500 | 13.5 | O | Example |
| 10 A | GA | 220 | 0.500 | 1.5 | 0.137 | 6000 | 13.5 | O | Example |
| 11 A | GA | 220 | 0.700 | 2.5 | 0.138 | 5500 | 13.5 | O | Example |
| 12 A | GA | 220 | 0.900 | 3.5 | 0.139 | 5000 | 13.5 | O | Example |
| 13 A | GA | 220 | 0.920 | 4.0 | 0.140 | 3500 | 13.5 | O | Comparative Example |
| 14 A | GA | 220 | 1.000 | 5.0 | 0.143 | 3000 | 13.5 | O | Comparative Example |

(Note) The plating weight is represented by the total conversion weight of metal elements in the film.

TABLE 12

| | | Fe—Ni—O Film | | | Press | Weldability | Adhesiveness | | |
|---|---|---|---|---|---|---|---|---|---|
| Sample No. | Type of Plating | Coating Weight ($mg/m^2$) | Fe Ratio Fe/(Fe + Ni) | Oxygen (wt %) | Formability Frictional Coefficient | Continuous Spot Weldability | Peeloff Strength (kgf/25 mm) | Chemical Treat-ability | |
| 15 A | GA | 20 | 0.200 | 0.2 | 0.152 | 5000 | 9.0 | O | Comparative Example |
| 16 A | GA | 40 | 0.200 | 0.4 | 0.151 | 5200 | 9.5 | O | Comparative Example |
| 17 A | GA | 60 | 0.200 | 0.5 | 0.142 | 5300 | 11.0 | O | Example |
| 18 A | GA | 80 | 0.200 | 0.5 | 0.140 | 5500 | 12.0 | O | Example |
| 19 A | GA | 150 | 0.200 | 0.8 | 0.138 | 6000 | 12.3 | O | Example |
| 20 A | GA | 170 | 0.200 | 0.6 | 0.136 | 6200 | 12.3 | O | Example |
| 21 A | GA | 260 | 0.200 | 5.0 | 0.130 | 6750 | 12.5 | O | Example |
| 22 A | GA | 300 | 0.200 | 10.0 | 0.130 | 6000 | 11.0 | O | Example |
| 23 A | GA | 320 | 0.200 | 20.0 | 0.130 | 4500 | 10.5 | X | Comparative Example |
| 24 A | GA | 350 | 0.200 | 25.0 | 0.130 | 4000 | 10.0 | X | Comparative Example |
| 25 A | GA | 6 | 0.200 | 1.0 | 0.150 | 3250 | 9.5 | O | Comparative Example |
| 26 A | GA | 8 | 0.200 | 1.0 | 0.149 | 3500 | 9.8 | O | Comparative Example |
| 27 A | GA | 20 | 0.200 | 1.0 | 0.142 | 5000 | 11.5 | O | Example |
| 28 A | GA | 100 | 0.200 | 1.0 | 0.138 | 5250 | 12.5 | O | Example |
| 29 A | GA | 180 | 0.200 | 1.0 | 0.135 | 5750 | 12.5 | O | Example |
| 30 A | GA | 270 | 0.200 | 1.0 | 0.132 | 6500 | 12.5 | O | Example |
| 31 A | GA | 320 | 0.200 | 1.0 | 0.131 | 7250 | 12.0 | O | Example |
| 32 A | GA | 330 | 0.200 | 1.0 | 0.130 | 7250 | 11.5 | O | Comparative Example |
| 33 A | GA | 420 | 0.200 | 1.0 | 0.130 | 7500 | 11.0 | O | Comparative Example |
| 34 A | GA | 200 | 0.200 | 1.0 | 0.133 | 6000 | 13.0 | O | Example |
| 35 A | GA | 180 | 0.200 | 1.0 | 0.134 | 6000 | 13.0 | O | Example |

(Note) The plating weight is represented by the total conversion weight of metal elements in the film.

TABLE 13

| | | Fe—Ni—O Film | | | Press | Weldability | Adhesiveness | | |
|---|---|---|---|---|---|---|---|---|---|
| Sample No. | Type of Plating | Coating Weight ($mg/m^2$) | Fe Ratio Fe/(Fe + Ni) | Oxygen (wt %) | Formability Frictional Coefficient | Continuous Spot Weldability | Peeloff Strength (kgf/25 mm) | Chemical Treat-ability | |
| 1 B | GI | — | — | — | 0.180 | 1000 | 2.9 | O | Comparative Example |
| 2 B | GI | 330 | 0.000 | 5.0 | 0.162 | 5000 | 5.9 | O | Comparative Example |
| 4 B | GI | 330 | 0.004 | 4.0 | 0.160 | 5000 | 10.1 | O | Example |
| 7 B | GI | 330 | 0.100 | 2.0 | 0.157 | 4750 | 11.9 | O | Example |
| 8 B | GI | 330 | 0.200 | 1.0 | 0.153 | 4500 | 12.4 | O | Example |
| 9 B | GI | 330 | 0.300 | 1.0 | 0.155 | 4500 | 12.4 | O | Example |
| 10 B | GI | 330 | 0.500 | 1.5 | 0.158 | 4000 | 12.4 | O | Example |
| 11 B | GI | 330 | 0.700 | 2.5 | 0.159 | 3500 | 12.4 | O | Example |
| 12 B | GI | 330 | 0.900 | 3.5 | 0.160 | 3000 | 12.4 | O | Example |

TABLE 13-continued

| Sample No. | Type of Plating | Fe—Ni—O Film Coating Weight (mg/m²) | Fe Ratio Fe/(Fe + Ni) | Oxygen (wt %) | Press Formability Frictional Coefficient | Weldability Continuous Spot Weldability | Adhesiveness Peeloff Strength (kgf/25 mm) | Chemical Treat-ability | |
|---|---|---|---|---|---|---|---|---|---|
| 13 B | GI | 330 | 0.920 | 4.0 | 0.162 | 1500 | 12.4 | O | Comparative Example |
| 34 B | GI | 300 | 0.200 | 1.0 | 0.154 | 4500 | 12.1 | O | Example |
| 35 B | GI | 270 | 0.200 | 1.0 | 0.155 | 4500 | 12.1 | O | Example |
| 1 C | EG | — | — | — | 0.180 | 1500 | 2.9 | O | Comparative Example |
| 2 C | EG | 330 | 0.000 | 5.0 | 0.163 | 5500 | 5.9 | O | Comparative Example |
| 4 C | EG | 330 | 0.004 | 4.0 | 0.161 | 5500 | 10.9 | O | Example |
| 7 C | EG | 330 | 0.100 | 2.0 | 0.155 | 5250 | 11.9 | O | Example |
| 8 c | EG | 330 | 0.200 | 1.0 | 0.155 | 5000 | 12.4 | O | Example |
| 9 C | EG | 330 | 0.300 | 1.0 | 0.157 | 5000 | 12.4 | O | Example |
| 10 c | EG | 330 | 0.500 | 1.5 | 0.159 | 4500 | 12.4 | O | Example |
| 11 C | EG | 330 | 0.700 | 2.5 | 0.161 | 4000 | 12.4 | O | Example |
| 12 C | EG | 330 | 0.900 | 3.5 | 0.162 | 3500 | 12.4 | O | Example |
| 13 c | EG | 330 | 0.920 | 4.0 | 0.164 | 2000 | 12.4 | O | Comparative Example |
| 34 C | EG | 300 | 0.200 | 1.0 | 0.156 | 5000 | 12.1 | O | Example |
| 35 C | EG | 270 | 0.200 | 1.0 | 0.157 | 5000 | 12.1 | O | Example |

(Note) The plating weight is represented by the total conversion weight of metal elements in the film.

TABLE 14

| Sample No. | Type of Plating | Fe—Ni—O Film Coating Weight (mg/m²) | Fe Ratio Fe/(Fe + Ni) | Oxygen (wt %) | Press Formability Frictional Coefficient | Weldability Continuous Spot Weldability | Adhesiveness Peeloff Strength (kgf/25 mm) | Chemical Treat-ability | |
|---|---|---|---|---|---|---|---|---|---|
| 1 D | Zn—Fe | — | — | — | 0.155 | 4000 | 5.7 | O | Comparative Example |
| 2 D | Zn—Fe | 220 | 0.000 | 5.0 | 0.137 | 8000 | 4.1 | O | Comparative Example |
| 4 D | Zn—Fe | 220 | 0.004 | 4.0 | 0.135 | 8000 | 10.9 | O | Example |
| 7 D | Zn—Fe | 220 | 0.100 | 2.0 | 0.132 | 7750 | 12.1 | O | Example |
| 8 D | Zn—Fe | 220 | 0.200 | 1.0 | 0.128 | 7500 | 13.6 | O | Example |
| 9 D | Zn—Fe | 220 | 0.300 | 1.0 | 0.130 | 7500 | 13.6 | O | Example |
| 10 D | Zn—Fe | 220 | 0.500 | 1.5 | 0.134 | 7000 | 13.6 | O | Example |
| 11 D | Zn—Fe | 220 | 0.700 | 2.5 | 0.136 | 6500 | 13.6 | O | Example |
| 12 D | Zn—Fe | 220 | 0.900 | 3.5 | 0.135 | 6000 | 13.6 | O | Example |
| 13 D | Zn—Fe | 220 | 0.920 | 4.0 | 0.137 | 4500 | 13.6 | O | Comparative Example |
| 34 D | Zn—Fe | 200 | 0.200 | 1.0 | 0.129 | 7500 | 13.3 | O | Example |
| 35 D | Zn—Fe | 180 | 0.200 | 1.0 | 0.130 | 7500 | 13.3 | O | Example |
| 1 E | Zn—Ni | — | — | — | 0.155 | 8000 | 5.7 | O | Comparative Example |
| 2 E | Zn—Ni | 220 | 0.000 | 5.0 | 0.137 | 10000 or Greater | 4.1 | O | Comparative Example |
| 4 E | Zn—Ni | 220 | 0.004 | 4.0 | 0.134 | 10000 or Greater | 10.1 | O | Example |
| 7 E | Zn—Ni | 220 | 0.100 | 2.0 | 0.132 | 10000 or Greater | 12.1 | O | Example |
| 8 E | Zn—Ni | 220 | 0.200 | 1.0 | 0.128 | 10000 or Greater | 13.6 | O | Example |
| 9 E | Zn—Ni | 220 | 0.300 | 1.0 | 0.130 | 10000 or Greater | 13.6 | O | Example |
| 10 E | Zn—Ni | 220 | 0.500 | 1.5 | 0.133 | 10000 or Greater | 13.6 | O | Example |
| 11 E | Zn—Ni | 220 | 0.700 | 2.5 | 0.135 | 10000 or Greater | 13.6 | O | Example |
| 12 E | Zn—Ni | 220 | 0.900 | 3.5 | 0.136 | 10000 or Greater | 13.6 | O | Example |
| 13 E | Zn—Ni | 220 | 0.920 | 4.0 | 0.137 | 9000 | 13.6 | O | Comparative Example |
| 34 E | Zn—Ni | 200 | 0.200 | 1.0 | 0.129 | 10000 or Greater | 13.3 | O | Example |
| 35 E | Zn—Ni | 180 | 0.200 | 1.0 | 0.130 | 10000 or Greater | 13.3 | O | Example |

(Note) The plating weight is represented by the total conversion weight of metal elements in the film.

TABLE 15

| Sample No. | Type of Plating | Fe—Ni—O Film Coating Weight (mg/m²) | Fe Ratio Fe/(Fe + Ni) | Oxygen (wt %) | Press Formability Frictional Coefficient | Weldability Continuous Spot Weldability | Adhesiveness Peeloff Strength (kgf/25 mm) | Chemical Treat-ability | |
|---|---|---|---|---|---|---|---|---|---|
| 1 F | Zn—Cr | — | — | — | 0.155 | 1500 | 5.7 | O | Comparative Example |
| 2 F | Zn—Cr | 220 | 0.000 | 5.0 | 0.138 | 5500 | 4.1 | O | Comparative Example |
| 4 F | Zn—Cr | 220 | 0.004 | 4.0 | 0.136 | 5500 | 10.8 | O | Example |
| 7 F | Zn—Cr | 220 | 0.100 | 2.0 | 0.132 | 5250 | 12.1 | O | Example |
| 8 F | Zn—Cr | 220 | 0.200 | 1.0 | 0.128 | 5000 | 13.6 | O | Example |
| 9 F | Zn—Cr | 220 | 0.300 | 1.0 | 0.130 | 5000 | 13.6 | O | Example |
| 10 F | Zn—Cr | 220 | 0.500 | 1.5 | 0.132 | 4500 | 13.6 | O | Example |
| 11 F | Zn—Cr | 220 | 0.700 | 2.5 | 0.134 | 4000 | 13.6 | O | Example |
| 12 F | Zn—Cr | 220 | 0.900 | 3.5 | 0.135 | 3500 | 13.6 | O | Example |

TABLE 15-continued

| Sample No. | Type of Plating | Fe—Ni—O Film Coating Weight (mg/m²) | Fe Ratio Fe/(Fe + Ni) | Oxygen (wt %) | Press Formability Frictional Coefficient | Weldability Continuous Spot Weldability | Adhesiveness Peeloff Strength (kgf/25 mm) | Chemical Treat-ability | |
|---|---|---|---|---|---|---|---|---|---|
| 13 F | Zn—Cr | 220 | 0.920 | 4.0 | 0.137 | 2000 | 13.6 | O | Comparative Example |
| 34 F | Zn—Cr | 200 | 0.200 | 1.0 | 0.129 | 5000 | 13.3 | O | Example |
| 35 F | Zn—Cr | 180 | 0.200 | 1.0 | 0.130 | 5000 | 13.3 | O | Example |
| 1 G | Zn—Al | — | — | — | 0.180 | 1000 | 2.9 | O | Comparative Example |
| 2 G | Zn—Al | 330 | 0.000 | 5.0 | 0.162 | 5000 | 5.9 | O | Comparative Example |
| 4 G | Zn—Al | 330 | 0.004 | 4.0 | 0.160 | 5000 | 10.4 | O | Example |
| 7 G | Zn—Al | 330 | 0.100 | 2.0 | 0.157 | 4750 | 11.9 | O | Example |
| 8 G | Zn—Al | 330 | 0.200 | 1.0 | 0.153 | 4500 | 12.4 | O | Example |
| 9 G | Zn—Al | 330 | 0.300 | 1.0 | 0.155 | 4500 | 12.4 | O | Example |
| 10 G | Zn—Al | 330 | 0.500 | 1.5 | 0.158 | 4000 | 12.4 | O | Example |
| 11 G | Zn—Al | 330 | 0.700 | 2.5 | 0.159 | 3500 | 12.4 | O | Example |
| 12 G | Zn—Al | 330 | 0.900 | 3.5 | 0.160 | 3000 | 12.4 | O | Example |
| 13 G | Zn—Al | 330 | 0.920 | 4.0 | 0.162 | 1500 | 12.4 | O | Comparative Example |
| 34 G | Zn—Al | 300 | 0.200 | 1.0 | 0.154 | 4500 | 12.1 | O | Example |
| 35 G | Zn—Al | 270 | G.200 | 1.0 | G.155 | 4500 | 12.1 | O | Example |

(Note) The plating weight is represented by the total conversion weight of metal elements in the film.

As a state test of the Fe—Ni—O film formed on each sample, the coating weight (mg/m²) as converted into a total weight of metals, the ratio of the Fe content (wt. %) to the sum of the Fe content (wt. %) and the Ni content (wt. %) in the film (Fe/(Fe+Ni)) and the oxygen content (wt. %) in the film were measured as follows.

[Measurement of coating weight of film as converted into total metal weight and Fe/(Fe+Ni) in film]

For the samples of plating types GI, EG, Zn—Cr, and Zn—Al, the coating weight of the Fe—Ni—O film as converted into a total weight of metal elements in the film and chemical composition were measured by dissolving the Fe—Ni—O film, together with the surface zinciferous plating layer thereunder, with diluted hydrochloric acid to cause peeling, and performing quantitative analysis of Fe and Ni by the ICP method. Then, the ratio Fe/(Fe+Ni) in the film was calculated.

For the samples of plating GA, Zn—Fe and Zn—Ni, it was difficult to completely separate the component elements in the upper Fe—Ni—O film from those of the lower plating layer by the ICP method, since the lower plating layer contained the component elements of the Fe—Ni—O film. Therefore, only component elements of the Fe—Ni—O film not contained in the lower plating layer were quantitatively analyzed by the ICP method. Further, after Ar ion sputtering, the chemical composition distribution of the individual component elements in the Fe—Ni—O film in terms of the depth of the plating layer was measured by repeating measurement of the individual component elements of the Fe—Ni—O film by the XPS method, starting from the film surface. In this measurement, the distance between the depth at which a component element of the Fe—Ni—O film not contained in the lower plating layer showed a maximum concentration and the position equal to a half the depth at which that element was no more detected was taken as the thickness of the Fe—Ni—O film. The coating weight of the Fe—Ni—O film as converted into a total weight of metal elements in the film and the chemical composition were calculated from the results of the ICP method and those of the XPS method. Then, the ratio Fe/(Fe+Ni) was calculated.

[Measurement of oxygen content in film]

The oxygen content in the film was determined from the result of analysis in the depth direction based on the Auger electron spectroscopy (AES).

Then, as a property test of each of the samples of the examples and the comparative examples, press formability, continuous spot weldability, adhesiveness and chemical treatability were tested.

[Chemical treatability]

The following test was carried out to evaluate chemical treatability.

Each sample was treated under ordinary conditions with the use of a dipping-type zinc phosphating solution for under-coating of automobile painting (Nihon Perkerizing Co. Ltd.), and a zinc phosphate film was formed on the surface thereof. Crystallization of the thus formed zinc phosphate film was observed through a scanning type electron microscope (SEM). As a result, cases in which a zinc phosphate film is normally formed are marked with ○, and cases in which a zinc phosphate film is not formed or gaps are produced in crystals, with X.

The results of the frictional coefficient, continuous spot weldability, peeloff strength and chemical treatability tests mentioned above are shown in Tables 11 to 15.

Tables 11 to 15 reveals the following findings.

Regarding properties of the samples (press formability, spot weldability and adhesiveness), comparison of the examples and the comparative examples suggests the following fact. In the examples, there is available improvement in all the foregoing properties as compared with the comparative examples not having an Fe—Ni—O film formed thereon (samples Nos. 1A; 1B; 1C; 1D; 1E; 1F and 1G), and improvement in at least one of the properties as compared with the comparative examples having an Fe—Ni—O film formed under conditions outside the scope of the present invention (2A, 3A, 13A, 14A, 15A, 16A, 23A, 24A, 25A, 26A; 2B, 13B; 2C, 13C; 2D, 13D; 2E, 13E; 2F, 13F; 2G, 13G), suggesting that the examples have more excellent properties in general.

In the comparative examples in which temperature of the aqueous treatment solution was high outside the scope of the present invention (32A, 33A), there was an increase in the manufacturing cost, although properties were excellent.

According to the present invention having the construction as described above, the Fe—Ni—O film formed on the surface of the plating layer of the zinciferous plated steel sheet has a higher hardness and a higher melting point than a zinc or zinc alloy plating layer. Presence of this film reduces sliding resistance between the plating layer surface and a press die during press forming of the zinciferous plated steel sheet, and enables the zinciferous plated steel sheet to easily flow into the die, thus improving press formability. The Fe—Ni—O film of a high melting point permits improvement of continuous spot weldability. Presence of Fe oxides in the Fe—Ni—O film improves peeloff strength of bonded substrates. According to the present invention, therefore, there is provided a zinciferous plated steel sheet excellent in press formability, spot weldability and adhesivenesson, thus providing industrially very useful effects.

EMBODIMENT 4

The present inventors found the possibility of largely improving press formability, spot weldability and adhesiveness by forming an appropriate Fe—Ni—O film on the surface of a plating layer of a zinciferous plated steel sheet, and subjecting, immediately before forming the Fe—Ni—O film, the zinciferous plated steel sheet to an alkaline treatment in an alkaline solution having a pH of at least 11 for a period of from 2 to 30 seconds.

The zinciferous plated steel sheet is inferior to the cold-rolled steel sheet in press formability because, under a high surface pressure, sticking takes place between zinc having a low melting point and the die, leading to an increase in sliding resistance. In order to avoid this inconvenience, it is effective to form a film having a higher hardness and a higher melting point than a zinc or zinc alloy plating layer on the surface of the plating layer of the zinciferous plated steel sheet, which reduces sliding resistance between the plating layer surface and the press die during press forming, and enables the zinciferous plated steel sheet to more easily flow into the press die, thus improving press formability.

The zinciferous plated steel sheet is inferior to the cold-rolled steel sheet in continuous spot weldability because, during welding, molten zinc comes into contact with the copper electrode and forms a brittle alloy layer which causes a more serious deterioration of the electrode. A method of forming a film having a high melting point on the surface of the plating layer is believed to be effective for the purpose of improving continuous spot weldability. To improve spot weldability of the zinciferous plated steel sheet, the present inventors found it particularly effective to form an Fe—Ni—O film as a result of studies on various films. Although the reason is not clear, conceivable causes are formation of Zn—Ni alloys of a high melting point through reaction of Ni and Zn, the high melting point of Ni oxide and the high electric conductivity of Ni oxide since it has semiconductor-like properties.

While the zinciferous plated steel sheet has been known to be inferior to the cold-rolled steel sheet in adhesiveness, the cause has not as yet been clarified. As a result of studies on the cause of this inferiority, the present inventors elucidated that adhesiveness was governed by the chemical composition of the oxide film on the surface of the steel sheet. More specifically, while the oxide film on the surface of the cold-rolled steel sheet mainly comprises Fe oxide, the film on the zinciferous plated steel sheet surface mainly comprises Zn oxide. Adhesiveness varies with the chemical composition of the oxide film: Zn oxide are inferior to Fe oxide in adhesiveness.

It is now possible therefore to improve adhesiveness by forming a film containing Fe oxide on the surface of the zinciferous plated steel sheet, as in the present invention.

The present invention was developed on the basis of the foregoing findings, and the method of manufacturing a zinciferous plated steel sheet of the present invention comprises the steps of subjecting a zinciferous plated steel sheet to an alkaline treatment in an alkaline solution for a period of from 2 to 30 seconds, and then subjecting the same to a film forming treatment for forming an Fe—Ni—O film on the surface of a zinciferous plating layer of the zinciferous plated steel sheet after the alkaline treatment, thereby improving the quality.

A preferable method of manufacturing a zinciferous plated steel sheet of the present invention comprises forming the Fe—Ni—O film by treating the alkali-treated zinciferous plated steel sheet in a aqueous solution containing ferrous chloride and nickel chloride and having a pH within a range of from 2.0 to 3.5 and a temperature within a range of from 20° to 70° C.

A more preferable method of manufacturing a zinciferous plated steel sheet of the present invention comprises forming the Fe—Ni—O film by treating the alkali-treated zinciferous plated steel sheet in an aqueous solution containing ferrous chloride and nickel chloride, in which the ratio of the iron content (wt. %) to the sum of the iron content (wt. %) and the nickel content (wt. %) is within a range of from 0.004 to 0.9, pH is within a range of from 2.0 to 3.5, and temperature is within a range of from 20° to 70° C.

In the present invention, the Fe—Ni—O film as an upper layer, formed on the surface of the plating layer of the zinciferous plated steel sheet of the present invention and in relation thereto shall be referred to as the "film," and on the other hand, the zinc or zinciferous plating layer as a lower layer shall be referred to as the "plating layer" for discrimination, not a "film."

Now, reasons of limiting the manufacturing conditions in the present invention will be described below.

The zinciferous plated steel sheet is treated in the alkaline solution for a period of from 2 to 30 seconds, and then the Fe—Ni—O film is formed on the surface of a plating layer of the zinciferous plated steel sheet. The reason is that the zinciferous plated steel sheet having the Fe—Ni—O film, more excellent in press formability than in a case without an alkaline treatment is available.

Figure 6:
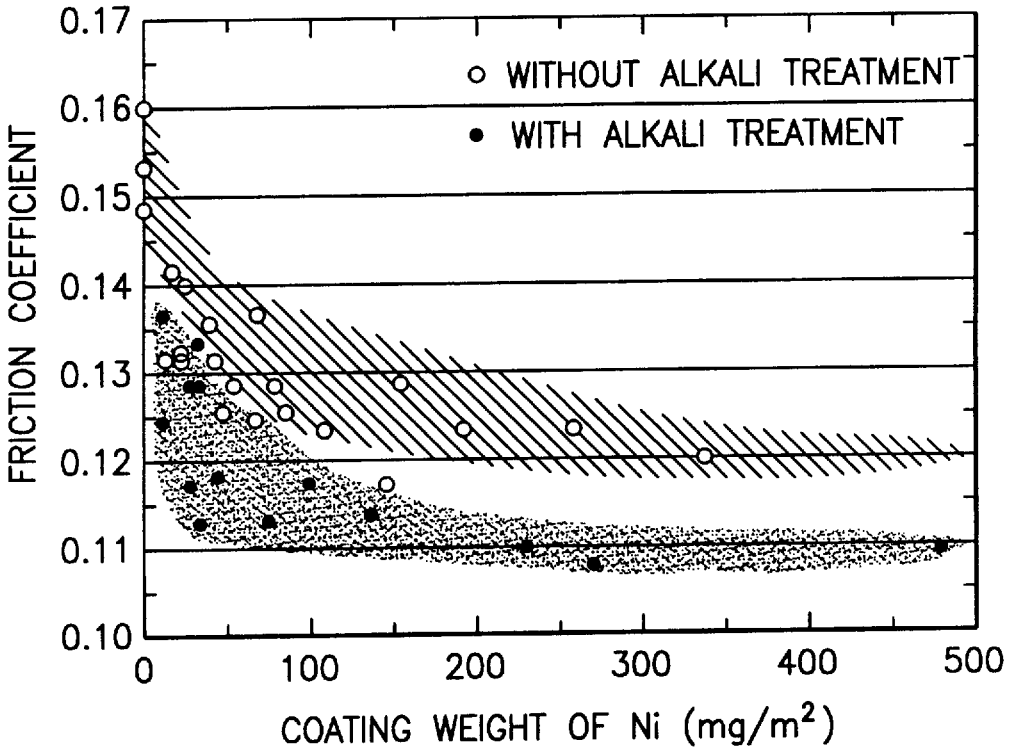
FIG. 6 is a graph illustrating an example of the relationship between the coating weight of Ni and frictional coefficient in a zinciferous plated steel sheet in cases with and without an alkali treatment.

FIG. 6 is a graph illustrating the relationship between the coating weight of Ni onto the surface of the plating layer of the zinciferous plated steel sheet and the frictional coefficient observed in a press formability test of the zinciferous plated steel sheet while comparing cases with and without an alkaline treatment. It is clear from FIG. 6 that, as compared with the case without the treatment, the case with treatment in the alkaline solution results in a smaller value of frictional coefficient when the coating weight of Ni is kept constant, and is superior in press formability.

As the alkaline solution, an aqueous solution of one or more of alkaline chemicals such as NaOH, KOH, $Na_2SO_4$, $Na_2PO_4$, LiHO and MgOH can be used. The alkali concentration of the aqueous solution should have a pH of at least 10, and pH should more preferably be adjusted to at least 11. In this case, it suffices to set the concentration in general to about 5 to 50 g/l.

When the Fe—Ni—O film is formed after treating the zinciferous plated steel sheet in an acidic solution, while a slight improvement of press formability is available, the resultant steel sheet is inferior to that treated in an alkaline solution in press formability, spot weldability and adhesiveness. This is due to the improvement of adhesiveness of the Fe—Ni—O film formed after treatment of the zinciferous plated steel sheet in the alkaline solution. The treatment in the acidic solution causes increase in the amount of an oxide film inevitably produced on the surface of the zinciferous plated steel sheet, and the foregoing effect is considered unavailable.

In this case, the Fe—Ni—O film is a mixture of Fe metal, Fe oxide, Ni metal and Ni oxide. There is no particular restrictions on the method for forming the film: it suffices to treat the sheet in an aqueous solution containing iron ion, nickel ion and an oxidizing agent, and applicable methods include the dipping method in the aqueous solution, the spraying method of the aqueous solution and the electroplating method. Further, the laser CVD, the optical CVD, the vacuum deposition, sputtering vapor deposition or other vapor plating method may also be applicable.

The foregoing aqueous solution for film forming may incidentally contain cations, hydroxides and oxides as well as anions of Zn, Co, Mn, Mo, Al, Ti, Sn, W, Si, Pb, Nb and Ta contained in the plating layer of the zinciferous plated steel sheet used in the present invention.

For the purpose of improving alkali treatability of the zinciferous plated steel sheet, a surfactant or the like may be added to the alkaline solution. Addition of an oxidizing agent however forms oxides on the surface of the zinciferous plated steel sheet, resulting in deterioration of adhesiveness of the Fe—Ni—O film. Addition of an oxidizing agent or the like is not therefore desirable.

An aqueous solution containing $FeCl_2$ and $NiCl_2$ can be used when forming the Fe—Ni—O film. For the supply of ferric ion and nickel ion, use of a metal salt of chloride gives a high precipitation efficiency. With the same salt concentration and treating time, therefore, there is available a larger coating weight of Ni and Fe as compared with nitrates and sulfates, thus permitting improvement of productivity.

Figure 7:
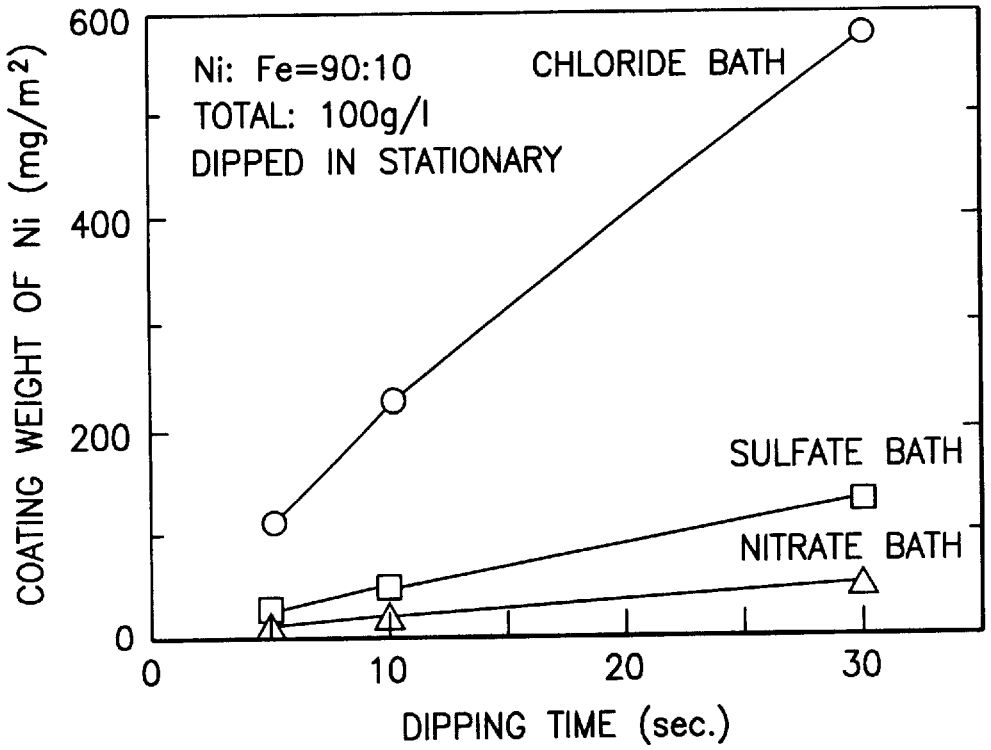
FIG. 7 is a graph illustrating differences in coating weight of Ni among cases with immersion in a chloride both, a sulfate bath and nitrate bath as an Fe—Ni—O film forming treatment solution.

FIG. 7 is a graph illustrating differences in the Ni coating weight among cases where the zinciferous plated steel sheet is dipped in a chloride bath, a sulfate bath or a nitrate bath as the treatment solution for the formation of the Fe—Ni—O film, where the ratio of Ni to Fe in the treatment solution is 90:10, and the sum of concentration is 100 g/l.

The aqueous solution for the formation of the film should preferably have a pH within a range of from 2.0 to 3.5. The reason is as follows.

With a pH of under 2.0, the amount of hydrogenation from the cathode becomes excessively larger, leading to a lower precipitation efficiency, and with the same salt concentration and treating time, the coating weight of Ni and Fe is reduced, resulting in a lower productivity. The film has come to mainly comprise Ni and Fe metals, and improving effect of press formability, spot weldability and adhesiveness is unavailable. With a pH of over 3.5, on the other hand, oxidation of Fe in the aqueous solution becomes violent, and sludge causes defects of the surface of the steel sheet.

Figure 8:
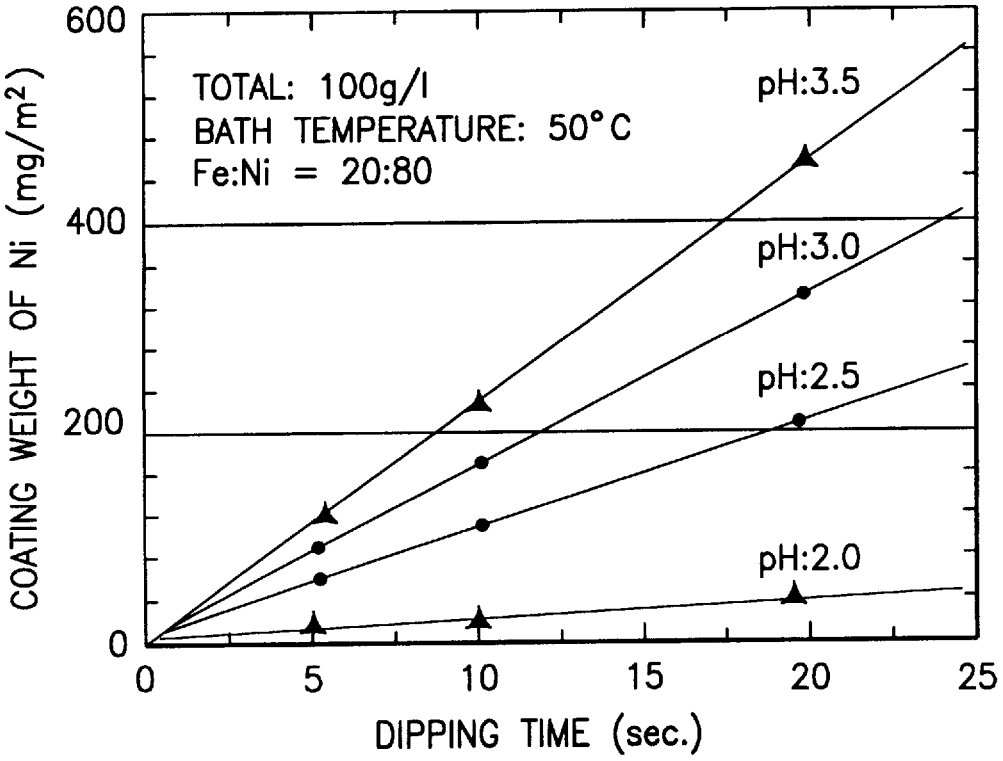
FIG. 8 is a graph illustrating an example of coating weight of Ni relative to the dipping time at various values of pH.

FIG. 8 is a graph illustrating an example of Ni coating weight relative to the dipping time with a pH varying from 2.0 to 3.5, under conditions including a treatment bath temperature of 50° C., an Ni to Fe concentration ratio in the treatment bath of 20:80, and a sum of concentration of 100 g/l.

Temperature of the aqueous solution should be within a range of from 20° to 70° C.

At a solution temperature of under 20° C., the reaction rate is low and it takes a long period of time to ensure a sufficient coating weight of Ni and Fe necessary for improving film properties, resulting in a decrease in productivity. At a temperature of over 70° C., on the other hand, deterioration of treatment performance of the aqueous solution is accelerated, and necessity of facilities and energy for keeping a high temperature results in an increase in the manufacturing cost.

The ratio of the Fe content (wt. %) to the sum of the Fe content (wt. %) and the Ni content (wt. %) in the aqueous solution (Fe/(Fe+Ni)) should preferably be within a range of from 0.004 to 0.9. The reason is as follows.

With a ratio Fe/(Fe+Ni) in the aqueous solution of under 0.004, the improving effect of adhesiveness is unavailable. With a ratio of over 0.9, on the other hand, the improving effect of spot weldability is reduced.

The zinciferous plated steel sheet used in the present invention suffices to be is a steel sheet having a plating layer formed by the dip plating method, the electroplating method, the vapor plating method or the like on a substrate. In terms of chemical composition, the zinciferous plating layer comprises, in addition to pure zinc, a single-layer or a plurality of layers containing one or more of such metals as Fe, Ni, Co, Mn, Cr, Al, Mo, Ti, Si, W, Sn, Pb, Nb and Ta (Si is also regarded as a metal), or oxides thereof, or organic substances. The layer may contain furthermore such fine particles as $SiO_2$ and $Al_2O_3$. As the zinciferous plated steel sheet, a plated steel sheet having a plurality of layer or a functional gradient plated steel sheet having a plating layer with a different chemical composition may be used.

The Fe—Ni—O film formed on the surface of the plating layer of the zinciferous plated steel sheet under the foregoing limiting conditions eliminates sticking between the steel sheet and the die during press forming, reduces sliding resistance, improves flow-in into the die, inhibits formation of a brittle alloy layer between the sheet and the copper electrode during spot welding, thus improving continuous spot weldability and improves adhesiveness under the effect of the film containing Fe.

EXAMPLES

The zinciferous plated steel sheet before forming the Fe—Ni—O film by the method of the present invention or a comparative method has any of the following plating seeds A, B, C, D, E, F and G formed thereon:

A: There is formed an alloyed dip-plating layer comprising 10 wt. % Fe and the balance Zn in a coating weight of 60 g/m$^2$ for each of the both surfaces;

B: There is formed a dip-plating layer in a coating weight of 90 g/m$^2$ for each of the both surfaces;

C: There is formed an electroplating layer in a coating weight of 40 g/m$^2$ for each of the both surfaces;

D: There is formed a Zn—Fe alloy electroplating layer comprising 15 wt. % Fe and the balance Zn, in a coating weight 40 g/m$^2$ for each of the both surfaces;

E: There is formed a Zn—Ni alloy electroplating layer comprising 12 wt. % Ni and the balance Zn, in a coating weight of 30 g/m$^2$ for each of the both surfaces;

F: There is formed a Zn—Cr alloy electroplating layer comprising 4 wt. % Cr and the balance Zn, in a coating weight of 20 g/m$^2$ for each of the both surfaces;

G: There is formed a Zn—Al alloy electroplating layer comprising 5 wt. % Al and the balance Zn, in a coating weight of 60 g/m$^2$ for each of the both surfaces.

Tests were carried out for examples in which the Fe—Ni—O film forming treatment was applied within the scope of the present invention to the above-mentioned zinciferous plated steel sheets, and for comparative examples in which the film forming treatment was not applied and comparative examples in which a method outside the scope of the present invention was applied.

Example 1

A test was carried out, in which the plating type was fixed to symbol A (alloyed dip-plating), and conditions for alkali treatment as a pre-treatment and the method for forming the Fe—Ni—O film were altered.

Table 16 shows conditions for the tests Nos. 1 to 21 in detail. The solution for forming the Fe—Ni—O film was an aqueous solution containing $FeCl_2$ and $NiCl_2$.

TABLE 16

| | | | Alkali Treatment Condition | | | | | | |
|---|---|---|---|---|---|---|---|---|---|
| | | Type of | Solution | | | | | Fe—Ni—O Film | |
| No | Test | Plating | Chemical Composition | pH | Treatment | Temperature (C.°) | Time (sec) | Presence | Film Forming |
| 1 | Comparative Example 1 | A | — | — | — | — | — | X | — |
| 2 | Comparative Example 2 | A | NaOH | 12.0 | Dipping | 50 | 5 | X | — |
| 3 | Comparative Example 3 | A | — | — | — | — | — | O | Dipping |
| 4 | Comparative Example 4 | A | NaOH | 9.5 | Dipping | 50 | 5 | O | Dipping |
| 5 | Example 1 | A | NaOH | 10.5 | Dipping | 50 | 5 | O | Dipping |
| 6 | Example 2 | A | NaOH | 11.0 | Dipping | 50 | 5 | O | Dipping |
| 7 | Example 3 | A | NaOH | 11.5 | Dipping | 50 | 5 | O | Dipping |
| 8 | Example 4 | A | NaOH | 12.0 | Dipping | 50 | 5 | O | Dipping |
| 9 | Example 5 | A | NaOH | 13.0 | Dipping | 50 | 5 | O | Dipping |
| 10 | Example 6 | A | NaOH | 14.0 | Dipping | 50 | 5 | o | Dipping |
| 11 | Comparative Example 5 | A | $H_2SO_4$ | 2.0 | Dipping | 50 | 5 | O | Dipping |
| 12 | Comparative Example 6 | A | HCl | 2.0 | Dipping | 50 | 5 | O | Dipping |
| 13 | Example 7 | A | NaOH | 12.0 | Spray | 50 | 5 | O | Dipping |
| 14 | Example 8 | A | KOH | 12.0 | Dipping | 50 | 5 | O | Dipping |
| 15 | Example 9 | A | $Na_2SiO_4$ | 12.0 | Dipping | 50 | 5 | O | Dipping |
| 16 | Example 10 | A | $Mg(OH)_2$ | 12.0 | Dipping | 50 | 5 | O | Dipping |
| 17 | Example 11 | A | LiOH | 12.0 | Dipping | 50 | 5 | O | Dipping |
| 18 | Example 12 | A | $Na_2PO_4$ | 12.0 | Dipping | 50 | 5 | O | Dipping |
| 19 | Example 13 | A | NaOH | 12.0 | Dipping | 50 | 5 | O | Spray |
| 20 | Example 14 | A | NaOH | 12.0 | Dipping | 50 | 5 | O | Electrolysis |
| 21 | Example 15 | A | NaOH | 12.0 | Dipping | 50 | 5 | O | Vapor Deposition |

O: With Fe—No—O film
X: Without Fe—Ni—O film

Example 2

Tests were carried out on zinciferous plated steel sheets of plating type symbols B, C, D, E, F and G. Comparative examples included cases where an alkali treatment as a pre-treatment was not applied without applying the Fe—Ni—O film forming treatment, and cases with the alkali treatment but without the Fe—Ni—O film forming treatment. Examples covered cases where the Fe—Ni—O film forming treatment was applied after the alkali treatment. Alkali treatment conditions were the same for the comparative examples and the examples.

Table 17 shows details of conditions for tests Nos. 22 to 39. The solution for forming the Fe—Ni—O film had the same chemical composition as in Test 1.

TABLE 17

| | | | Alkali Treatment Condition | | | | | | |
|---|---|---|---|---|---|---|---|---|---|
| | | Type of | Solution | | | | | Fe—Ni—O Film | |
| No | Test | Plating | Chemical Composition | pH | Treatment | Temperature (C.°) | Time (sec) | Presence | Film Forming |
| 22 | Comparative Example 7 | B | — | — | — | — | — | X | — |
| 23 | Comparative Example 8 | B | NaOH | 12.0 | Dipping | 50 | 5 | X | — |
| 24 | Example 16 | B | NaOH | 12.0 | Dipping | 50 | 5 | O | Dipping |
| 25 | Comparative Example 9 | C | — | — | — | — | — | X | — |
| 26 | Comparative Example 10 | C | NaOH | 12.0 | Dipping | 50 | 5 | X | — |

TABLE 17-continued

| No | Test | Type of Plating | Alkali Treatment Condition: Solution: Chemical Composition | pH | Treatment | Temperature (C.°) | Time (sec) | Fe—Ni—O Film: Presence | Film Forming |
|---|---|---|---|---|---|---|---|---|---|
| 27 | Example 17 | C | NaOH | 12.0 | Dipping | 50 | 5 | O | Dipping |
| 28 | Comparative Example 11 | D | — | — | — | — | — | X | — |
| 29 | Comparative Example 12 | D | NaOH | 12.0 | Dipping | 50 | 5 | X | — |
| 30 | Example 18 | D | NaOH | 12.0 | Dipping | 50 | 5 | O | Dipping |
| 31 | Comparative Example 13 | E | — | — | — | — | — | X | — |
| 32 | Comparative Example 14 | E | NaOH | 12.0 | Dipping | 50 | 5 | X | — |
| 33 | Example 19 | E | NaOH | 12.0 | Dipping | 50 | 5 | O | Dipping |
| 34 | Comparative Example 15 | F | — | — | — | — | — | X | — |
| 35 | Comparative Example 16 | F | NaOH | 12.0 | Dipping | 50 | 5 | X | — |
| 36 | Example 20 | F | NaOH | 12.0 | Dipping | 50 | 5 | O | Dipping |
| 37 | Comparative Example 17 | G | — | — | — | — | — | X | — |
| 38 | Comparative Example 18 | G | NaOH | 12.0 | Dipping | 50 | 5 | X | — |
| 39 | Example 21 | G | NaOH | 12.0 | Dipping | 50 | 5 | O | Dipping |

O: With Fe—No—O film
X: Without Fe—Ni—O film

Example 3

Tests were carried out with a fixed plating type symbol A and constant alkali treatment conditions for pre-treatment by altering the chemical composition of the Fe—Ni—O film forming solution. The aqueous solution contained $FeCl_2$ and $NiCl_2$. The concentration of $FeCl_2$ and $NiCl_2$ was altered. The ratio of the Fe content (wt. %) to the sum of the Fe content (wt. %) and the Ni content (wt. %) was altered. The other conditions were kept constant.

Table 18 shows details of the conditions for tests Nos. 40 to 58.

TABLE 18

| No | Test | Alkali Treatment Condition: Solution: Chemical Composition | pH | Treatment | Temperature (°C.) | Time (sec) | Fe—Ni—O Film Forming Condition: Aqueous Solution: Film Forming | $FeCl_2$ g/l | $NiCl_2$ g/l | pH | Temperature (°C.) | Fe/(Fe + Ni) | Dipping Time (s) |
|---|---|---|---|---|---|---|---|---|---|---|---|---|---|
| 40 | Comparative Example 19 | A NaOH | 12.0 | Dipping | 50 | 5 | Dipping | 0 | 200.0 | 2.5 | 50 | 0 | 10 |
| 41 | Example 22 | A NaOH | 12.0 | Dipping | 50 | 5 | Dipping | 0.7 | 199 | 2.5 | 50 | 0.0035 | 10 |
| 42 | Example 23 | A NaOH | 12.0 | Dipping | 50 | 5 | Dipping | 0.8 | 199 | 2.5 | 50 | 0.004 | 10 |
| 43 | Example 24 | A NaOH | 12.0 | Dipping | 50 | 5 | Dipping | 1.0 | 199 | 2.5 | 50 | 0.005 | 10 |
| 44 | Example 25 | A NaOH | 12.0 | Dipping | 50 | 5 | Dipping | 5.0 | 195 | 2.5 | 50 | 0.025 | 10 |
| 45 | Example 26 | A NaOH | 12.0 | Dipping | 50 | 5 | Dipping | 10.0 | 190 | 2.5 | 50 | 0.05 | 10 |
| 46 | Example 27 | A NaOH | 12.0 | Dipping | 50 | 5 | Dipping | 20.0 | 180 | 2.5 | 50 | 0.1 | 10 |
| 47 | Example 28 | A NaOH | 12.0 | Dipping | 50 | 5 | Dipping | 30.0 | 170 | 2.5 | 50 | 0.15 | 10 |
| 48 | Example 29 | A NaOH | 12.0 | Dipping | 50 | 5 | Dipping | 40.0 | 160 | 2.5 | 50 | 0.2 | 10 |
| 49 | Example 30 | A NaOH | 12.0 | Dipping | 50 | 5 | Dipping | 50.0 | 150 | 2.5 | 50 | 0.25 | 10 |
| 50 | Example 31 | A NaOH | 12.0 | Dipping | 50 | 5 | Dipping | 60.0 | 140 | 2.5 | 50 | 0.3 | 10 |
| 51 | Example 32 | A NaOH | 12.0 | Dipping | 50 | 5 | Dipping | 80.0 | 120 | 2.5 | 50 | 0.4 | 10 |
| 52 | Example 33 | A NaOH | 12.0 | Dipping | 50 | 5 | Dipping | 100.0 | 100 | 2.5 | 50 | 0.5 | 10 |
| 53 | Example 34 | A NaOH | 12.0 | Dipping | 50 | 5 | Dipping | 120.0 | 80 | 2.5 | 50 | 0.6 | 10 |
| 54 | Example 35 | A NaOH | 12.0 | Dipping | 50 | s | Dipping | 140.0 | 60 | 2.5 | 50 | 0.7 | 10 |
| 55 | Example 36 | A NaOH | 12.0 | Dipping | 50 | 5 | Dipping | 160.0 | 40 | 2.5 | 50 | 0.8 | 10 |
| 56 | Example 37 | A NaOH | 12.0 | Dipping | 50 | 5 | Dipping | 180.0 | 20 | 2.5 | 50 | 0.9 | 10 |
| 57 | Example 38 | A NaOH | 12.0 | Dipping | 50 | 5 | Dipping | 185.0 | 15 | 2.5 | 50 | 0.925 | 10 |
| 58 | Comparative Example 20 | A NaOH | 12.0 | Dipping | 50 | 5 | Dipping | 200.0 | 0 | 2.5 | 50 | 1 | 10 |

For the samples of zinciferous plated steel sheets thus manufactured in Examples and Comparative Examples, evaluation tests of press formability, spot weldability, adhesiveness and chemical treatability were carried out. Spot weldability was evaluated in terms of the continuous spot welding runs. Adhesiveness was evaluated in terms of peeloff strength after bonding. Chemical treatability was evaluated in terms of the state of crystallization of the zinc phosphate film.

Tables 19, 20 and 21 show the results of Tests 1, 2 and 3, respectively.

TABLE 19

| No. | Test | Press Formability Frictional Coefficient ($\mu$) | Spot Weldability Continuous Spot Weldability | Adhesiveness Peeloff strength (kgf/cm$^2$) | Chemical Treatability Condition of Zinc Phosphate Film |
|---|---|---|---|---|---|
| 1 | Comparative Example 1 | 0.150 | 2500 | 8.0 | — |
| 2 | Comparative Example 2 | 0.145 | 2500 | 10.0 | — |
| 3 | Comparative Example 3 | 0.125 | 5000 | 12.0 | o |
| 4 | Comparative Example 4 | 0.125 | 5000 | 12.0 | o |
| 5 | Example 1 | 0.120 | 5500 | 12.0 | o |
| 6 | Example 2 | 0.115 | 5500 | 12.5 | o |
| 7 | Example 3 | 0.110 | 5500 | 12.5 | o |
| 8 | Example 4 | 0.110 | 5500 | 12.5 | o |
| 9 | Example 5 | 0.105 | 5500 | 12.5 | o |
| 10 | Example 6 | 0.105 | 5500 | 12.5 | o |
| 11 | Comparative Example 5 | 0.130 | 5000 | 12.5 | o |
| 12 | Comparative Example 6 | 0.130 | 5000 | 12.5 | o |
| 13 | Example 7 | 0.110 | 5300 | 12.5 | o |
| 14 | Example 8 | 0.110 | 5500 | 12.5 | o |
| 15 | Example 9 | 0.110 | 5500 | 12.5 | o |
| 16 | Example 10 | 0.110 | 5500 | 12.5 | o |
| 17 | Example 11 | 0.110 | 5500 | 12.5 | o |
| 18 | Example 12 | 0.110 | 5500 | 12.5 | o |
| 19 | Example 13 | 0.110 | 5500 | 12.5 | o |
| 20 | Example 14 | 0.110 | 5500 | 12.5 | o |
| 21 | Example 15 | 0.110 | 5500 | 12.5 | o |
| 22 | Comparative Example 7 | 0.180 | 1500 | 5.0 | o |
| 23 | Comparative Example 8 | 0.175 | 1500 | 6.0 | o |
| 24 | Example 16 | 0.130 | 4000 | 12.5 | o |
| 25 | Comparative Example 9 | 0.180 | 2500 | 6.0 | o |
| 26 | Comparative Example 10 | 0.175 | 250 | 7.0 | o |
| 27 | Example 17 | 0.130 | 5000 | 12.5 | o |

TABLE 20

| No. | Test | Press Formability Frictional Coefficient ($\mu$) | Spot Weldability Continuous Spot Weldability | Adhesiveness Peeloff strength (kgf/cm$^2$) | Chemical Treatability Condition of Zinc Phosphate Film |
|---|---|---|---|---|---|
| 28 | Comparative Example 11 | 0.150 | 3000 | 8.0 | o |
| 29 | Comparative Example 12 | 0.145 | 3000 | 10.0 | o |
| 30 | Example 18 | 0.115 | 6000 | 12.0 | o |
| 31 | Comparative Example 13 | 0.150 | 8000 | 6.0 | o |
| 32 | Comparative Example 14 | 0.145 | 8000 | 7.0 | o |
| 33 | Example 19 | 0.115 | 10000 | 12.5 | o |
| 34 | Comparative Example 15 | 0.150 | 3000 | 6.0 | o |
| 35 | Comparative Example 16 | 0.145 | 3000 | 7.0 | o |
| 36 | Example 20 | 0.115 | 6000 | 12.5 | o |

TABLE 20-continued

| No. | Test | Press Formability Frictional Coefficient (ǂ) | Spot Weldability Continuous Spot Weldability | Adhesiveness Peeloff strength (kgf/cm$^2$) | Chemical Treatability Condition of Zinc Phosphate Film |
|---|---|---|---|---|---|
| 37 | Comparative Example 17 | 0.180 | 1500 | 5.0 | o |
| 38 | Comparative Example 18 | 0.175 | 1500 | 7.0 | o |
| 39 | Example 21 | 0.130 | 4000 | 12.5 | o |

TABLE 21

| No. | Test | Press Formability Frictional Coefficient (ǂ) | Spot Weldability Continuous Spot Weldability | Adhesiveness Peeloff strength (kgf/cm$^2$) | Chemical Treatability Condition of Zinc Phosphate Film |
|---|---|---|---|---|---|
| 40 | Comparative Example 19 | 0.135 | 5500 | 6.0 | o |
| 41 | Example 22 | 0.130 | 5500 | 11.0 | o |
| 42 | Example 23 | 0.120 | 5500 | 12.0 | o |
| 43 | Example 24 | 0.110 | 5500 | 12.5 | o |
| 44 | Example 25 | 0.110 | 5500 | 12.5 | o |
| 45 | Example 26 | 0.110 | 5500 | 12.5 | o |
| 46 | Example 27 | 0.110 | 5000 | 12.5 | o |
| 47 | Example 28 | 0.110 | 5000 | 12.5 | o |
| 48 | Example 29 | 0.110 | 5500 | 12.5 | o |
| 49 | Example 30 | 0.110 | 5500 | 12.5 | o |
| 50 | Example 31 | 0.110 | 5500 | 12.5 | o |
| 51 | Example 32 | 0.110 | 5500 | 12.5 | o |
| 52 | Example 33 | 0.110 | 5500 | 12.5 | o |
| 53 | Example 34 | 0.110 | 5500 | 12.5 | o |
| 54 | Example 35 | 0.110 | 5000 | 12.5 | o |
| 55 | Example 36 | 0.120 | 4500 | 12.5 | o |
| 56 | Example 37 | 0.120 | 4000 | 12.5 | o |
| 57 | Example 38 | 0.130 | 3500 | 12.5 | o |
| 58 | Comparative Example 20 | 0.135 | 2500 | 12.5 | o |

Test result 1

From the result shown in Table 19, the following fact is evident.

When the plating type is fixed as symbol A (alloyed dip-plating), the Comparative Examples were inferior to the Examples in at least one of properties.

More specifically, (1) Comparative Example 1 in which an alkali treatment nor formation of an Fe—Ni—O film was conducted, and in Comparative Example 2 in which an alkali treatment was applied without however formation of an Fe—Ni—O film, are inferior to Examples in all of press formability, spot weldability, adhesiveness and chemical treatability.

(2) Comparative Example 3 with formation of an Fe—Ni—O film but not an alkali treatment is inferior to Examples in press formability.

(3) Comparative Example 4 in which the sheet was treated in an aqueous solution having an alkali concentration of pH: 9.5 which is lower than the concentration usually used for conventional alkali treatment and then an Fe—Ni—O film was formed was inferior to Examples in press formability.

(4) Comparative Examples 5 and 6 in which an Fe—Ni—O film was formed but a pre-treatment was conducted in an acidic solution are inferior to Examples in press formability.

Test result 2

The results shown in Table 5 suggest the following fact.

(1) For a primer plating type symbol D, E or F, even without an alkali treatment and formation of an Fe—Ni—O film, or with an alkali treatment but without formation of an Fe—Ni—O film, properties show values almost at the same level as under the same conditions with plating type symbol A. In the case of symbols B, C and G, however, Comparative examples 7, 9 and 17 without an alkali treatment nor formation of an Fe—Ni—O film, and Comparative Examples 8, 10 and 18 with an alkali treatment but without formation of an Fe—Ni—O film are further inferior even to Comparative Examples 1 and 2 of plating type symbol A under the same conditions in any of press formability, spot weldability and adhesiveness.

(2) Among cases with any of primer plating type symbols B, C, D, E, F and G, while Comparative Examples 7 to 18 are inferior in at least one of press formability, spot weldability and adhesiveness, Examples 17 to 21 show improved properties as compared with Comparative Examples of the same plating types.

Test result 3

From the result shown in Table 21, the following fact is clear for cases with plating type symbol A.

(1) Comparative Example 19 in which the zinciferous plated steel sheet was alkali-treated in an aqueous solution containing $NiCl_2$ but not $FeCl_2$ and then a film was formed, and Comparative Example 20 in which the sheet was treated in an aqueous solution containing $FeCl_2$ but not $NiCl_2$ are poor in press formability and adhesiveness, and in press formability and spot weldability, respectively.

(2) Examples 22 to 38 within the scope of the present invention show in contrast improvement in all of press formability, spot weldability, adhesiveness and chemical treatability. This improvement is particularly remarkable in cases where the ratio Fe (wt. %)/(Fe (wt. %)+Ni (wt. %)) in the Fe—Ni—O film treating solution is within a range of from 0.004 to 0.9.

Even in cases with plating type symbols B, C, D, E, F and G, results similar to those with plating type symbol A would be obtained.

According to the present invention having the construction as described above, the Fe—Ni—O film formed on the surface of the plating layer of the zinciferous plated steel sheet has a higher hardness and a higher melting point than a zinc or zinc alloy plating layer. Presence of this film reduces sliding resistance between the plating layer surface and a press die during press forming of the zinciferous plated steel sheet, and enables the zinciferous plated steel sheet to easily slip into the die, thus improving press formability. The Fe—Ni—O film of a high melting point permits improvement of continuous spot weldability. Presence of Fe oxides in the Fe—Ni—O film improves peeloff strength of bonded substrates. According to the present invention, therefore, there is provided a method of manufacturing a zinciferous plated steel sheet excellent in press formability, spot weldability and adhesiveness, thus providing industrially very useful effects.

EMBODIMENT 5

It was found that the formation of an island-like or mosaic Fe—Ni—O film on a surface of a zinciferous plating layer of a zinciferous plated steel sheet can improve press formability, spot weldability and adhesiveness.

A conventional zinciferous plated steel sheet is inferior to a cold-rolled steel sheet in press formability. This is caused by the increase in sliding resistance due to the adhesion of low-melting-point zinc to a die. In order to prevent this, it is effective to form a film having higher hardness and a higher melting point than a zinc or zinc alloy plating layer on the surface of the zinciferous plated steel sheet. Since the Fe—Ni—O film has high hardness and a high melting point, the formation of the island-like or mosaic-shaped Fe—Ni—O film on the surface of the zinciferous plated steel sheet decreases the sliding resistance between the deposit surface and the press die press die during press forming, and facilitates sliding of the zinciferous plated steel sheet into the press die, thereby improving the press formability.

A conventional zinciferous plated steel sheet is inferior to a cold-rolled steel sheet in the continuous spot weldability in spot welding. This is caused by the fact that a brittle alloy layer is formed due to melting of zinc and copper of an electrode in contact therewith during welding, thereby significantly deteriorating the electrode. In the present invention, therefore, since the island-like or mosaic Fe—Ni—O film is formed, a decrease in the contact area between the copper electrode and zinc during spot welding contributes to improvement in the spot weldability.

It is also thought that an effective method for improving the continuous spot weldability of the zinciferous plated steel sheet is to form a high-melting-point film on the surface of the plating layer. As a result of research on various films for improving the spot weldability of the zinciferous plated steel sheet, the inventors found that a Ni or Ni oxide film is particularly effective. Although the reasons for this are not apparent, a possible reason is that, since a high-melting-point Zn—Ni alloy is formed by reaction of Ni and Zn, Ni and Ni oxide have very high melting points, and the Ni oxide has semiconductor properties, the electric conductivity is high among the various films.

Although it is known that a conventional zinciferous plated steel sheet is inferior to a cold-rolled steel sheet in adhesiveness, the reasons for this are not apparent. As a result of examination of the reasons, therefore, the inventors found that the adhesiveness is governed by the composition of an oxide film on the steel surface. Namely, although the oxide film on the surface of the cold-rolled steel sheet is mainly composed of Fe oxide, the oxide film on the zinciferous plated steel sheet is mainly composed of Zn oxide. The adhesiveness depends upon the composition of the oxide film, and the Zn oxide is inferior to the Fe oxide in adhesiveness. Therefore, the formation of a film containing a Fe oxide on the surface of the zinciferous plated steel sheet can improve the adhesiveness, as in the present invention.

The reasons why a conventional zinciferous plated steel sheet is inferior to a cold-rolled steel sheet in the chemical treatability are that, since the Zn content in the surface of the zinciferous plated steel sheet is high, the crystal structure of the formed phosphate film is coarse and nonuniform, and that the phosphate film on the zinciferous plated steel sheet has a crystal structure and a composition different from those of the cold-rolled steel sheet. When the Zn content in the surface of the steel sheet is high, the phosphate crystal mainly comprises hopeite, and the hot-water secondary adhesiveness after painting is poor. The cause of this is that, since the Fe content of the phosphate film is low, the adhesion force of the chemically-treated film to the steel sheet is lost due to condensation when the film is exposed to a wet environment after painting.

In order to prevent the chemically-treated film from recovering the lost water, it is effective to contain a metal such as Fe or Ni in the phosphate crystal. In the present invention, the formation of the Fe—Ni—O film causes Ni and Fe in the film to be captured in the phosphate crystal during chemical treatment to form a chemically treated film having good adhesiveness. Since the Fe—Ni—O film having an island-like or mosaic distribution is formed, the film does not cover the entire zinciferous plating layer. Therefore, at the same time, direct reaction of the chemically treated film and the zinciferous plating layer takes place, thereby ensuring the adhesive force for the zinciferous plating layer itself.

As described above, it was found that, when the mixed film comprising Ni and Fe metals and oxides thereof, i.e., the Fe—Ni—O film, having an island-like or mosaic distribution is formed on the surface of the zinciferous plated steel sheet, the steel sheet obtained is excellent in all the press formability, spot weldability, adhesiveness and chemical treatability.

The present invention has been achieved on the basis of the above finding, and a zinciferous plated steel sheet of the present invention comprises a Fe—Ni—O film formed on at least one plating layer, wherein the Fe—Ni—O film has an island-like or mosaic distribution, the coating weight of the Fe—Ni—O film is within the range of 10 to 1500 mg/m$^2$ in terms of the total weight of the metal elements in the Fe—Ni—O film, and the ratio of surface coating of the Fe—Ni—O film is within the range of 30 to 90%.

In the zinciferous plated steel sheet, the ratio of the Fe content (wt %) to the total of the Fe content (wt %) and the Ni content (wt %) of the Fe—Ni—O film is preferably within the range of 0.004 to 0.9, and the oxygen content of the Fe—Ni—O film is within the range of 0.5 to 10 wt %.

A method of producing a zinciferous plated steel sheet of the present invention comprises spraying a mist solution containing Fe ion and Ni ion and having a pH within the range of 1 to 3.5 on at least one plating layer of the zinciferous plated steel sheet, maintaining the zinciferous plated steel sheet at a temperature within the range of 20° to 70° C. for 1 second or more, and then heating the zinciferous plated steel sheet to form, on the plating layer, a Fe—Ni—O film having a coating weight within the range of 10 to 1500 $mg/m^2$ in terms of the total weight of metal elements, a rate of coating within the range of 30 to 90%, and an island-like or mosaic distribution.

In the method of producing a zinciferous plated steel sheet, the ratio of the Fe content (g/l) to the total of the Fe content (g/l) and the Ni content (g/l) in the mist solution is within the range of 0.004 to 0.9.

In the method of producing a zinciferous plated steel sheet, the Fe—Ni—O filming is formed by heat treatment of the zinciferous plated steel sheet at a temperature of 80° to 500° C.

Another method of producing a zinciferous plated steel sheet of the present invention is described below.

The important characteristic lies in the island-like or mosaic Fe—Ni—O film formed on the plating layer of the predetermined zinciferous plated steel sheet, and the forming method thereof. In order to properly form the island-like or mosaic Fe—Ni—O film, the zinciferous plated steel sheet is pre-treated as described below so as to form minute portions where the Fe—Ni—O film is easily formed, and minute portions where the Fe—Ni—O film is hardly formed on the plating layer. The Fe—Ni—O film is then formed on the zinciferous plated steel sheet with the surface having such minute portions formed thereon. The method of forming the film is characterized in that the coating weight is within the range of 10 to 1500 $mg/m^2$ in terms of the total weight of the metallic elements, and the ratio of coating is within the range of 30 to 90%.

The methods of pre-treating the zinciferous plated steel sheet include the following methods:

(1) Fine irregularities are formed on the surface of the plating layer by temper-rolling the zinciferous plated steel sheet.

(2) A new surface is formed on the surface of the plating layer by temper-rolling the zinciferous plated steel sheet.

(3) The air oxide film existing on the surface of the plating layer is partly dissolved by dipping the zinciferous plated steel sheet in an acid solution, or anodic electrolysis in an acid solution to form active and inactive portions on the surface of the plating layer.

(4) The air oxide film existing on the surface of the plating layer is partly dissolved by dipping the zinciferous plated steel sheet in an alkaline solution, or anodic electrolysis in an alkaline solution to form active and inactive portions on the surface of the plating layer.

In the method of producing a zinciferous plated steel sheet in accordance with any one of the above mentioned pre-treating methods (1) to (4), a cathodic electrolysis method is preferably used as the method of forming the Fe—Ni—O film, and the electrolytic solution used preferably satisfies conditions in that it contains nickel sulfate, ferrous sulfate and ferric sulfate in a total amount within the range of 0.3 to 2.0 mol/l, and the pH is within the range of 1 to 2.

In the method of producing a zinciferous plated steel sheet, the electrolytic solution used satisfies conditions in that the ratio of the Fe content (g/l) to the total of the Fe content (g/l) and the Ni content (g/l) is within the range of 0.004 to 0.9, and the molar ratio of ferric sulfate (mol/l) to the total of ferrous sulfate (mol/l) and ferric sulfate (mol/l) is within the range of 0.5 to less than 1.0.

In the method of producing a zinciferous plated steel sheet in accordance with any one of the above mentioned pre-treating methods (1) to (4), an aqueous solution is used for forming the Fe—Ni—O film, and the aqueous solution contains $FeCl_2$ and $NiCl_2$, and satisfies conditions in that the pH is within the range of 2.0 to 3.5, and the temperature is within the range of 20° to 70° C.

In the method of producing a zinciferous plated steel sheet, the aqueous solution used for forming the Fe—Ni—O film satisfies a condition in that the ratio of the Fe content (g/l) to the total of the Fe content (g/l) and the Fe content (g/l) is within the range of 0.004 to 0.9.

Figure 9:
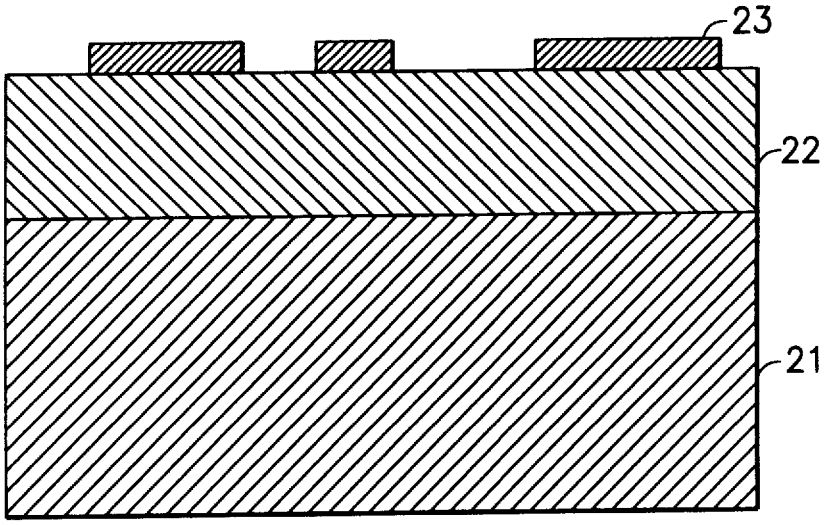
FIG. 9 is a schematic drawing illustrating a longitudinal section of a zinciferous plated steel sheet in accordance with an embodiment of the present invention.

FIG. 9 is a schematic drawing illustrating a longitudinal section of a zinciferous plated steel sheet in accordance with an embodiment of the present invention. As shown in the drawing, the zinciferous plated steel sheet of the present invention comprises a steel sheet 21, a zinciferous plating layer 22 formed on at least one surface of the steel sheet 21, and a Fe—Ni—O film 23 formed on the surface of the zinciferous plating layer 22 and having an island-like or mosaic distribution.

The reasons for limiting the Fe—Ni—O film of the zinciferous plated steel sheet as described above are described below.

The reasons for determining the coating weight of the Fe—Ni—O film to 10 to 1500 $mg/m^2$ in terms of the total weight of the metal elements are as follows. With a coating weight of less than 10 $mg/m^2$, the effect of improving the press formability, spot weldability and adhesiveness cannot be obtained. While with a coating weight over 500 $mg/m^2$, not only the effect is saturated, but also the formation of the phosphate crystal is inhibited by the presence of the oxide film, thereby deteriorating the chemical treatability.

The reasons why the rate of coating of the Fe—Ni—O film 23 covering the surface of the zinciferous plating layer 22 and having an island-like or mosaic distribution is limited to be within the range of 30 to 90% per side of the steel sheet are as follows.

If the ratio of coating of the Fe—Ni—O film 23 is less than 30% per side of the steel sheet, the effect of improving press formability and spot weldability cannot be obtained. While, if the ratio of coating the Fe—Ni—O film 23 exceeds 90% per side of the steel sheet, the area of direct reaction of the phosphate crystal and the zinciferous plated steel sheet is decreased, thereby deteriorating the adhesiveness to the zinciferous plating layer 23.

It is an essential requirement that the Fe—Ni—O film has an island-like or mosaic distribution. The reasons for this are as follows. If the film covers the entire surface of the zinciferous plating layer, when a chemically treated film is formed thereon, the treated film does not react with the zinciferous plating layer, and thus the adhesive force between the chemically treated film and the zinciferous plating layer itself cannot be ensured, thereby deteriorating the adhesive force between the chemically treated film and the zinciferous plating layer itself.

In the Fe—Ni—O film 23, the Fe ratio (Fe/(Fe+Ni)) of the film is preferably within the range of 0.004 to 0.9. The reasons for this are as follows. With a ratio Fe/(Fe+Ni) of less than 0.004, the effect of improving the adhesiveness is low, while with a ratio over 0.9, the effect of improving the s pot weldability is low.

The oxygen content of the Fe—Ni—O film is preferably within the range of 0.5 to 10 wt %. The reasons for this are as follows. With an oxygen content of less than 0.5 wt %, since the metallic properties of the film are enhanced, the effect of improving the press formability is low, while with an oxygen content over 10 wt %, the formation of the phosphate crystal is inhibited by the presence of the oxide film, thereby causing the tendency that the chemical treatability deteriorate.

The zinciferous plated steel sheets used in the present invention are steel sheets each having a plating layer formed on a surface of the steel sheet as a base material by a method such as a dip plating method, an electroplating method, a vapor phase plating method or the like. The zinciferous plating layer comprises a single layer or a plurality of layers having a composition containing pure zinc, and a metal or an oxide thereof such as Fe, Ni, Co, Mn, Cr, Al, Mo, Ti, Si, W, Sn, Pb, Nb, Ta, or the like, or at least one organic material. The plating layer may contain fine particles of $SiO_2$, $Al_2O_3$ or the like. A multilayer plated steel sheet and a functional gradient plated steel sheet, in which the composition is changed, can also be used as the zinciferous plated steel sheet.

The method of producing a zinciferous plated steel sheet in accordance with a first manner of the present invention is described. In the first manner, a mist solution having a pH of 1 to 3.5 and containing Fe and Ni ions is sprayed on the surface of the zinciferous plating layer on at least one side of the zinciferous plated steel sheet. After the steel sheet is held at 20° to 70° C. for 1 second or more, it is heated to form, on the surface of the plating layer, the Fe—Ni—O film having an island-like or mosaic distribution, a coating weight of 10 to 1500 mg/m$^2$ in terms of the total weight of the metallic elements, and a rate of coating of 30 to 90%.

The reason for limiting the pH of the misty solution to be within the range of 1 to 3.5 is that, with a pH beyond this range, no reaction of displacement deposition takes place when the solution adheres to the surface of the zinciferous plated steel sheet, and thus metallic Ni and Fe cannot be formed in the Fe—Ni—O film.

The reason for maintaining the steel sheet at a temperature of 20° to 70° C. for 1 second or more after the mist solution was sprayed thereon is that a time for displacement reaction is ensured for capturing Ni and Fe in the Fe—Ni—O film. The mist solution is preferably a chloride bath having a high efficiency of displacement deposition, and any other solutions such as a sulfate bath, a nitrate bath and the like may be used as long as displacement reaction is secured. In order to improve the efficiency of displacement deposition, additives such as an oxidizer, a surfactant, etc. may be added for facilitating decomposition of the salts during heating.

In order to form the Fe—Ni—O film having a coating weight of 10 to 1500 mg/m$^2$ in terms of the total weight of the metal elements, and a rate of coating within the range of 30 to 90%, the size and amount of the mist particles sprayed or the concentration of the solution may be adjusted.

The reasons why the heating temperature of the zinciferous plated steel sheet on which the mist solution is sprayed is limited to be within the range of 80° to 500° C. are as follows. At a temperature lower than 80° C., the salts are not decomposed, and thus the Fe—Ni—O film cannot properly be formed, while at a temperature over 500° C., a problem occurs in which the characteristics of the steel sheet and the plating layer are undesirably changed.

The method of producing a zinciferous plated steel sheet in accordance with a second manner of the present invention is described below. In the second manner, fine irregularities are formed on the surface of the zinciferous plating layer by temper rolling, and treatment for forming a Fe—Ni—O film on the surface of the plating layer on at lest one side of the steel sheet is performed for forming the Fe—Ni—O film having an island-like or mosaic distribution, a coating weight of 10 to 1500 mg/m2 in terms of the total weight of the metallic elements, and a ratio of coating of 30 to 90%.

Temper rolling of the zinciferous plated steel sheet is performed for correcting the shape and smoothing the surface, and a roll having fine irregularities formed on the surface thereof is used.

Figure 10:
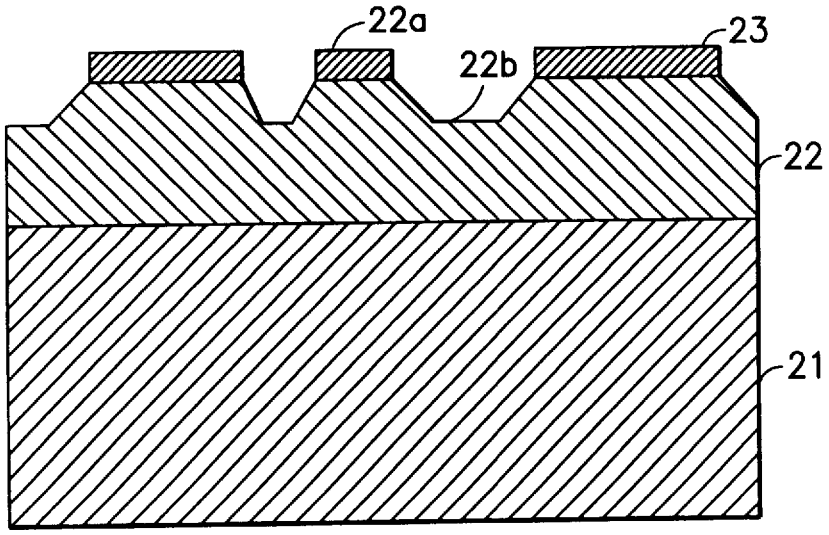
FIG. 10 is a schematic drawing illustrating a longitudinal section of a zinciferous plated steel sheet in accordance with an embodiment of the present invention in which the zinciferous plated steel sheet is temper-rolled by using a rolling roll having a surface with fine irregularities formed therein, and then treated to form a Fe—Ni—O film.

FIG. 10 is a schematic drawing illustrating a section of a zinciferous plated steel sheet temper-rolled by using the roll having fine irregularities formed on the surface thereof. As shown in the drawing, fine convex and concave portions 22*a* and 22*b* are formed in the surface of a zinciferous plating layer 22 of a steel sheet 21. Treatment for forming a Fe—Ni—O film is then performed on the surface of the zinciferous plated steel sheet on which fine irregularities are formed, to form the Fe—Ni—O film only on the convex portions 22*a*. As a result, the island-like for mosaic Fe—Ni—O film is formed. This is caused by the fact that the formation reactivity of the Fe—Ni—O film in the convex portions is higher than that in the concave portions. When the Fe—Ni—O film is formed by the electrolysis method, electrolytic current is concentrated at the convex portions. In the aqueous solution dipping method, the convex and concave portions shows different diffusion behaviors of reaction ions in the solution.

A method of producing a zinciferous plated steel sheet in accordance with a third manner is described below. In the third manner, a new surface is formed on the surface of the plating layer by temper-rolling the zinciferous plated steel sheet, and treatment for forming a Fe—Ni—O film is then performed on the surface of the plating layer on at least one side thereof to form the Fe—Ni—O film having an island-like or mosaic distribution, a coating weight of 10 to 1500 mg/m$^2$ in terms of the total weight of the metal elements, and a rate of coating of 30 to 90%.

Temper rolling of the zinciferous plated steel sheet is performed for correcting the shape and smoothing the surface, and a rolling roll having a relatively smooth surface thereof is used.

Figure 11:
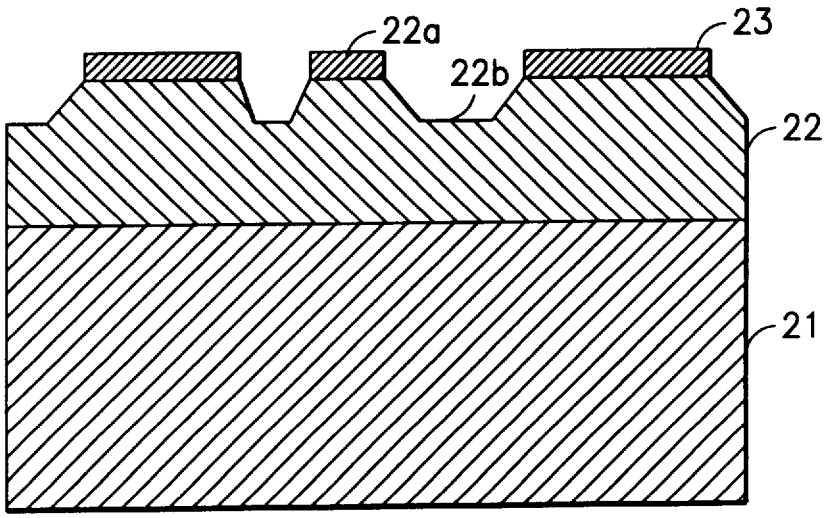
FIG. 11 is a schematic drawing illustrating a longitudinal section of a zinciferous plated steel sheet in accordance with an embodiment of the present invention in which the zinciferous plated steel sheet is temper-rolled by using a rolling roll having a relatively smooth surface, and then treated to form a Fe—Ni—O film.

FIG. 11 is a schematic drawing illustrating a section of a zinciferous plated steel sheet temper-rolled by using the rolling roll having a relatively smooth surface. As shown in the drawing, convex portions of fine irregularities originally present on the surface of a zinciferous plating layer 22 of a steel sheet 21 contact the roll to form convex portions 22*a* where new surfaces appear, and concave portions 22*b* where no new surface is exposed. Treatment for forming a Fe—Ni—O film is then performed on the surface of the zinciferous plated steel sheet in which the new surfaces appear in the convex portions, to form the Fe—Ni—O film only on the new surfaces of the convex portions 22*a*. As a result, the island-like or mosaic Fe—Ni—O film is formed. This is caused by the fact that the formation reactivity of the Fe—Ni—O film in the convex portions is higher than that in the concave portions. In the electrolytic method for forming the Fe—Ni—O film, electrolytic current is concentrated at the convex portions, and, in the aqueous solution dipping method, the convex and concave portions shows different diffusion behaviors of reaction ions in the solution, as in the second manner.

A method of producing a zinciferous plated steel sheet in accordance with a fourth manner is described below. In the fourth manner, an air oxide film present on a surface of the plating layer is partly dissolved by dipping the zinciferous plated steel sheet in an acid solution or anodic electrolysis in an acid solution to form active and inactive portions. Treatment for forming a Fe—Ni—O film is then performed to form the Fe—Ni—O film having an island-like or mosaic distribution, a coating weight of 10 to 1500 mg/m$^2$ in terms of the total weight of the metal elements, and a ratio of coating of 30 to 90%.

Figure 12:
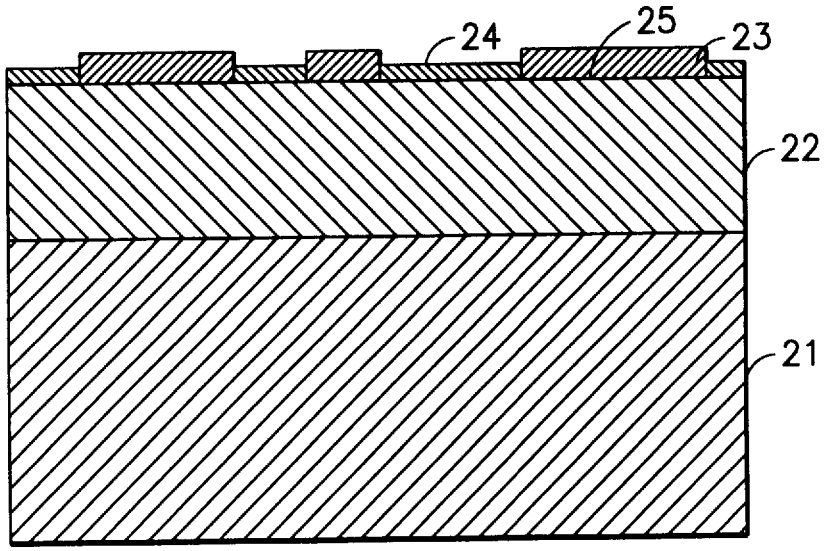
FIG. 12 is a schematic drawing illustrating a longitudinal section of a zinciferous plated steel sheet in accordance with an embodiment of the present invention in which an air oxide film on the surface of the zinciferous plated steel sheet is partly dissolved by dipping in an acid solution or anodic electrolysis in an acid solution to form active and inactive portions in the deposit surface.

FIG. 12 is a schematic sectional view of the zinciferous plated steel sheet in which the air oxide coating is partly dissolved by dipping the zinciferous plated steel sheet in an acid solution or anodic electrolysis in an acid solution to form active and inactive portions on the surface of the plating layer. As shown in the drawing, inactive portions 24 where the air oxide film remains and active portions 25 where the air oxide film remains in a thin layer are formed on the surface of a zinciferous plating layer 22. Treatment for forming a Fe—Ni—O film is then performed on the zinciferous plated steel sheet having the above active and inactive portions to form the Fe—Ni—O film 23 only on the active portions. As a result, the island-like or mosaic Fe—Ni—O film is formed. This is caused by the fact that the Fe—Ni—O film in the active portions has higher formation reactivity. In the electrolytic method for forming the Fe—Ni—O film, electrolytic current is concentrated at the active portions, and, in the aqueous solution dipping method, the active portions have high activity.

A method of producing a zinciferous plated steel sheet in accordance with a fifth manner is described below. In the fifth manner, an alkaline solution is used in place of the acid solution used in the fourth manner, and the same effects are obtained. Namely, an air oxide film present on a surface of the plating layer is partly dissolved by dipping the zinciferous plated steel sheet in an alkaline solution or anodic electrolysis in an alkaline solution to form active and inactive portions. Treatment for forming a Fe—Ni—O film is then performed to form the Fe—Ni—O film having an island-like or mosaic distribution, a coating weight of 10 to 1500 mg/m$^2$ in terms of the total weight of the metal elements, and a rate of coating of 30 to 90%.

When an air oxide film present on a surface of the plating layer is partly dissolved by dipping the zinciferous plated steel sheet in the alkaline solution or by anodic electrolysis in the alkaline solution to form the active and inactive portions, the steel sheet has the same sectional state as that shown in FIG. 12. Treatment for forming the Fe—Ni—O film is then performed on the zinciferous plated steel sheet to form the Fe—Ni—O film only on the active portions. As a result, the island-like or mosaic Fe—Ni—O film is formed This is caused by the fact that the Fe—Ni—O film in the active portions has higher formation reactivity. In the electrolytic method for forming the Fe—Ni—O film, electrolytic current is concentrated at the active portions, and, in the aqueous solution dipping method, the active portions have high activity, as in the fourth manner.

In the treatment for the Fe—Ni—O film, the Fe—Ni—O film can be formed by cathodic electrolysis using an electrolytic solution having a pH of 1 to 2 and containing nickel sulfate, ferrous sulfate and ferric sulfate in a total amount of 0.3 to 2.0 mol/l.

It is also preferable that the ratio of the Fe content (g/l) to the total of the Fe content (g/l) and the Ni content (g/l) in the electrolytic solution is controlled to be within the range of 0.004 to 0.9, and the molar ratio of ferrous sulfate (mol/l) to the total of the ferrous sulfate (mol/l) and ferric sulfate (mol/l) is controlled to be within the range of 0.5 to less than 1.0. The reasons why these conditions are preferable are as follows. If the Fe ratio (Fe/(Fe+Ni)) of the electrolytic solution is less than 0.004, the Fe content of the Fe—Ni—O film is decreased, and the effect of improving adhesiveness is thus decreased. While if the Fe ratio exceeds 0.9, the Fe content of the Fe—Ni—O film is increased, and the effect of improving the spot weldability is thus decreased. With a molar ratio of ferric sulfate (ferric sulfate/ferrous sulfate+ferric sulfate) of less than 0.5, the oxygen content of the Fe—Ni—O film is decreased. On the other hand, the higher the molar ratio is, the more easily the iron oxide is captured in the Fe—Ni—O film, and the higher the oxygen content becomes. However, the electrolytic solution containing only ferric sulfate is undesirable because yellowing occurs in plating.

In the treatment for forming the Fe—Ni—O film, the Fe—Ni—O film is preferably formed by treatment with an aqueous solution containing $FeCl_2$ and $NiCl_2$ at a pH of 2.0 to 3.5 and a temperature of 20° to 70° C. The ratio of Fe content (g/l) to the total of the Fe content (g/l) and the Ni content (g/l) is further preferably controlled to 0.004 to 0.9.

EXAMPLES

Examples within the range of the present invention and comparative examples out of the range of the present invention were carried out as described below.

As the zinciferous plated steel sheets used in the examples and comparative examples, the seven types of steel sheets below respectively denoted by symbols A to G were appropriately selected according to the plating methods, the compositions and the coating weights.

A: Alloyed zinc dip-plated steel sheet (10 wt % Fe, the balance Zn) both sides of which had a coating weight of 60 g/m$^2$.

B: Zinc dip-plated steel sheet both sides of which had a coating weight of 90 g/m$^2$.

C: Zinc electroplated steel sheet both sides of which had a coating weight of 40 g/m$^2$.

D: Zn—Fe alloy electroplated steel sheet (15% Fe) both sides of which had a coating weight of 40 g/m$^2$.

E: Zn—Ni alloy electroplated steel sheet (12 wt % Ni) both sides of which had a coating weight of 30 g/m$^2$.

F: Zn—Cr alloy electroplated steel sheet (4 wt % Cr) both sides of which had a coating weight of 20 g/m$^2$.

G: Zn—Fe alloy dip-plated steel sheet (5 wt % Al) both sides of which had a coating weight of 60 g/m$^2$.

In the examples of the present invention, the Fe—Ni—O film having an island-like or mosaic distribution was formed on the plating layer of each of the above types of zinciferous plated steel sheets by the following methods I) to V):

I) On the basis of the first manner of the present invention, a zinciferous plated steel sheet was produced in which a Fe—Ni—O film had an island-like or mosaic distribution.

The mist solution containing Fe and Ni ions was sprayed on the zinciferous plated steel sheet, and the steel sheet was then heated to form the film. The other main conditions were as follows:

Components of the solution: nickel chloride and iron chloride

Metal ion content of the solution: 1 to 10 g/l

Amount of the solution sprayed: controlled to obtain a predetermined coating weight Holding time after spraying the solution: 1 to 30 seconds Heating temperature: 200° to 350° C.

Heating time: 1 minute

II) On the basis of the second manner of the present invention, a zinciferous plated steel sheet was produced in which a Fe—Ni—O film had an island-like or mosaic distribution.

Fine irregularities (irregularity pitch: 50 to 300 $\mu$m) were formed on the zinciferous plating layer surface by temper-rolling the zinciferous plated steel sheet, and treatment for forming the Fe—Ni—O film was the performed by the cathodic electrolysis method 1 or aqueous solution dipping method 2 below.

1. Cathodic electrolysis method

Electrolytic solution: Solution containing nickel sulfate, ferrous sulfate and ferric sulfate Electrolytic solution concentration: 0.3 to 2.0 mol/l (total concentration of components)

pH: 1 to 2

Fe ratio in the electrolytic solution (Fe/(Fe+Ni)): 0.004 to 0.9

Molar ratio of ferric sulfate of the electrolytic solution (ferric sulfate/ferrous sulfate+ferric sulfate): 0.5 to 1.0

2. Aqueous solution dipping method

Aqueous solution and component content:

nickel chloride=120 g/l ferrous chloride=changing concentrations pH: 2.5 to 3.5

Fe ratio of the aqueous solution (Fe/(Fe+Ni)): 0.004 to 0.9

Dipping time: 1 to 30 seconds

III) On the basis of the third manner of the present invention, a zinciferous plated steel sheet was produced in which a Fe—Ni—O film had an island-like or mosaic distribution.

A new surface (pitch of new surface: 10 to 50 μm) was formed on the zinciferous plating layer by temper-rolling the zinciferous plated steel sheet, and treatment for forming the Fe—Ni—O film was then performed.

The film was formed by the aqueous solution dipping method 2 described above in II).

IV) On the basis of the fourth manner of the present invention, a zinciferous plated steel sheet was produced in which a Fe—Ni—O film had an island-like or mosaic distribution.

The air oxide film present on the surface of the zinciferous plating layer was partly dissolved by dipping the zinciferous plated steel sheet in a sulfuric acid solution of pH 3 for 2 to 5 seconds to form active and inactive portions on the surface of the plating layer, and treatment for forming the Fe—Ni—O film was then performed.

The film was formed by either of the cathodic electrolysis method 1 and the aqueous solution dipping method 2.

V) On the basis of the fifth manner, a zinciferous plated steel sheet was produced in which a Fe—Ni—O film had an island-like or mosaic distribution.

The air oxide film present on the surface of the zinciferous plating layer was partly dissolved by dipping the zinciferous plated steel sheet in a NaOH alkaline solution of pH 12 for 2 to 5 seconds to form active and inactive portions on the surface of the plating layer, and treatment for forming the Fe—Ni—O film was then performed.

The film was formed by either of the cathodic electrolysis method 1 and the aqueous solution dipping method 2.

On the other hand, in the comparative examples, a zinciferous plated steel sheet was prepared by a method in which the Fe—Ni—O film was formed under conditions beyond the range of the present invention, or no treatment was formed for forming the film.

Tables 22 to 26 show the plating layer type (denoted by a symbol) and the coating weight of the zinciferous plating layer, the method (denoted by a symbol) of forming the Fe—Ni—O film, and the coating weight thereof in terms of the total weight of metal elements and the rate of coating of each of the examples and the comparative examples. Tables 25 and 26 further show the Fe ratio (Fe/(Fe+Ni)) of the film the oxygen content thereof of each of the examples and comparative examples.

TABLE 22

| | Lower Layer | | Fe—Ni—O Film | | | | Press- | Spot Weldability | | Adhesion |
|---|---|---|---|---|---|---|---|---|---|---|
| | Type | Coating Weight ($g/m^2$) | Forming Method | | Coating Weight ($mg/m^2$) | Rate of Coating (%) | Formability Friction Coefficient | Number of Continuous Welding Spots | Chemical Treatability | Between Treated Film and Zinc Layer |
| 1 Comparative Example | A | 60 | — | — | 0 | 0 | 0.165 | 3000 | Δ | o |
| 2 Example | A | 60 | I | — | 200 | 30 | 0.145 | 5000 points or more | o | o |
| 3 Example | A | 60 | I | — | 200 | 60 | 0.135 | 5000 points or more | o | o |
| 4 Example | A | 60 | I | — | 200 | 90 | 0.125 | 5000 points or more | o | o |
| 5 Example | A | 60 | II | 1 | 200 | 40 | 0.140 | 5000 points or more | o | o |
| 6 Example | A | 60 | II | 1 | 200 | 70 | 0.130 | 5000 points or more | o | o |
| 7 Example | A | 60 | II | 2 | 200 | 40 | 0.140 | 5000 points or more | o | o |
| 8 Example | A | 60 | II | 2 | 200 | 70 | 0.130 | 5000 points or more | o | o |
| 9 Comparative Example | A | 60 | III | 2 | 5 | 70 | 0.155 | 4000 | Δ | o |
| 10 Example | A | 60 | III | 2 | 10 | 70 | 0.140 | 5000 points or more | o | o |
| 11 Example | A | 60 | III | 2 | 50 | 70 | 0.135 | 5000 points or more | o | o |
| 12 Example | A | 60 | III | 2 | 100 | 70 | 0.132 | 5000 points or more | o | o |
| 13 Comparative Example | A | 60 | III | 2 | 200 | 20 | 0.155 | 5000 points or more | o | o |
| 14 Example | A | 60 | III | 2 | 200 | 30 | 0.142 | 5000 points or more | o | o |
| 15 Example | A | 60 | III | 2 | 200 | 60 | 0.132 | 5000 points | o | o |

TABLE 22-continued

| | Lower Layer | | Fe—Ni—O Film | | | | Press- | Spot Weldability | | Adhesion |
|---|---|---|---|---|---|---|---|---|---|---|
| | Type | Coating Weight ($g/m^2$) | Forming Method | | Coating Weight ($mg/m^2$) | Rate of Coating (%) | Formability Friction Coefficient | Number of Continuous Welding Spots | Chemical Treatability | Between Treated Film and Zinc Layer |
| 16 Example | A | 60 | III | 2 | 200 | 90 | 0.125 | or more 5000 points or more | o | o |
| 17 Comparative Example | A | 60 | III | 2 | 200 | 100 | 0.125 | 5000 points or more | o | Δ |
| 18 Example | A | 60 | III | 2 | 400 | 70 | 0.120 | 5000 points or more | o | o |

TABLE 23

| | Lower Layer | | Fe—Ni—O Film | | | | Press- | Spot Weldability | | Adhesion |
|---|---|---|---|---|---|---|---|---|---|---|
| | Type | Coating Weight ($g/m^2$) | Forming Method | | Coating Weight ($mg/m^2$) | Rate of Coating (%) | Formability Friction Coefficient | Number of Continuous Welding Spots | Chemical Treatability | Between Treated Film and Zinc Layer |
| 19 Example | A | 60 | III | 2 | 700 | 70 | 0.120 | 5000 points or more | o | o |
| 20 Example | A | 60 | III | 2 | 1000 | 70 | 0.115 | 5000 points or more | o | o |
| 21 Example | A | 60 | III | 2 | 1500 | 70 | 0.115 | 5000 points or more | o | o |
| 22 Comparative Example | A | 60 | III | 2 | 1600 | 70 | 0.115 | 5000 points or more | x | o |
| 23 Example | A | 60 | IV | 1 | 200 | 40 | 0.140 | 5000 points or more | o | o |
| 24 Example | A | 60 | IV | 1 | 200 | 70 | 0.130 | 5000 points or more | o | o |
| 25 Example | A | 60 | IV | 2 | 200 | 40 | 0.140 | 5000 points or more | o | o |
| 26 Example | A | 60 | IV | 2 | 200 | 70 | 0.130 | 5000 points or more | o | o |
| 27 Example | A | 60 | V | 1 | 200 | 40 | 0.140 | 5000 points or more | o | o |
| 28 Example | A | 60 | V | 2 | 200 | 70 | 0.130 | 5000 points or more | o | o |
| 29 Example | A | 60 | V | 2 | 200 | 40 | 0.140 | 5000 points or more | o | o |
| 30 Example | A | 60 | V | 2 | 200 | 70 | 0.130 | 5000 points or more | o | o |
| 31 Comparative Example | B | 90 | — | — | 0 | 0 | 0.180 | 2000 | Δ | o |
| 32 Example | B | 90 | III | 2 | 200 | 30 | 0.145 | 5000 points or more | o | o |
| 33 Example | B | 90 | III | 2 | 200 | 70 | 0.135 | 5000 points or more | o | o |
| 34 Comparative Example | C | 40 | — | — | 0 | 0 | 0.165 | 4000 | Δ | o |
| 35 Example | C | 40 | III | 2 | 200 | 30 | 0.135 | 5000 points or more | o | o |
| 36 Example | C | 40 | III | 2 | 200 | 70 | 0.125 | 5000 points or more | o | o |

TABLE 24

| | Lower Layer | | Fe—Ni—O Film | | | | Press- | Spot Weldability | | Adhesion |
|---|---|---|---|---|---|---|---|---|---|---|
| | Type | Coating Weight ($g/m^2$) | Forming Method | | Coating Weight ($mg/m^2$) | Rate of Coating (%) | Formability Friction Coefficient | Number of Continuous Welding Spots | Chemical Treatability | Between Treated Film and Zinc Layer |
| 37 Comparative Example | D | 40 | — | — | 0 | 0 | 0.165 | 4000 | Δ | o |
| 38 Example | D | 40 | III | 2 | 200 | 30 | 0.135 | 5000 points or more | o | o |

TABLE 24-continued

| | Lower Layer | | Fe—Ni—O Film | | | | Press- | Spot Weldability | | Adhesion |
|---|---|---|---|---|---|---|---|---|---|---|
| | Type | Coating Weight ($g/m^2$) | Forming Method | | Coating Weight ($mg/m^2$) | Rate of Coating (%) | Formability Friction Coefficient | Number of Continuous Welding Spots | Chemical Treatability | Between Treated Film and Zinc Layer |
| 39 Example | D | 40 | III | 2 | 200 | 70 | 0.125 | 5000 points or more | o | o |
| 40 Comparative Example | E | 30 | — | — | 0 | 0 | 0.165 | 4000 | Δ | o |
| 41 Example | E | 30 | III | 2 | 200 | 30 | 0.135 | 5000 points or more | o | o |
| 42 Example | E | 30 | III | 2 | 200 | 70 | 0.125 | 5000 points or more | o | o |
| 43 Comparative Example | F | 20 | — | — | 0 | 0 | 0.165 | 4000 | Δ | o |
| 44 Example | F | 20 | III | 2 | 200 | 30 | 0.135 | 5000 points or more | o | o |
| 45 Example | F | 20 | III | 2 | 200 | 70 | 0.125 | 5000 points or more | o | o |
| 46 Comparative Example | G | 60 | — | — | 0 | 0 | 0.18O | 2000 | Δ | o |
| 47 Example | G | 60 | III | 2 | 200 | 30 | 0.145 | 5000 points or more | o | o |
| 48 Example | G | 60 | III | 2 | 200 | 70 | 0.135 | 5000 points or more | o | o |

TABLE 25

| | Lower Layer | | Fe—Ni—O Film | | | | | | Press- | Spot Weldability | Adhesion | |
|---|---|---|---|---|---|---|---|---|---|---|---|---|
| | Type | Coating Weight ($g/m^2$) | Forming Method | | Coating Weight ($mg/m^2$) | Rate of Coating (%) | Fe/ (Fe + Ni) | Oxygen Content (%) | Formability Friction Coefficient | Number of Continuous Welding Spots | Peel Strength (kgf/25 mm) | Chemical Treatability |
| 49 Comparative Example | A | — | — | — | — | — | — | — | 0.165 | 3000 | 8.0 | Δ |
| 50 Comparative Example | A | 60 | III | 2 | 200 | 70 | 0 | 3 | 0.130 | 8000 | 7.0 | o |
| 51 Example | A | 60 | III | 2 | 200 | 70 | 0.003 | 3 | 0.130 | 8000 | 8.0 | o |
| 52 Example | A | 60 | III | 2 | 200 | 70 | 0.004 | 3 | 0.130 | 8000 | 11.0 | o |
| 53 Example | A | 60 | III | 2 | 200 | 70 | 0.010 | 3 | 0.130 | 8000 | 11.5 | o |
| 54 Example | A | 60 | III | 2 | 200 | 70 | 0.050 | 3 | 0.130 | 8000 | 12.0 | o |
| 55 Example | A | 60 | III | 2 | 200 | 70 | 0.100 | 3 | 0.130 | 8000 | 12.5 | o |
| 56 Example | A | 60 | III | 2 | 200 | 70 | 0.150 | 3 | 0.130 | 8000 | 12.5 | o |
| 57 Example | A | 60 | III | 2 | 200 | 70 | 0.200 | 3 | 0.130 | 8000 | 12.5 | o |
| 58 Example | A | 60 | III | 2 | 200 | 70 | 0.250 | 3 | 0.130 | 8000 | 12.5 | o |
| 59 Example | A | 60 | III | 2 | 200 | 70 | 0.300 | 3 | 0.130 | 8000 | 12.5 | o |
| 60 Example | A | 60 | III | 2 | 200 | 70 | 0.500 | 3 | 0.130 | 7000 | 12.5 | o |
| 61 Example | A | 60 | III | 2 | 200 | 70 | 0.700 | 3 | 0.135 | 6000 | 12.5 | o |
| 62 Example | A | 60 | III | 2 | 200 | 70 | 0.900 | 3 | 0.140 | 5000 | 12.5 | o |
| 63 Example | A | 60 | III | 2 | 200 | 70 | 0.920 | 3 | 0.140 | 4000 | 12.5 | o |
| 64 Comparative Example | A | 60 | III | 2 | 200 | 70 | 1 | 3 | 0.140 | 3000 | 12.5 | o |

TABLE 26

| | Lower Layer | | Fe—Ni—O Film | | | | | | Press- | Spot Weldability | Adhesion | |
|---|---|---|---|---|---|---|---|---|---|---|---|---|
| | Type | Coating Weight ($g/m^2$) | Forming Method | | Coating Weight ($mg/m^2$) | Rate of Coating (%) | Fe/ (Fe + Ni) | Oxygen Content (%) | Formability Friction Coefficient | Number of Continuous Welding Spots | Peel Strength (kgf/25 mm) | Chemical Treatability |
| 65 Comparative Example | A | 60 | III | 2 | 200 | 70 | 0.2 | 0 | 0.155 | 8000 | 8.0 | o |
| 66 Example | A | 60 | III | 2 | 200 | 70 | 0.2 | 0.4 | 0.145 | 8000 | 11.0 | o |
| 67 Example | A | 60 | III | 2 | 200 | 70 | 0.2 | 0.5 | 0.130 | 8000 | 12.0 | o |
| 68 Example | A | 60 | III | 2 | 200 | 70 | 0.2 | 1 | 0.130 | 8000 | 12.5 | o |
| 69 Example | A | 60 | III | 2 | 200 | 70 | 0.2 | 5 | 0.125 | 8000 | 12.5 | o |
| 70 Example | A | 60 | III | 2 | 200 | 70 | 0.2 | 7 | 0.125 | 8000 | 12.5 | o |

TABLE 26-continued

| | Lower Layer | | Fe—Ni—O Film | | | | | | Press- | Spot Weldability | Adhesion | |
|---|---|---|---|---|---|---|---|---|---|---|---|---|
| | Type | Coating Weight ($g/m^2$) | Forming Method | | Coating Weight ($mg/m^2$) | Rate of Coating (%) | Fe/ (Fe + Ni) | Oxygen Content (%) | Formability Friction Coefficient | Number of Continuous Welding Spots | Peel Strength (kgf/25 mm) | Chemical Treatability |
| 71 Example | A | 60 | III | 2 | 200 | 70 | 0.2 | 10 | 0.125 | 8000 | 12.5 | o |
| 72 Example | A | 60 | III | 2 | 200 | 70 | 0.2 | 11 | 0.125 | 8000 | 12.5 | Δ |

The coating weight, the ratio of coating, the Fe ratio and the oxygen content of the Fe—Ni—O film were measured by the following methods.

[Measurement of the coating weight and the ratio Fe/(Fe+Ni) of the film]

In specimens of the dip-plated steel, electroplated steel, Zn—Cr alloy electroplated steel, and Zn—Al alloy dip-plated steel, which are denoted by symbols B, C, F and G, respectively, the Fe—Ni—O film was peeled together with the surface layer of the lower plating layer (representing the Zn-based plating layer hereinafter) by dissolving in diluted hydrochloric acid, and the coating weight and composition of the Fe—Ni—O film were measured by ICP quantitative analysis of Fe, Ni and metals. The ratio Fe/(Fe+Ni) of the film was calculated.

In specimens of the alloyed zinc dip-plating steel, Zn—Fe alloy electroplated steel, and Zn—Ni alloy electroplated steel, which are denoted by symbols A, D, and E, respectively, since the lower plating layer contained the same component elements as those in the Fe—Ni—O film, the component elements of the upper Fe—Ni—O film could not be easily completely separated from the components elements of the lower plating layer by the ICP method, only the elements of the Fe—Ni—O film, which are not contained in the lower plating layer, were thus quantitatively analyzed by the ICP method. After Ar ion sputtering, the component elements of the Fe—Ni—O film was then repeatedly measured from the surface by the XPS method to measure the composition distribution of each of the component elements in the direction of the depth of the plating layer. In this measurement, the distance between the surface and the center between a depth where the element of the Fe—Ni—O film, which was not contained in the lower plating layer, showed the maximum content, and a depth where that element was not detected, was considered as the thickness of the Fe—Ni—O film. The coating weight and the composition of the Fe—Ni—O film were calculated from the results of the ICP method and the XPS method. The ratio Fe/(Fe+Ni) of the film was then calculated.

[Measurement of ratio of coating]

The ratio of coating of the Fe—Ni—O film distributed in an island-like and mosaic form was measured by the following method.

Mapping analysis of the surface having the Fe—Ni—O film formed thereon was performed by an AES analysis (Auger electron spectroscopy) or EPMA analysis to measure distribution states of Ni, Fe and O on the surface. Points exhibiting an intensity showing a coating weight of the Fe—Ni—O film of 10 $mg/m^2$ or more in terms of the total weight of the metal elements was considered as coated points, and the ratio of coating was calculated by determining the ratio of the coated points to the total measurement points.

[Measurement of oxygen content of film]

The oxygen content of the film was determined from the results of AES analysis in the direction of the depth thereof.

Specimens (Nos. 1 to 72) of the examples and the comparative examples were evaluated in the press formability, the spot weldability and chemical treatability, specimen Nos. 1 to 48 were further evaluated in the adhesiveness between the chemically treated film and the zinciferous plating layer itself, and specimen Nos. 49 to 72 were further evaluated in adhesion to an adhesive.

[Adhesion test of conversion-treated film]

A specimen was treated with a dip-type zinc phosphate treating agent for undercoating an automobile, followed by ED coating with a thickness of 20 $\mu$m.

Figure 13:
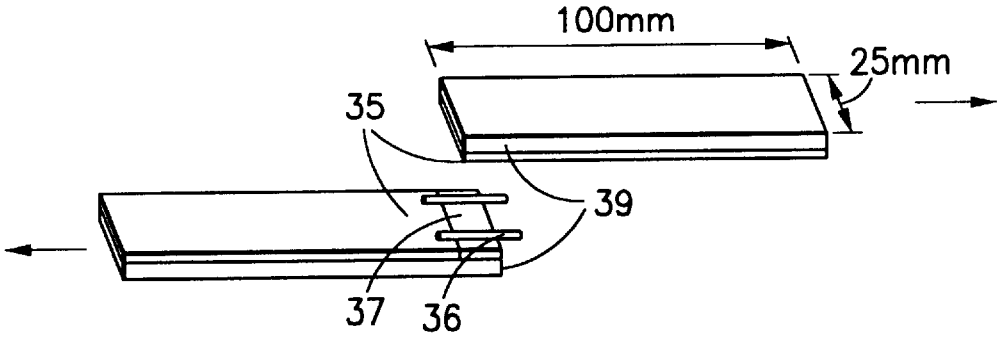
FIG. 13 is a schematic perspective view illustrating the method of evaluating the adhesiveness between a chemically treated film and a zinciferous plating layer itself, which is a characteristic of a zinciferous plated steel sheet of the present invention.

As shown in FIG. 13, two specimens 35 having a the size of 100×25 mm were bonded with an adhesive agent 37 having a thickness of 0.15 and a bonding area of 25×10 mm, and spacers 16 of 0.15 mm therebetween to prepare a test specimen, followed by baking at 170° C. for 30 minutes. An epoxy adhesive agent for structures was used as the adhesive agent. Although various steel sheets having a thickness of 0.8 mm were used as specimens, since some materials have the possibility of causing breakage of a base material due to low strength during a tensile test, a steel sheet having a thickness of 2 mm was used as an reinforcing plate 39 for a specimen to form a test specimen. Thus-formed test specimen was pulled at a ratio of 200 mm/min by using a tensile machine to measure the average peeloff strength at the time of peeling, and the peeled surface was observed by a scanning electron microscope (SEM).

Peeling occurs at a position with lowest strength. In the use of GA (symbol A), peeling occurs at the interface between the GA deposit and the steel sheet, and peeloff strength represents the interface peeloff strength between the GA film and the steel sheet. In the use of each of GI (symbol B), EG (symbol C), Zn—Fe (symbol D), Zn—Ni (symbol E), Zn—Cr (symbol F) and Zn—Al (symbol G), aggregation in the adhesive is broken, and thus peeloff strength represents the strength of the adhesive itself.

If the film of the present invention covers the entire zinciferous plating layer, the adhesion between the chemically treated film and the zinciferous plating layer itself is not ensured, thereby decreasing the peeloff strength. The peeloff strength in the same level as an untreated specimen is shown by ○, and the peeloff strength lower than the untreated specimen is shown by X.

The test results of each of the test specimens measured by the above described measurements are shown in Tables 22 to 26. These tables reveal the following results.

The examples within the range of the present invention have low friction coefficients and good press formability. Particularly, in the present invention, since the Fe—Ni—O film has an island-like or mosaic distribution, if the coating weight and other conditions are considered as the same, as the ratio of coating on the surface of the plating layer increases, the friction coefficient decreases, and thus the film more contributes to improvement in the press formability.

In all the examples, the results of continuous spot welding test for the spot weldability are 5000 spots or more and are thus very good.

In the examples, the crystal of the zinc phosphate coating is normally formed, and thus the chemical treatability are good.

In regard to the adhesion between the chemically treated film and the zinciferous plating layer, when the Fe—Ni—O film covers the entire zinciferous plating layer, the adhesive force between the chemically treated film and the zinciferous plating layer is not secured, thereby decreasing peeloff strength. In Comparative Example No. 17 in which the rate of coating by the Fe—Ni—O film is 100%, the adhesion is not secured. However, in all examples, the adhesion is secured.

In most of the examples, the peeloff strength is 12 kgf/25 mm or more and thus good.

The comparative examples beyond the range of the present invention are poor in any one of the friction coefficient, the continuous spot weldability, adhesiveness and the chemical treatability.

In the present invention constructed as described above, since the Fe—Ni—O film formed on the surface of the plating layer a zinciferous plated steel sheet has improved performance, higher hardness and melting point than those of a zinc or zinc alloy plating layer, and an island-like or mosaic distribution, in press forming, the sliding resistance between the surface of the plating layer and a press die is significantly decreased, and the zinciferous plated steel sheet can easily be flowed into the press die, thereby improving the press formability. The continuous spot weldability in spot welding are also improved due to the presence of the Fe—Ni—O film having a high melting point. The presence of the Fe oxide in the Fe—Ni—O film further increases the peeloff strength of an adhesive plate and thus improves adhesiveness. The chemical treatability are also more improved due to the above characteristics as well as the island-like or mosaic distribution of the film. The present invention thus has the very advantageous industrial effect of providing a zinciferous plated steel sheet having excellent press formability, spot weldability, adhesiveness and chemical treatability.

EMBODIMENT 6

First, a method for producing a zinciferous plated steel sheet is characterized in that the zinciferous plated steel sheet is subjected to temper rolling within the range of elongation rate of 0.3 to 5.0%, alkali treatment is carried out for the zinciferous plated steel sheet in an alkaline solution having pH of 10 or more for the period of 2 to 30 seconds, and subsequently a Fe—Ni—O film is formed on the surface of a plating layer of the zinciferous plated steel sheet for which the alkali treatment is carried out.

Secondly, a method for producing a zinciferous plated steel sheet is characterized in that alkali treatment is carried out for the zinciferous plated steel sheet in an aqueous solution having pH of 10 or more within the period of 2 to 30 seconds, the zinciferous plated steel sheet for which alkali treatment is carried out in that way is subjected to temper rolling within the range of 0.3 to 5.0%, and subsequently, a Fe—Ni—O film is formed on the surface of a plating layer of the zinciferous plated steel sheet thus subjected to the temper rolling.

A method for forming the Fe—Ni—O film can be performed by treating the zinciferous plated steel sheet in an aqueous solution having the range of pH of 2.0 to 3.5 at a temperature of 20° to 70° C., the aqueous solution containing $FeCl_2$ and $NiCll_2$.

The formation of the Fe—Ni—O film is conducted by treating the zinciferous plated steel sheet in an aqueous solution having of pH of 2.0 to 3.5 at a temperature of 20° to 70° C., the aqueous solution containing $FeCl_2$ and $NiCl_2$ and a content ratio of a sum of Fe content (wt. %) and Ni content (wt. %) to the Fe content (wt. %) being within the range of 0.004 to 0.9.

In this patent application, it is to be noted that in the case that a Fe—Ni—O film formed on the surface of the plating layer of the zinciferous plated steel sheet to serve as an upper layer is referred to, it is called "film", and in the case that a zinciferous plating layer serving as a lower layer is referred to, it is called "plating layer" but it is not called "film".

The reasons why production conditions of the invention are defined as mentioned above are described below.

In the invention, the reason why the zinciferous plated steel sheet is treated in the alkaline solution having pH of 10 or more for the period of 2 to 30 seconds and thereafter the Fe—Ni—O film is formed on the surface of the zinciferous plated steel sheet consists in that the case that the zinciferous plated steel sheet is treated in the alkaline solution is remarkably superior in press formability in comparison with the case that the Fe—Ni—O film is formed without any treatment of the zinciferous plated steel sheet in the alkaline solution. In addition, the foregoing reason consists in that the zinciferous plated steel sheet having adhesiveness improved and exhibiting excellent press formability can be obtained, because when the Fe—Ni—O film is formed after it is subjected to temper rolling within the range of elongation ratio of 0.3% to 0.5% before or after it is treated in the alkaline solution, the surface of the zinciferous plated steel sheet is flattened by the temper rolling and the oxide film worsening the adhesiveness of the Fe—Ni—O film is removed.

Figure 14:
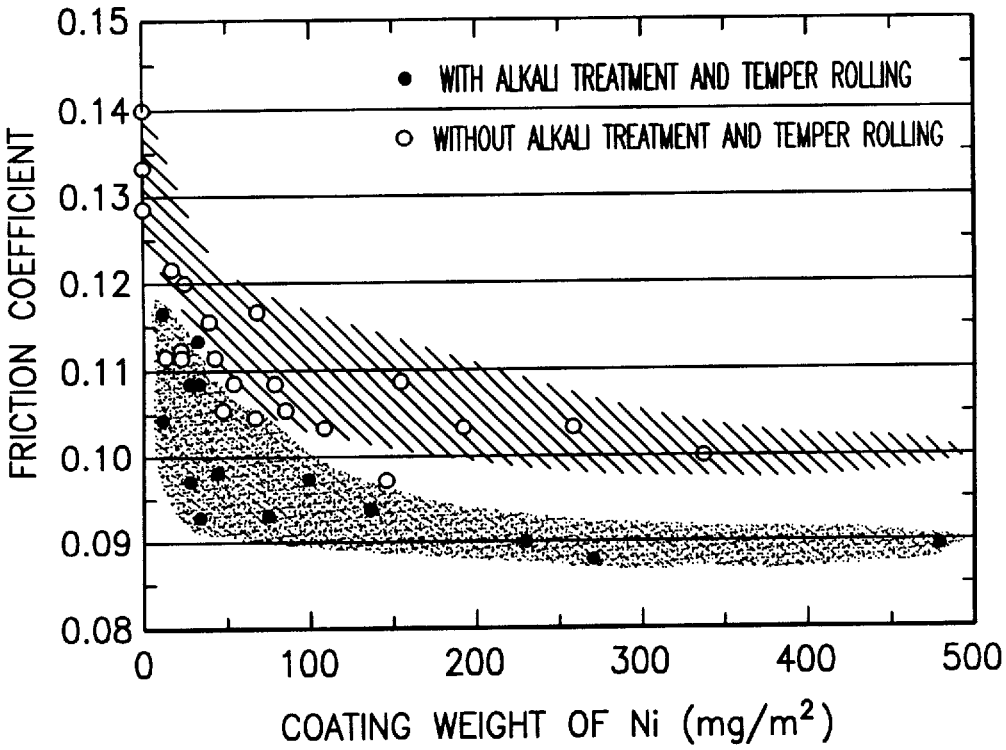
FIG. 14 is a graph which shows by way of example the relationship between a coating weight of Ni to a zinciferous plated steel sheet and frictional coefficient in the case that alkali solution treatment and temper rolling are performed for the steel sheet as well as the case that the foregoing treatments are not performed.

FIG. 14 is a graph which shows the relationship between a coating weight of Ni to the surface of the plating layer of the zinciferous plated steel sheet with respect to the case that alkaline solution treatment and temper rolling are conducted as well as the case that no treatment is conducted. It is found from the graph that in the case that alkaline solution treatment and temper rolling are conducted, a value of frictional coefficient becomes small with a same coating weight of nickel compared with the case that no treatment is conducted. Here, the aqueous solution containing one kind or two and more kinds of alkaline chemicals such as NaOH, KOH, $Na_2SO_4$, LiOH, $Na_2SO_4$, MgOH or the like can be used as an alkaline solution. It is necessary that an alkali concentration of the aqueous solution has pH of 10 or more and it is more desirous that the alkaline solution is prepared so that the alkaline concentration has pH of 11 and more. In this case, it is generally acceptable that the alkaline solution has a concentration ranging from 5 to 50 g/l.

On the contrary, in the case that the Fe—Ni—O film is formed after the zinciferous plated steel sheet is treated in an acid solution, some improvement of press formability is recognized but press formability, spot weldability and adhesiveness are inferior compared with the case that the zinc based sheets steel sheet is treated in the alkaline solution. This is attributable to the fact that the adhesiveness of the Fe—Ni—O film are improved by treating the zinciferous plated steel sheet in the alkaline solution, and it is appreciated that the foregoing effect can not be obtained when the zinciferous plated steel sheet is treated in the acid solution because a quantity of oxide film unavoidably formed on the surface of the zinciferous plated steel sheet is increased with the acid solution.

Here, the Fe—Ni—O film is a mixture of Fe metal, Fe oxide, Ni metal and Ni oxide, and a method of forming the film is not especially defined to certain one. It is acceptable that it is treated in an aqueous solution containing Fe ion, Ni ion and an oxidizing agent, and an aqueous solution dipping method, an aqueous solution spraying method, a coating method, an electroplating method or the like are employable. In addition, a vapor phase plating method such as a laser CVD, an optical CVD, a vacuum deposition, a spattering deposition or the like can be employed.

A plus ion, hydroxide and oxide of Zn, Co, Mn, Mo, Al, Ti, Sn, W, Si, Pb, Nb, Ta or the like unavoidably contained in the plating layer for the zinciferous plated steel sheet used for carrying out the present invention are contained in the aqueous solution for forming the film. In addition, a minus ion may be contained in the plating layer.

Additionally, to elevate the properties of alkali treatment for the zinciferous plated steel sheet, a surface active agent may additionally be contained in the alkaline solution. However, when an oxidizing agent is added to the alkaline solution, an oxide is formed on the surface of the zinciferous plated steel sheet, causing the adhesiveness of the Fe—Ni—O film to be degraded. For this reason, it is not desirable that the surface active agent is additionally contained in that way.

Temper rolling and alkali treatment can be conducted regardless of an order of both the treatments before Fe—Ni—O film forming treatment with same effect, provided that a factor of obstructing a coating weight of the Fe—Ni—O film is removed. Therefore, the foregoing order of both the treatments for removing the obstructing factor may adequately selected depending on the kind of the zinciferous plated steel sheet. With respect to the elongation ratio for the temper rolling, it is sufficient that the factor for obstructing the adhesiveness of Fe—Ni—O film is removed. To this end, it is acceptable that the elongation ratio ranges from 0.3% to 5.0%. When same elongation ratio is applied, a larger compression load provides a larger effect with the same elongation ratio. When the elongation ratio is less than 0.3%, the flattening effect is small, resulting in the satisfactory press formability failing to be obtained. On the other hand, when the elongation ratio exceeds 5.0%, the material is undesirably degraded. The reason why the aqueous solution containing $FeCl_2$ and $NiCl_2$ therein used for forming the Fe—Ni—O film with the method consists in that a high precipitation efficiency is obtained when metal salt of chloride is used to provide secondary iron ion and nickel ion, resulting in productivity of the method being improved. In the case of same salt concentration and same treatment time, a coating weight of Ni and Fe is increased in comparison with that of nitrate and sulfate.

Figure 15:
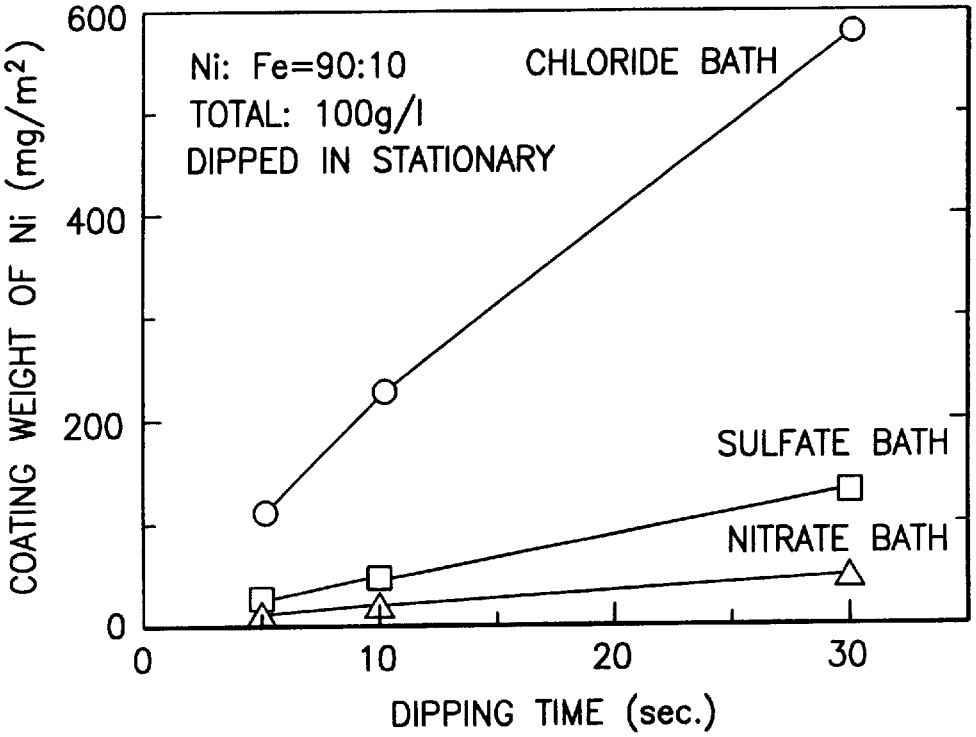
FIG. 15 is a graph which shows the difference in coating weight of Ni to the zinciferous plated steel sheet in the case that it is dipped in a chloride bath, a sulfate bath and a nitrite bath serving as a treatment liquid for Fe—Ni—O film.

FIG. 15 is a graph which shows the relationship between the kind of treatment bath for forming the Fe—Ni—O film and a coating weight. The graph shows the case that a concentration ratio of Ni to Fe in the treatment bath is 90:10 and a sum of concentrations in the stationary bath is 100 g/l. It is found from the graph that a chloride bath exhibits a high efficiency compared with a sulfate bath and a nitride bath.

It is desirable that pH of the aqueous solution for forming the film ranges from 2.0 to 3.5. The reasons for this are described below.

When pH is less than 2.0, a quantity of generation of hydrogen from the cathode is excessively increased, a precipitation efficiency is lowered and a coating weight of Ni and Fe becomes small with same salt concentration and same treatment time, resulting in productivity of the method being lowered. In addition, the film is mainly composed of metals of Ni and Fe, and improvement effect of press formability, spot weldability and adhesiveness can not be achieved. On the other hand, when pH exceeds 3.5, Fe in the aqueous solution is intensely oxidized, and flaw on the surface of the steel sheet appears in the presence of sludge.

Figure 16:
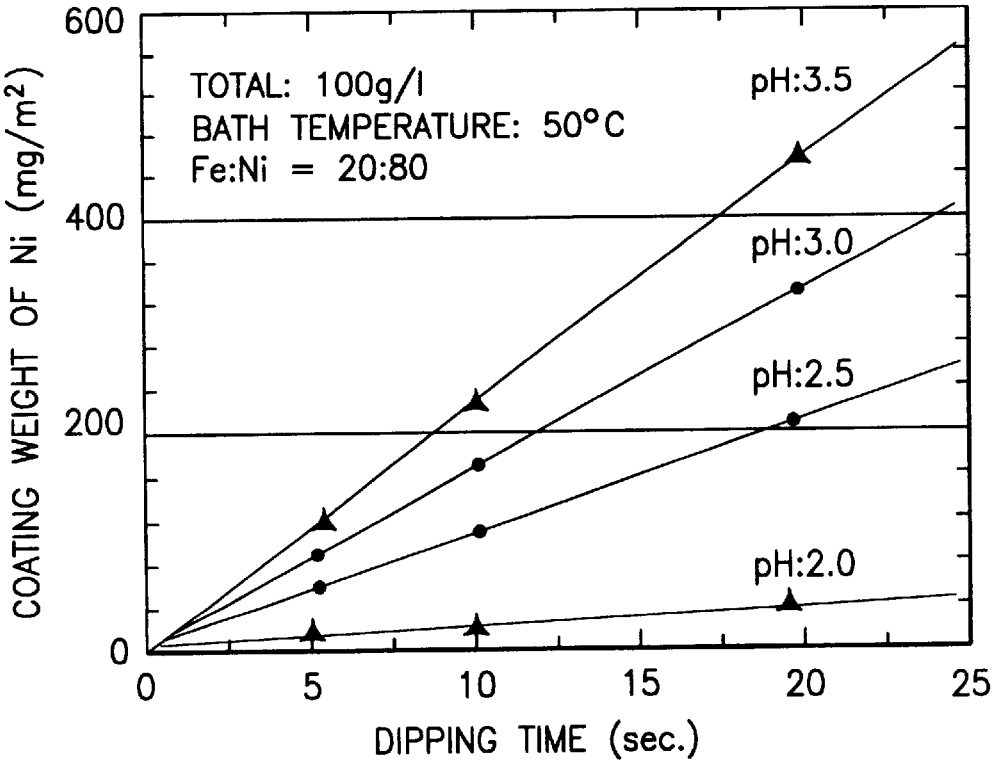
FIG. 16 is a graph which shows by way of example a coating weight of Ni to the zinciferous plated steel sheet relative to the dipping time in the case that pH is changed.

FIG. 16 is a graph which shows by way of example a coating weight of Ni to the dipping time in the case that pH is changed from 2.0 to 3.5. The graph shows the case that the treatment bath has a temperature of 50° C., the concentration ratio of Ni to Fe in the treatment bath is 20:80, and a sum of concentrations is 100 g/l, and it is found from the graph that the precipitation efficiency is acceptable as pH is increased.

It is desirable that the temperature of the aqueous solution for forming the film ranges from 20° C. to 70° C. The reasons for this are described as follows.

When the temperature of the aqueous solution is lower than 20° C., the reaction speed becomes slow and a long time is required to maintain a coating weight of Ni and Fe necessary for improving the properties of the film. On the other hand, when the temperature of the aqueous exceeds 70° C., deterioration of the properties of the aqueous solution is accelerated and facilities and thermal energy for maintaining them at a high temperature are required, resulting in the production cost being elevated.

The reason why a ratio of a sum of Fe content (wt. %) and Ni content (wt. %) to the Fe content (wt. %) in an aqueous solution serving as a solution for forming Fe—Ni—O film (hereinafter represented by Fe ratio: Fe/(Fe+Ni)) is defined within the range of 0.004 to 0.9 consists in that when the Fe ratio is less than 0.004, the adhesiveness can not be improved and when it exceeds 0.9, the properties of spot weldability can be improved to small extent.

A steel sheet having a zinciferous plating layer formed thereon by employing a zinc dip-plating method, an electroplating method, a vapor plating method or the like is acceptable as a zinciferous plated steel sheet which can be used for carrying out the present invention. The composition of the plating layer on the surface of the zinciferous plated steel sheet may be composed of a metal such as Fe, Ni, Co, Mn, Cr, Al, Mo, Ti, Si, W, Sn, Pb, Nb and Ta (in this case, Si is handled as metal) in addition to pure zinc or oxide or one kind or two and more kinds of organic material in the form of plating layer of single or plural layers. In addition, fine particles of $SiO_2$ and $Al_2O_3$ may be contained in the plating layer. Further, a plural layer plated steel sheet having a composition of a plating layer changed and a function inclined plated steel sheet can be used as a zinciferous plated steel sheet.

A phenomenon of adhesion between the steel sheet and the forming die at the time of press forming disappears in the presence of Fe—Ni—O film formed on the surface of the plating layer of the zinciferous plated steel sheet under the foregoing limiting conditions, causing slidable resistance to be reduced. Thus, sliding receipt of the steel sheet in the forming die is improved and formation of brittle alloy layer between copper electrodes at the time of spot welding is suppressed with the result that continuous spot-weldability are improved, and moreover, adhesiveness are improved by the function of the film containing Fe therein.

EXAMPLES

Predetermined zinciferous plated steel sheets were produced on the basis of the examples which represent the method defined within the scope of the present invention as well as the comparative examples which represent the method defined outside of the scope of the present invention, using zinciferous plated steel sheets which are plated on cold rolled thin steel sheets by employing conventional method. The kind of plating of the zinciferous plated steel sheet was selected from the group represented by the following characters A, B, C, D, E, F and G.

A: Alloyed zinc dip-plating layers of alloy composed of 10 wt. % Fe and balance of Zn are formed and a coating weight of the alloy to both of the surfaces is defined to 60 g/m$^2$.

B: Zinc dip-plating players are formed and a coating weight to both of the surfaces is defined to 90 g/m$^2$.

C: Zinc Electroplating layers are formed and a coating weight of the alloy to both of the surfaces is defined to 40 g/m$^2$.

D: Zinc Electroplating layers of 15 wt. % of Fe and balance of Zn are formed and a coating weight of the alloy to both of the surfaces is defined to 40 g/m$^2$.

E: Alloy Electroplating layers of 12 wt % Ni and balance of Zn are formed and a coating weight of the alloy to both of the surfaces is defined to 30 g/m$^2$.

F: Alloy Electroplating layers of 4 wt. % Cr and balance of Zn are formed and a coating weight of the alloy to both of the surfaces is defined to 20 g/m$^2$.

G: Alloy dip-plating layer of 5 wt. % Al and balance of Zn are formed and a coating weight of the alloy to both of the surfaces is defined to 60 g/m$^2$.

The zinciferous plated steel sheets produced by employing the methods of examples and comparative examples were evaluated during the following tests 1 and 2 with respect to press formability, spot weldability, adhesiveness, chemical treatability and mechanical properties of the zinciferous plated steel sheet.

Next, examples and comparative example are described with respect to tables 1 to 3. An outline of the content of each test is shown in Table 27.

TABLE 27

| | | Temper Rolling | | Alkali Treatment | | | | | Formation of Fe—Ni—O Film | | | | | | |
|---|---|---|---|---|---|---|---|---|---|---|---|---|---|---|---|
| | | | | | | | | | | | Aqueous Solution | | | | |
| | Kind of Plating | Elongation Rate (%) | Time of Execution of Treatment Before or After Alkali Treatment | Solution Component | Solution pH | Method of Treatment | Temperature (°C.) | Time (s) | Presence or Absence of Film | Method of Formation | $FeCl_2$ + $NiCl_2$ (wt. %) | pH | Temperature | Treatment Time | Fe / Fe + Ni |
| Test 1 | | | | | | | | | | | | | | | |
| 1 of Test 1 | A | 0.7 | Before and After | NaOH | 9.5~14.0 | Dipping | 50 | 5 | Presence & Absence | Dipping | — | — | — | — | — |
| 2 of Test 1 | A | 0.2~5.5 | Before and After | NaOH | 12.0 | Dipping | 50 | 5 | Presence | Dipping | — | — | — | — | — |
| 3 of Test 1 | A | 0.7 | Before | Various Kind | 12.0 & 2.0 | Dipping and Spraying | 50 | 5 | Presence | Dipping and Various Kind | — | — | — | — | — |
| Test 2 | B~G | 0 & 0.7 | Before | NaOH | 12.0 | | 50 | 5 | Presence & Absence | Dipping | — | — | — | — | — |
| Test 3 | A | 0.7 | Before and After | NaOH | 12.0 | | 50 | 5 | Presence | Dipping | 200 | 2.5 | 50 | 5 | 0~1 |

[Test 1]

(1 OF TEST 1)

As shown in Table 28 representing test conditions, zinciferous plated steel sheets of which kind of plating is identified by marks A are subjected to constant temper rolling at an elongation ratio of 0.7% before or after alkali treatment, they are subjected to preliminary treatment by dipping them in an aqueous solution of NaOH having pH ranging from 9.5 to 14.0 at a temperature of 50° C., and subsequently, on completion of the preliminary treatment, Fe—Ni—O film is formed on the surface of each zinciferous plated steel sheet by dipping it in an aqueous solution containing $FeCl_2$ and $NiCl_2$. In addition, the case that alkali treatment is not conducted and Fe—Ni—O film is not formed, the case that preliminary treatment is conducted but Fe—Ni—O film is not formed and the case that Fe—Ni—O film is formed without any alkali treatment conducted are shown as comparative examples.

TABLE 28

| No. | Kind of Plating | Conditions for Temper Rolling: Elongation Rate % | Conditions for Temper Rolling: Before or After Alkali Treatment | Conditions for Alkali Treatment: Solution Component | Conditions for Alkali Treatment: Solution pH | Conditions for Alkali Treatment: Method of Treatment | Conditions for Alkali Treatment: Temperature (°C.) | Conditions for Alkali Treatment: Time (s) | Fe—Ni—O film: Presence or Absence of Film | Fe—Ni—O film: Method of Film Formation | Test Sample |
|---|---|---|---|---|---|---|---|---|---|---|---|
| 1 | A | 0.7 | — | — | — | — | — | — | X | — | Comparative Example |
| 2 | A | 0.7 | Before | NaOH | 12.0 | Dipping | 50 | 5 | X | — | Comparative Example |
| 3 | A | 0.7 | — | — | — | — | — | — | O | Dipping | Comparative Example |
| 4 | A | 0.7 | Before | NaOH | 9.5 | Dipping | 50 | 5 | O | Dipping | Comparative Example |
| 5 | A | 0.7 | Before | NaOH | 10.5 | Dipping | 50 | 5 | O | Dipping | Embodiment Example |
| 6 | A | 0.7 | After | NaOH | 10.5 | Dipping | 50 | 5 | O | Dipping | Embodiment Example |
| 7 | A | 0.7 | Before | NaOH | 11.0 | Dipping | 50 | 5 | O | Dipping | Embodiment Example |
| 8 | A | 0.7 | After | NaOH | 11.0 | Dipping | 50 | 5 | O | Dipping | Embodiment Example |
| 9 | A | 0.7 | Before | NaOH | 11.5 | Dipping | 50 | 5 | O | Dipping | Embodiment Example |
| 10 | A | 0.7 | After | NaOH | 11.5 | Dipping | 50 | 5 | O | Dipping | Embodiment Example |
| 11 | A | 0.7 | Before | NaOH | 13.0 | Dipping | 50 | 5 | O | Dipping | Embodiment Example |
| 12 | A | 0.7 | After | NaOH | 13.0 | Dipping | 50 | 5 | O | Dipping | Embodiment Example |
| 13 | A | 0.7 | Before | NaOH | 14.0 | Dipping | 50 | 5 | O | Dipping | Embodiment Example |
| 14 | A | 0.7 | After | NaOH | 14.0 | Dipping | 50 | 5 | O | Dipping | Embodiment Example |

Test results mentioned above are shown in Table 29. The following facts are found from the table.

(1) Test samples having no Fe—Ni—O film formed thereon are inferior in press formability, spot weldability, adhesiveness and chemical treatability (NO 1 and NO 2). Although Fe—Ni—O film is formed, test samples having pH less than 10 are slightly inferior in press formability (NO 3 and NO 4).

(2) In the embodiment examples, press formability, spot weldability, adhesiveness and chemical treatability are improved (NO 5 to NO 14). Press formability is largely improved when the solution for alkali treatment has a large value of pH. These advantageous effects do not vary regardless of an order of temper rolling and alkali treatment in the preliminary treatment.

TABLE 29

| No. | Frictional Coefficient | Spot Weldability Number of Continuous spot-welding runs | Adhesiveness Strength kg/25 mm | Chemical treatability | Test Sample |
|---|---|---|---|---|---|
| 1 | 0.150 | 2500 | 8.0 | = | Comparative Example |
| 2 | 0.145 | 2500 | 10.0 | = | Comparative Example |
| 3 | 0.125 | 5000 | 12.0 | O | Comparative Example |
| 4 | 0.125 | 5000 | 12.5 | O | Comparative Example |
| 5 | 0.120 | 5500 | 12.0 | O | Embodiment Example |
| 6 | 0.120 | 5500 | 12.0 | O | Embodiment Example |
| 7 | 0.115 | 5500 | 12.5 | O | Embodiment Example |
| 8 | 0.115 | 5500 | 12.5 | O | Embodiment Example |
| 9 | 0.110 | 5500 | 12.5 | O | Embodiment Example |
| 10 | 0.110 | 5500 | 12.5 | O | Embodiment |

TABLE 29-continued

| No. | Frictional Coefficient | Spot Weldability Number of Continuous spot-welding runs | Adhesiveness Strength kg/25 mm | Chemical treatability | Test Sample |
|---|---|---|---|---|---|
| 11 | 0.105 | 5500 | 12.5 | O | Example Embodiment Example |
| 12 | 0.105 | 5500 | 12.5 | O | Example Embodiment Example |
| 13 | 0.105 | 5500 | 12.5 | O | Example Embodiment Example |
| 14 | 0.105 | 5500 | 12.5 | O | Example Embodiment Example |

(2 OF TEST 1)

As shown in Table 4, test conditions are such that zinciferous plated steel sheets of which kind of plating is identified by marks A (representing alloyed zinc dip-plating) are subjected to temper rolling before or after alkali treatment at an elongation ratio of 5.5%, alkali treating is conducted by dipping them in an aqueous solution of NaOH having constant pH of 12.0 at a temperature of 50° C. for a period of time of 5 seconds, and subsequently, on completion of the preliminary treatment, Fe—Ni—O film is formed on the surface of each zinciferous plated steel sheet by dipping the latter in the aqueous solution containing $FeCl_2$ and $NiCl_2$.

Results of the tests mentioned above are shown in Table 31. The following facts are found from this table.

(1) When temper rolling of the preliminary treatment is conducted at an elongation ratio less than 0.3%, properties of press formability are insufficiently improved, although Fe—Ni—O film is formed on the surface of each zinciferous plated steel sheet (NO 15 to NO 18). When the elongation ratio exceeds 5.0%, each zinciferous plated steel sheet is superior in press formability, spot weldability, adhesiveness and chemical treatability but mechanical properties of the zinciferous plated steel sheet are inferior (NO 29 and NO 30).

TABLE 30

| | | Conditions for Temper Rolling | | Conditions for Alkali Treatment | | | | | Fe—Ni—O film | | |
|---|---|---|---|---|---|---|---|---|---|---|---|
| | | | | Solution | | | | | | | |
| No. | Kind of Plating | Elongation Rate % | Before or After Alkali Treatment | Component | pH | Method of Treatment | Temperature (°C.) | Time (s) | Presence or Absence of Film | Method of Film Formation | Test Sample |
| 15 | A | 0.0 | Before | NaOH | 12.0 | Dipping | 50 | 5 | O | Dipping | Comparative Example |
| 17 | A | 0.2 | Before | NaOH | 12.0 | Dipping | 50 | 5 | O | Dipping | Comparative Example |
| 18 | A | 0.2 | After | NaOH | 12.0 | Dipping | 50 | 5 | O | Dipping | Comparative Example |
| 19 | A | 0.3 | Before | NaOH | 12.0 | Dipping | 50 | 5 | O | Dipping | Embodiment Example |
| 20 | A | 0.3 | After | NaOH | 12.0 | Dipping | 50 | 5 | O | Dipping | Embodiment Example |
| 21 | A | 0.7 | Before | NaOH | 12.0 | Dipping | 50 | 5 | O | Dipping | Embodiment Example |
| 22 | A | 0.7 | After | NaOH | 12.0 | Dipping | 50 | 5 | O | Dipping | Embodiment Example |
| 23 | A | 1.0 | Before | NaOH | 12.0 | Dipping | 50 | 5 | O | Dipping | Embodiment Example |
| 24 | A | 1.0 | After | NaOH | 12.0 | Dipping | 50 | 5 | O | Dipping | Embodiment Example |
| 25 | A | 3.0 | Before | NaOH | 12.0 | Dipping | 50 | 5 | O | Dipping | Embodiment Example |
| 26 | A | 3.0 | After | NaOH | 12.0 | Dipping | 50 | 5 | O | Dipping | Embodiment Example |
| 27 | A | 5.0 | Before | NaOH | 12.0 | Dipping | 50 | 5 | O | Dipping | Embodiment Example |
| 28 | A | 5.0 | After | NaOH | 12.0 | Dipping | 50 | 5 | O | Dipping | Embodiment Example |
| 29 | A | 5.5 | Before | NaOH | 12.0 | Dipping | 50 | 5 | O | Dipping | Comparative Example |
| 30 | A | 5.5 | After | NaOH | 12.0 | Dipping | 50 | 5 | O | Dipping | Comparative Example |

(Note) Test sample No. 16 is not shown in this Table (2) On the contrary, in the embodiment examples, press formability, spot weldability, properties of adhesiveness and properties of each zinciferous plated steel sheet are improved (NO 19 to NO 28). Press formability of the latter is largely improved when temper rolling is conducted at a large elongation ratio. These advantageous effects are not unchangeably obtained during preliminary treatment of the steel sheet regardless of an order of temper rolling and alkali treatment.

TABLE 31

| No. | Frictional Coefficient | Spot-Weldability Number of Continuous spot-welding runs | Adhesiveness Strength kg/25 mm | Properties of Formation Treatment | Remark | Test Sample |
|---|---|---|---|---|---|---|
| 15 | 0.130 | 5500 | 12.5 | O | — | Comparative Example |
| 17 | 0.125 | 5500 | 12.5 | O | — | Comparative Example |
| 18 | 0.125 | 5500 | 12.5 | O | — | Comparative Example |
| 19 | 0.120 | 5500 | 12.5 | O | — | Embodiment Example |
| 20 | 0.120 | 5500 | 12.5 | O | — | Embodiment Example |
| 21 | 0.110 | 5500 | 12.5 | O | — | Embodiment Example |
| 22 | 0.110 | 5500 | 12.5 | O | — | Embodiment Example |
| 23 | 0.105 | 5500 | 12.5 | O | — | Embodiment Example |
| 24 | 0.105 | 5500 | 12.5 | O | — | Embodiment Example |
| 25 | 0.100 | 5500 | 12.5 | O | — | Embodiment Example |
| 26 | 0.100 | 5500 | 12.5 | O | — | Embodiment Example |
| 27 | 0.09 | 5500 | 12.5 | O | — | Embodiment Example |
| 28 | 0.09 | 5500 | 12.5 | O | — | Embodiment Example |
| 29 | 0.09 | 5500 | 12.5 | O | Material Deteriorated | Comparative Example |
| 30 | 0.09 | 5500 | 12.5 | O | Material Deteriorated | Comparative Example |

(note) Test sample No. 16 is not shown in this Table (3 of TEST 1)

As shown in Table 32, test conditions are such that zinciferous plated steel sheets of which kind of plating is identified by marks A (representing alloyed zinc dip-plating) are subjected to temper rolling at a constant elongation ratio of 0.7%, alkali treatment is conducted by dipping them in an aqueous solution having constant pH of 12.0 (a part of them is dipped in an acid solution having pH of 20) at a temperature of 50° C. for a period of time of 5 seconds (the aqueous solution is sprayed to a part of them), and subsequently, on completion of the preliminary treatment, Fe—Ni—O film is formed on the surface of each zinciferous plated steel sheet by dipping the latter in the aqueous solution containing $FeCl_2$ and $NiCl_2$ (the aqueous solution is given to a part of the zinciferous plated steel sheets by spraying, electrolyzing or vapor depositing).

TABLE 32

| | | Conditions for Temper Rolling | | Conditions for Alkali Treatment | | | | | Fe—Ni—O film | | |
|---|---|---|---|---|---|---|---|---|---|---|---|
| | | | | Solution | | | | | | | |
| No. | Kind of Plating | Elongation Rate % | Before or After Alkali Treatment | Component | pH | Method of Treatment | Temperature (°C.) | Time (s) | Presence or Absence of Film | Method of Film Formation | Test Sample |
| 31 | A | 0.7 | Before | $H_2SO_4$ | 2.0 | Dipping | 50 | 5 | O | Dipping | Comparative Example |
| 32 | A | 0.7 | Before | HCl | 2.0 | Dipping | 50 | 5 | O | Dipping | Comparative Example |
| 33 | A | 0.7 | Before | NaOH | 12.0 | Spraying | 50 | 5 | O | Dipping | Embodiment Example |
| 34 | A | 0.7 | Before | KOH | 12.0 | Dipping | 50 | 5 | O | Dipping | Embodiment Example |
| 35 | A | 0.7 | Before | $Na_2SiO_4$ | 12.0 | Dipping | 50 | 5 | O | Dipping | Embodiment |

TABLE 32-continued

| No. | Kind of Plating | Conditions for Temper Rolling: Elongation Rate % | Conditions for Temper Rolling: Before or After Alkali Treatment | Conditions for Alkali Treatment: Solution Component | Conditions for Alkali Treatment: Solution pH | Conditions for Alkali Treatment: Method of Treatment | Conditions for Alkali Treatment: Temperature (°C.) | Conditions for Alkali Treatment: Time (s) | Fe—Ni—O film: Presence or Absence of Film | Fe—Ni—O film: Method of Film Formation | Test Sample |
|---|---|---|---|---|---|---|---|---|---|---|---|
| 36 | A | 0.7 | Before | $Mg(OH)_2$ | 12.0 | Dipping | 50 | 5 | O | Dipping | Example Embodiment Example |
| 37 | A | 0.7 | Before | LiOH | 12.0 | Dipping | 50 | 5 | O | Dipping | Example Embodiment Example |
| 38 | A | 0.7 | Before | $Na_2PO_4$ | 12.0 | Dipping | 50 | 5 | O | Dipping | Example Embodiment Example |
| 39 | A | 0.7 | Before | NaCH | 12.0 | Dipping | 50 | 5 | O | Spraying | Example Embodiment Example |
| 40 | A | 0.7 | Before | NaOH | 12.0 | Dipping | 50 | 5 | O | Electro-lyzing | Example Embodiment Example |
| 41 | A | 0.7 | Before | NaOH | 12.0 | Dipping | 50 | 5 | O | Vapor Deposit-ing | Example Embodiment Example |

Results of the tests mentioned above are shown in Table 33. The following facts are found from this table.

(1) When the preliminary treatment is conducted by using the acid aqueous solution containing acid components, properties of press formability is insufficiently improved (NO 31 and NO 32).

(2) On the contrary, in the examples, press formability, spot weldability and adhesiveness of each zinciferous plated steel sheet are improved (NO 33 to NO 41).

G. In the embodiment examples, temper rolling is conducted at an elongation ratio of 0.7% before alkali treatment, preliminary treatment is conducted by dipping each zinciferous plated steel sheet in an aqueous solution of NaON having pH of 12.0 at a temperature of 50° C. for a period of 5 seconds, and on completion of the preliminary treatment, Fe—Ni—O film is formed on the surface of zinciferous plated steel sheet by dipping it in an aqueous solution containing $FeCl_2$ and $NiCl_2$. In comparative examples, the

TABLE 33

| No. | Frictional Coefficient | Spot Weldability Number of Continuous spot-welding runs | Adhesiveness Strength kg/25 mm | Chemical treatability | Test Sample |
|---|---|---|---|---|---|
| 31 | 0.130 | 5000 | 12.5 | O | Comparative Example |
| 32 | 0.130 | 5000 | 12.5 | O | Comparative Example |
| 33 | 0.110 | 5500 | 12.5 | O | Embodiment Example |
| 34 | 0.110 | 5500 | 12.5 | O | Embodiment Example |
| 35 | 0.110 | 5500 | 12.5 | O | Embodiment Example |
| 36 | 0.110 | 5500 | 12.5 | O | Embodiment Example |
| 37 | 0.110 | 5500 | 12.5 | O | Embodiment Example |
| 38 | 0.110 | 5500 | 12.5 | O | Embodiment Example |
| 39 | 0.110 | 5500 | 12.5 | O | Embodiment Example |
| 40 | 0.110 | 5500 | 12.5 | O | Embodiment Example |
| 41 | 0.110 | 5500 | 12.5 | O | Embodiment Example |

[Test 2]

As shown in Table 34, testing conditions are such that each test is performed by using zinciferous plated steel sheets of which kind of plating is changed to B, C, D, F and case that all of temper rolling, alkali treatment and formation of Fe—Ni—O film are not conducted and the case that alkali treatment is conducted but temper rolling is not conducted and Fe—Ni—O film is formed are comparatively tested.

TABLE 34

| No. | Kind of Plating | Conditions for Temper Rolling: Elongation Rate % | Conditions for Temper Rolling: Before or After Alkali Treatment | Conditions for Alkali Treatment: Solution Component | Conditions for Alkali Treatment: Solution pH | Conditions for Alkali Treatment: Method of Treatment | Conditions for Alkali Treatment: Temperature (°C.) | Conditions for Alkali Treatment: Time (s) | Fe—Ni—O film: Presence or Absence of Film | Fe—Ni—O film: Method of Film Formation | Test Sample |
|---|---|---|---|---|---|---|---|---|---|---|---|
| 42 | B | 0.0 | — | — | — | — | — | — | X | — | Comparative Example |
| 43 | B | 0.0 | — | NaOH | 12.0 | Dipping | 50 | 5 | O | Dipping | Comparative Example |
| 44 | B | 0.7 | Before | NaOH | 12.0 | Dipping | 50 | 5 | O | Dipping | Embodiment Example |
| 45 | C | 0.0 | — | — | — | — | — | — | X | — | Comparative Example |
| 46 | C | 0.0 | — | NaOH | 12.0 | Dipping | 50 | 5 | O | Dipping | Comparative Example |
| 47 | C | 0.7 | Before | NaOH | 12.0 | Dipping | 50 | 5 | O | Dipping | Embodiment Example |
| 48 | D | 0.0 | — | — | — | — | — | — | X | — | Comparative Example |
| 49 | D | 0.0 | — | NaOH | 12.0 | Dipping | 50 | 5 | O | Dipping | Comparative Example |
| 50 | D | 0.7 | Before | NaOH | 12.0 | Dipping | 50 | 5 | O | Dipping | Embodiment Example |
| 51 | E | 0.0 | — | — | — | — | — | — | X | — | Comparative Example |
| 52 | E | 0.0 | — | NaOH | 12.0 | Dipping | 50 | 5 | O | Dipping | Comparative Example |
| 53 | E | 0.7 | Before | NaOH | 12.0 | Dipping | 50 | 5 | O | Dipping | Embodiment Example |
| 54 | F | 0.0 | — | — | — | — | — | — | X | — | Comparative Example |
| 55 | F | 0.0 | — | NaOH | 12.0 | Dipping | 50 | 5 | O | Dipping | Comparative Example |
| 56 | F | 0.7 | Before | NaOH | 12.0 | Dipping | 50 | 5 | O | Dipping | Embodiment Example |
| 57 | G | 0.0 | — | — | — | — | — | — | X | — | Comparative Example |
| 58 | G | 0.0 | — | NaOH | 12.0 | Dipping | 50 | 5 | O | Dipping | Comparative Example |
| 59 | G | 0.7 | Before | NaOH | 12.0 | Dipping | 50 | 5 | O | Dipping | Embodiment Example |

Results of the tests mentioned above are shown in Table 35. The following facts are found from this table.

(1) In the case that all of temper rolling, alkali treatment and formation of Fe—Ni—O film are not performed regardless of the kind of plating, press formability, spot weldability and adhesiveness of each zinciferous plated steel sheet are inferior (NO 42, NO 45, NO 48, NO 51, NO 54 and NO 57). In the case that only temper rolling is not performed among the conditions of the present invention, only press formability is improved to some extent because the Fe—Ni—O film is formed on the surface of the plated steel sheet but the improvement is not sufficient (NO 43, NO 46, NO. 49, NO 52, NO 55 and NO 58).

(2) On the contrary, in the embodiment examples, press formability, spot weldability and properties of adhesiveness are improved (NO 44, NO 47, NO 50, NO 53, NO. 56 and NO 59).

TABLE 35

| No. | Frictional Coefficient | Spot Weldability Number of Continuous spot-welding runs | Adhesiveness Strength kg/25 mm | Chemical treatability | Test Sample |
|---|---|---|---|---|---|
| 42 | 0.180 | 1500 | 5.0 | O | Comparative Example |
| 43 | 0.150 | 1500 | 6.0 | O | Comparative Example |
| 44 | 0.125 | 4000 | 12.5 | O | Embodiment Example |
| 45 | 0.180 | 2500 | 6.0 | O | Comparative Example |
| 46 | 0.150 | 250 | 7.0 | O | Comparative Example |

TABLE 35-continued

| No. | Frictional Coefficient | Spot Weldability Number of Continuous spot-welding runs | Adhesiveness Strength kg/25 mm | Chemical treatability | Test Sample |
|---|---|---|---|---|---|
| 47 | 0.125 | 5000 | 12.5 | O | Embodiment Example |
| 48 | 0.150 | 3000 | 8.0 | O | Comparative Example |
| 49 | 0.130 | 3000 | 10.0 | O | Comparative Example |
| 50 | 0.110 | 6000 | 12.5 | O | Embodiment Example |
| 51 | 0.150 | 8000 | 6.0 | O | Comparative Example |
| 52 | 0.130 | 8000 | 7.0 | O | Comparative Example |
| 53 | 0.110 | 10000 | 12.5 | O | Embodiment Example |
| 54 | 0.150 | 3000 | 6.0 | O | Comparative Example |
| 55 | 0.130 | 3000 | 7.0 | O | Comparative Example |
| 56 | 0.110 | 6000 | 12.5 | O | Embodiment Example |
| 57 | 0.180 | 1500 | 5.0 | O | Comparative Example |
| 58 | 0.150 | 1500 | 7.0 | O | Comparative Example |
| 59 | 0.125 | 4000 | 12.5 | O | Embodiment Example |

(TEST 3)

As shown on Table 10 and Table 11, test conditions are such that zinciferous plated steel sheets of which kind of plating is identified by marks A (representing alloyed zinc dip-plating) are subjected to temper rolling before or after alkali treatment at an elongation ratio of 0.7%, alkali treating is conducted by dipping them in an aqueous solution of NaOH having constant pH of 12.0 at a temperature of 50° C. for a period of time of 5 seconds, and subsequently, on completion of the preliminary treatment, Fe—Ni—O film is formed on the surface of each zinciferous plated steel sheet by dipping the latter in the aqueous solution containing $FeCl_2$ and $NiCl_2$. Here, the total concentration of $FeCl_2$ and $NiCl_2$ in the aqueous solution is set to a constant value of 200 g/l, and a ratio of a sum of Fe content (wt. %) and Ni content (wt. %) to the Fe content (wt. %) is variously changed within the range of 0 to 1 so that pH of the aqueous solution is set to 2.5 and a temperature of the aqueous solution is maintained at the temperature of 50° C.

TABLE 36

| | | Conditions for Temper Rolling | | Conditions for Alkali Treatment | | | | | | Aqueous Solution | | | | | | |
|---|---|---|---|---|---|---|---|---|---|---|---|---|---|---|---|---|
| No. | Kind of Plating | Elongation Rate (%) | Before or After Alkali Treatment | Solution Component | pH | Treatment Method | Temperature (°C.) | Time (s) | Fe—Ni—O Forming Method | $FeCl_2$ (g/l) | $NiCl_2$ (g/l) | pH | Temperature (°C.) | Dipping Time | Fe / Fe + Ni | Test Sample |
| 60 | A | 0.7 | Before | NaOH | 12.0 | Dipping | 50 | 5 | Dipping | 0.0 | 200.0 | 2.5 | 50 | 10 | 0 | Comparative Example |
| 61 | A | 0.7 | Before | NaOH | 12.0 | Dipping | 50 | 5 | Dipping | 0.7 | 199 | 2.5 | 50 | 10 | 0.0035 | Embodiment Example |
| 62 | A | 0.7 | Before | NaOH | 12.0 | Dipping | 50 | 5 | Dipping | 0.8 | 199 | 2.5 | 50 | 10 | 0.004 | Embodiment Example |
| 63 | A | 0.7 | Before | NaOH | 12.0 | Dipping | 50 | 5 | Dipping | 1.0 | 199 | 2.5 | 50 | 10 | 0.005 | Embodiment Example |
| 64 | A | 0.7 | Before | NaOH | 12.0 | Dipping | 50 | 5 | Dipping | 5.0 | 195 | 2.5 | 50 | 10 | 0.025 | Embodiment Example |
| 65 | A | 0.7 | Before | NaOH | 12.0 | Dipping | 50 | 5 | Dipping | 10.0 | 190 | 2.5 | 50 | 10 | 0.05 | Embodiment Example |
| 66 | A | 0.7 | Before | NaOH | 12.0 | Dipping | 50 | 5 | Dipping | 20.0 | 180 | 2.5 | 50 | 10 | 0.1 | Embodiment Example |
| 67 | A | 0.7 | Before | NaOH | 12.0 | Dipping | 50 | 5 | Dipping | 30.0 | 170 | 2.5 | 50 | 10 | 0.15 | Embodiment Example |
| 68 | A | 0.7 | Before | NaOH | 12.0 | Dipping | 50 | 5 | Dipping | 40.0 | 160 | 2.5 | 50 | 10 | 0.2 | Embodiment Example |
| 69 | A | 0.7 | Before | NaOH | 12.0 | Dipping | 50 | 5 | Dipping | 50.0 | 150 | 2.5 | 50 | 10 | 0.25 | Embodiment |

TABLE 36-continued

| | | Conditions for Temper Rolling | | Conditions for Alkali Treatment | | | | | | Aqueous Solution | | | | | | |
|---|---|---|---|---|---|---|---|---|---|---|---|---|---|---|---|---|
| | Kind of | Elong- | Before or After | Solution | | Treat- | Tem- pera- | | Fe—Ni—O | | | | Tem- pera- | Dip- | | |
| | Plat- | Rate | Alkali | Com- | | ment | ture | Time | Forming | $FeCl_2$ | $NiCl_2$ | | ture | ping | Fe | Test |
| No. | ing | (%) | Treatment | ponent | pH | Method | (°C.) | (s) | Method | (g/l) | (g/l) | pH | (°C.) | Time | Fe + Ni | Sample |
| 70 | A | 0.7 | Before | NaOH | 12.0 | Dipping | 50 | 5 | Dipping | 60.0 | 140 | 2.5 | 50 | 10 | 0.3 | Example Embodiment |
| 71 | A | 0.7 | Before | NaOH | 12.0 | Dipping | 50 | 5 | Dipping | 80.0 | 120 | 2.5 | 50 | 10 | 0.4 | Example Embodiment |
| 72 | A | 0.7 | Before | NaOH | 12.0 | Dipping | 50 | 5 | Dipping | 100.0 | 100 | 2.5 | 50 | 10 | 0.5 | Example Embodiment |
| 73 | A | 0.7 | Before | NaOH | 12.0 | Dipping | 50 | 5 | Dipping | 120.0 | 80 | 2.5 | 50 | 10 | 0.6 | Example Embodiment |
| 74 | A | 0.7 | Before | NaOH | 12.0 | Dipping | 50 | 5 | Dipping | 140.0 | 60 | 2.5 | 50 | 10 | 0.7 | Example Embodiment |
| 75 | A | 0.7 | Before | NaOH | 12.0 | Dipping | 50 | 5 | Dipping | 160.0 | 40 | 2.5 | 50 | 10 | 0.8 | Example Embodiment |
| 76 | A | 0.7 | Before | NaOH | 12.0 | Dipping | 50 | 5 | Dipping | 180.0 | 20 | 2.5 | 50 | 10 | 0.9 | Example Embodiment |
| 77 | A | 0.7 | Before | NaOH | 12.0 | Dipping | 50 | 5 | Dipping | 185.0 | 15 | 2.5 | 50 | 10 | 0.925 | Example Embodiment |
| 78 | A | 0.7 | Before | NaOH | 12.0 | Dipping | 50 | 5 | Dipping | 200.0 | 0 | 2.5 | 50 | 10 | 1 | Example Comparative Example |

TABLE 37

| | | Conditions for Temper Rolling | | Conditions for Alkali Treatment | | | | | | Aqueous Solution | | | | | | |
|---|---|---|---|---|---|---|---|---|---|---|---|---|---|---|---|---|
| | Kind of | Elong- | Before or After | Solution | | Treat- | Tem- pera- | | Fe—Ni—O | | | | Tem- pera- | Dip- | | |
| | Plat- | Rate | Alkali | Com- | | ment | ture | Time | Forming | $FeCl_2$ | $NiCl_2$ | | ture | ping | Fe | Test |
| No. | ing | (%) | Treatment | ponent | pH | Method | (°C.) | (s) | Method | (g/l) | (g/l) | pH | (°C.) | Time | Fe + Ni | Sample |
| 79 | A | 0.7 | After | NaOH | 12.0 | Dipping | 50 | 5 | Dipping | 0.0 | 200.0 | 2.5 | 50 | 10 | 0 | Comparative Example |
| 80 | A | 0.7 | After | NaOH | 12.0 | Dipping | 50 | 5 | Dipping | 0.7 | 199 | 2.5 | 50 | 10 | 0.0035 | Embodiment Example |
| 81 | A | 0.7 | After | NaOH | 12.0 | Dipping | 50 | 5 | Dipping | 0.8 | 199 | 2.5 | 50 | 10 | 0.004 | Embodiment Example |
| 82 | A | 0.7 | After | NaOH | 12.0 | Dipping | 50 | 5 | Dipping | 1.0 | 199 | 2.5 | 50 | 10 | 0.005 | Embodiment Example |
| 83 | A | 0.7 | After | NaOH | 12.0 | Dipping | 50 | 5 | Dipping | 5.0 | 195 | 2.5 | 50 | 10 | 0.025 | Embodiment Example |
| 84 | A | 0.7 | After | NaOH | 12.0 | Dipping | 50 | 5 | Dipping | 10.0 | 190 | 2.5 | 50 | 10 | 0.05 | Embodiment Example |
| 85 | A | 0.7 | After | NaOH | 12.0 | Dipping | 50 | 5 | Dipping | 20.0 | 180 | 2.5 | 50 | 10 | 0.1 | Embodiment Example |
| 86 | A | 0.7 | After | NaOH | 12.0 | Dipping | 50 | 5 | Dipping | 30.0 | 170 | 2.5 | 50 | 10 | 0.15 | Embodiment Example |
| 87 | A | 0.7 | After | NaOH | 12.0 | Dipping | 50 | 5 | Dipping | 40.0 | 160 | 2.5 | 50 | 10 | 0.2 | Embodiment Example |
| 88 | A | 0.7 | After | NaOH | 12.0 | Dipping | 50 | 5 | Dipping | 50.0 | 150 | 2.5 | 50 | 10 | 0.25 | Embodiment Example |
| 89 | A | 0.7 | After | NaOH | 12.0 | Dipping | 50 | 5 | Dipping | 60.0 | 140 | 2.5 | 50 | 10 | 0.3 | Embodiment Example |
| 90 | A | 0.7 | After | NaOH | 12.0 | Dipping | 50 | 5 | Dipping | 80.0 | 120 | 2.5 | 50 | 10 | 0.4 | Embodiment Example |
| 91 | A | 0.7 | After | NaOH | 12.0 | Dipping | 50 | 5 | Dipping | 100.0 | 100 | 2.5 | 50 | 10 | 0.5 | Embodiment Example |
| 92 | A | 0.7 | After | NaOH | 12.0 | Dipping | 50 | 5 | Dipping | 120.0 | 80 | 2.5 | 50 | 10 | 0.6 | Embodiment Example |
| 93 | A | 0.7 | After | NaOH | 12.0 | Dipping | 50 | 5 | Dipping | 140.0 | 60 | 2.5 | 50 | 10 | 0.7 | Embodiment Example |
| 94 | A | 0.7 | After | NaOH | *12.0 | Dipping | 50 | 5 | Dipping | 160.0 | 40 | 2.5 | 50 | 10 | 0.8 | Embodiment Example |
| 95 | A | 0.7 | After | NaOH | 12.0 | Dipping | 50 | 5 | Dipping | 180.0 | 20 | 2.5 | 50 | 10 | 0.9 | Embodiment Example |

TABLE 37-continued

| | | Conditions for Temper Rolling | | Conditions for Alkali Treatment | | | | | | Aqueous Solution | | | | | | |
|---|---|---|---|---|---|---|---|---|---|---|---|---|---|---|---|---|
| | Kind of | Elong-ation | Before or After | Solution | | Treat- | Tem-pera- | | Fe—Ni—O | | | | Tem-pera- | Dip- | | |
| | Plat- | Rate | Alkali | Com- | | ment | ture | Time | Forming | $FeCl_2$ | $NiCl_2$ | | ture | ping | Fe | Test |
| No. | ing | (%) | Treatment | ponent | pH | Method | (°C.) | (s) | Method | (g/l) | (g/l) | pH | (°C.) | Time | Fe + Ni | Sample |
| 96 | A | 0.7 | After | NaOH | 12.0 | Dipping | 50 | 5 | Dipping | 185.0 | 15 | 2.5 | 50 | 10 | 0.925 | Embodiment Example |
| 97 | A | 0.7 | After | NaOH | 12.0 | Dipping | 50 | 5 | Dipping | 200.0 | 0 | 2.5 | 50 | 10 | 1 | Comparative Example |

Results of tests mentioned above are shown in Table 38 and Table 39. The following facts are found from these tables.

(1) In the comparative examples, in the case that the ratio of Fe/(Fe+Ni) applicable to the aqueous solution for forming Fe—Ni—O film is set to 0 and thus Ni—O film is formed, press formability and properties of each zinciferous plated steel sheet are inferior (NO 60 and NO 79). On the other hand, in the case that Fe/(Fe+Ni) is set to 1 and thus the Fe—O film is formed, press formability and sot weldability are inferior (NO 78 and NO 97).

(2) On the contrary, in the examples, press formability, adhesiveness and chemical treatability are improved (NO 61 to NO 77 and NO 80 to NO 96). Especially, in the case that the ratio Fe/(Fe+Ni) is within the range of 0.04 to 0.9, the foregoing properties are largely improved. These advantageous effects are not changed regardless of an order of temper rolling and alkali treatment to be conducted in the preliminary treatment for the steel sheets (NO 78 and NO 97).

TABLE 38

| No. | Frictional Coefficient | Spot Weldability Number of Continuous Spot-welding runs | Adhesiveness Strength kg/25 mm | Chemical Treat-ability | Test Sample |
|---|---|---|---|---|---|
| 60 | 0.135 | 5500 | 6.0 | o | Comparative Example |
| 61 | 0.130 | 5500 | 10.0 | o | Embodiment Example |
| 62 | 0.120 | 5500 | 12.0 | o | Embodiment Example |
| 63 | 0.110 | 5500 | 12.5 | o | Embodiment Example |
| 64 | 0.110 | 5500 | 12.5 | o | Embodiment Example |
| 65 | 0.110 | 5500 | 12.5 | o | Embodiment Example |
| 66 | 0.110 | 5000 | 12.5 | o | Embodiment Example |
| 67 | 0.110 | 5000 | 12.5 | o | Embodiment Example |
| 68 | 0.110 | 5500 | 12.5 | o | Embodiment Example |
| 69 | 0.110 | 5500 | 12.5 | o | Embodiment Example |
| 70 | 0.110 | 5500 | 12.5 | o | Embodiment Example |
| 71 | 0.110 | 5500 | 12.5 | o | Embodiment Example |
| 72 | 0.110 | 5500 | 12.5 | o | Embodiment Example |
| 73 | 0.110 | 5500 | 12.5 | o | Embodiment Example |
| 74 | 0.110 | 5000 | 12.5 | o | Embodiment Example |
| 75 | 0.120 | 4500 | 12.5 | o | Embodiment Example |
| 76 | 0.120 | 4000 | 12.5 | o | Embodiment Example |
| 77 | 0.130 | 3000 | 12.5 | o | Embodiment Example |

TABLE 38-continued

| No. | Frictional Coefficient | Spot Weldability Number of Continuous Spot-welding runs | Adhesiveness Strength kg/25 mm | Chemical Treat-ability | Test Sample |
|---|---|---|---|---|---|
| 78 | 0.135 | 250a | 12.5 | o | Comparative Example |

TABLE 39

| No. | Frictional Coefficient | Spot Weldability Number of Continuous Spot-welding runs | Adhesiveness Strength kg/25 mm | Chemical Treat-ability | Test Sample |
|---|---|---|---|---|---|
| 79 | 0.135 | 5500 | 6.0 | o | Comparative Example |
| 80 | 0.130 | 5500 | 10.0 | o | Embodiment Example |
| 81 | 0.120 | 5500 | 12.0 | o | Embodiment Example |
| 82 | 0.110 | 5500 | 12.5 | o | Embodiment Example |
| 83 | 0.110 | 5500 | 12.5 | o | Embodiment Example |
| 84 | 0.110 | 5500 | 12.5 | o | Embodiment Example |
| 85 | 0.110 | 5000 | 12.5 | o | Embodiment Example |
| 86 | 0.110 | 5000 | 12.5 | o | Embodiment Example |
| 87 | 0.110 | 5500 | 12.5 | o | Embodiment Example |
| 88 | 0.110 | 5500 | 12.5 | o | Embodiment Example |
| 89 | 0.110 | 5500 | 12.5 | o | Embodiment Example |
| 90 | 0.110 | 5500 | 12.5 | o | Embodiment Example |
| 91 | 0.110 | 5500 | 12.5 | o | Embodiment Example |
| 92 | 0.110 | 5500 | 12.5 | o | Embodiment Example |
| 93 | 0.110 | 5000 | 12.5 | o | Embodiment Example |
| 94 | 0.120 | 4500 | 12.5 | o | Embodiment Example |
| 95 | 0.120 | 4000 | 12.5 | o | Embodiment Example |
| 96 | 0.130 | 3000 | 12.5 | o | Embodiment Example |
| 97 | 0.135 | 2500 | 12.5 | o | Comparative Example |

Since the method of the present invention is performed in the above-mentioned manner, properties of Fe—Ni—O film formed on the surface of the plating layer of zinciferous plated steel sheet are improved, and moreover, since Fe—Ni—O film is hard in comparison with the zinc or zinc alloy plating layer and has a high temperature point, sliding resistance between the surface of plating layer and the press forming die is reduced at the time of press forming, causing the zinciferous plated steel sheet to be easily received in the press forming die with the result that the press formability is improved. In addition, continuous spot-weldability s during spot welding are improved owing to the presence of Fe—Ni—O film. Additionally, properties of the Fe—Ni—O plated steel sheet are improved owing to the presence of the Fe—Ni—O film. As will be apparent from the above description, the present invention can provide a method for producing a zinciferous plated steel sheet with excellent properties of press formability and spot weldability as well as excellent adhesiveness, resulting in very usable industrial effects being assured.

EMBODIMENT 7

The present inventors have made continued research to obtain several results described later. Namely, improved press formability can be attained by the formation of a Fe—Ni—O film on the plating layer disposed on an alloyed zinc dip-plated steel sheet and provided with a surface alloy phase that is of a ζ or δ1 phase.

It will be reasoned here why the above specified construction can provide an alloyed zinc dip-plated steel sheet having excellent press formability.

Insufficient press formability inherent to an alloyed alloyed zinc dip-plated steel sheet is due to the fact that when the surface alloy phase present on a plating layer is of a η or ζ phase, a cohesive phenomenon takes place between a η or ζ phase of a soft nature and of a low melting point and a mating mold at elevated surface pressure, resulting in increased sliding resistance. The surface alloy phase if being of a η1 phase is harder in nature and higher in melting point than the η and ζ phases, but is still more susceptible to sticking than a cold-rolled steel sheet.

For such problems to be solved, it is effective to provide a film of a higher hardness and of a higher melting point than a Fe—Zn alloy phase. A Fe—Ni—O film according to the present invention is high in hardness and high in melting point. When applied on to an alloyed zinc dip-plated steel sheet, this film acts to reduce such resistance as tending to occur on sliding movement of the plating layer with respect to the associated pressure mold, thus allowing the steel sheet to easily slide into the mold so that press formability is improved.

Furthermore, where a ζ phase of a low Fe content is required to be disposed on the plating layer, a brittle ζ phase can be prevented against generation with the result that powdering resistance is improved at the same time. Where a δ1 phase of a high Fe content is desired to be formed on the plating layer, a η phase of a soft nature and of a low melting point can be prevented from getting generated, whereby flaking resistance is simultaneously improved.

Alloyed zinc dip-plated steel sheets in common use are poor in respect of continuous spot-weldability during spot welding when compared to a cold-rolled steel sheet. This is because zinc having melted at the time of spot welding makes a reactive contact with a copper electrode to generate a brittle alloy layer which would deteriorate the electrode with violence.

It is generally recognized that continuous spot-weldability could be effectively improved by forming a high-melting film on the plating layer of an alloyed zinc dip-plated steel sheet. To gain improved spot weldability of the steel sheet, the present inventors have made studies of a variety of films and have now found that a film derived particularly from an oxide of Ni is suited for that purpose. Although the reasoning is not exactly unknown, it is thought that Ni would react with Zn to generate a high-melting Zn—Ni alloy and that because of its extremely high melting point and also of its semiconductive properties, Ni would exhibit electrical conductivity to rather high a degree among the various films.

Conventional alloyed zinc dip-plated steel sheets are known to be lower in adhesiveness than a cold-rolled steel sheet, but little has been elucidated about the cause. As a result of studies made by the present inventors, it has been found that adhesiveness is dominated by the composition of an oxide film deposited on a steel sheet. That is, the oxide film is predominantly of a Fe oxide in the cold-rolled steel sheet, while the oxide film is mainly of a Zn oxide in the alloyed zinc dip-plated steel sheet. Adhesiveness varies with the composition of each of the two different films, and the Zn oxide has proved inferior in this physical property to the Fe oxide. As contemplated under the present invention, therefore, adhesiveness can be improved by the formation of a Fe oxide-containing film on the alloyed zinc dip-plated steel sheet.

Conventional alloyed zinc hot-plated steel sheets are insufficient in regard to chemical treatability as compared to a cold-rolled steel sheet. This is attributable to the fact that since Zn present on the steel sheet is high in its concentration, a crystal of a phosphate film to be formed is coarse and irregular and that two phosphate crystals used in both of the steel sheets are different from each other. In the case of the cold-rolled steel plate, the phosphate crystal is based mainly on phosphofilite ($Zn_2Fe(PO_4)_3.4H_2O$). Where the Zn concentration is high on a steel sheet, the phosphate crystal is composed predominantly of phobite ($Zn_3(PO_4)_3.4H_2O$) which is rather poor as to secondary adhesiveness in warm water after painting. The reason behind this is that owing to too low a concentration of Fe in the phosphate film, the chemically treated film causes condensation when exposed to a wetting environment after painting, inviting lost adhesiveness to the steel sheet.

For the chemically treated film to be prevented against condensation, it is effective to incorporate such metals as of Fe, Ni and the like into a phosphate crystal. With a Fe—Ni—O film provided as called for by the present invention, Ni and Fe can incorporate into a phosphate crystal, bringing about a chemically treated film of satisfactory adhesiveness and besides a dense regular phosphate crystal, whereby secondary adhesiveness in warm water as well as corrosion resistance has been found to be improved.

As previously mentioned, it has been found that an alloyed zinc dip-plated steel sheet can be obtained by properly forming on its plating layer a combination film (hereunder called a Fe—Ni—O film) composed at least of metals of Ni and Fe and oxides of Ni and Fe, which steel sheet is excellent in press formability, spot weldability, adhesiveness and chemical treatability and also in deep drawability. More specifically, one essential requirement of the present invention lies in the provision of the above Fe—Ni—O film on the plating layer.

This invention has been completed based on the foregoing findings. An alloyed zinc dip-plated steel sheet of the first manner comprises a plating layer disposed on at least one surface thereof and having a chemical composition comprised of 6–11 wt. % of Fe and as the balance Zn and unavoidable impurities, characterized in that the plating layer is provided with a surface alloy phase which is of a ζ phase, and the plating layer has a coating weight of 20–100 $g/m^2$ and includes a Fe—Ni—O film formed thereon.

An alloyed zinc dip-plated steel sheet of the second manner, characterized in that, in the invention recited in the first manner, the Fe—Ni—O film has a coating weight of 10–1500 $mg/m^2$ in terms of the total weight of all of the metallic elements contained therein, the content of Fe (wt. %) in the Fe—Ni—O film is in a ratio of 0.004–0.9 with respect to the sum of the content of Fe (wt. %) and the content of Ni (wt. %) in the Fe—Ni—O film, and the Fe—Ni—O film contains oxygen in an amount of 0.5–10 wt. %.

An alloyed zinc dip-plated steel sheet according to the third manner comprises a plating layer disposed on at least one surface thereof and having a chemical composition comprised of 9–14 wt. % of Fe and as the balance Zn and unavoidable impurities, characterized in that the plating layer is provided with a surface alloy phase which is of a δ1 phase, and the plating layer has a coating weight of 20–100 $g/m^2$ and includes a Fe—Ni—O film formed thereon.

An alloyed zinc dip-plated steel sheet of the fourth manner, characterized in that, in the third manner, the Fe—Ni—O film has a coating weight of 10–1500 $mg/m^2$ in terms of the total weight of all of the metallic elements contained therein, the content of Fe (% by weight) in the Fe—Ni—O film is in a ratio of 0.004–0.9 with respect to the sum of the content of Fe (wt. %) and the content of Ni (wt. %) in the Fe—Ni—O film, and the Fe—Ni—O film contains oxygen in an amount of 0.5–10 wt. %.

Now, the following explanations are given to account for specific limitations imposed, as noted above in the practice of the present invention, upon the alloyed zinc dip-plating layer deposited as an undercoat on the steel sheet and the film formed as an overcoat on the plating layer.

(1) Alloyed Zinc Dip-Plating layer

[When Surface Alloy Phase is of a ζ Phase]

The content of Fe is more than 6 wt. % as less than that content is ineffective to form a ζ phase on the plating layer. Conversely, contents of Fe above 11 wt. % should be avoided to preclude formation of a Γ phase with increased thickness. The Γ phase so formed thick leads to impaired powdering resistance, hence marred press formability, even with a Fe—Ni—O film formed on the plating layer.

Accordingly, the content of Fe in the alloyed zinc dip-plating layer should be in the range of 6–11 wt. %.

[When Surface Alloy Phase is of a δ1 Phase]

The content of Fe in the alloyed zinc dip-plating layer exceeds 9 wt. % since less than that content fails to form a δ1 phase on the plating layer. Even where a δ1 phase is provided on the plating layer, contents of Fe above 14 wt. % render the resulting Γ phase large in thickness. The Γ phase thus made thick-walled adversely affects powdering resistance and hence press formability even a Fe—Ni—O film provided on the plating layer.

Thus, the content of Fe in the alloyed zinc dip-plating layer should be in the range of 9–14 wt. %.

[Coating weight of Alloyed zinc dip-plating layer]

The coating weight is limited to a range of 20–100 g/m$^2$. Below 20 g/m$^2$ fails to gain sufficient corrosion resistance, while above 100 g/m$^2$ causes a Γ phase to excessively grow with large thickness in an alloying step in which Fe is added in an amount of more than 6 wt. % in an alloyed zinc dip-plating layer. The latter case leaves the problem that, even if the present invention is practiced, adequate powdering resistance cannot be attained.

Fe only is specifically represented herein as a component of the alloyed zinc dip-plating layer. Various other metals such as Al, Pb, Cd, Sn, In, Li, Sb, As, Bi, Mg, La, Ca, Ti, Zr, Ni, Co, Cr, Mn, P, S, O and the like may be used so long as they are added in limited amounts to the plating layer or made to unavoidably intrude into the layer. These metals exert no significant effect on those advantages accruing from the present invention. As for Al, for example, this metal has been added in an amount of about 0.1 wt. % to a plating bath in current practice, and hence, may be made to necessarily enter the resultant plating layer.

(2) Fe—Ni—O Film

[Coating weight of Fe—Ni—O Film]

The coating weight of the Fe—Ni—O film, if less than 10 mg/m$^2$ in terms of the total weight of all the metallic elements, fails to suffciently improve press formability, and if more than 1500 mg/m$^2$, produce no better results in further improvement in such physical property.

The coating weight of the Fe—Ni—O film should, therefore, be preferably in the range of 10–1500 mg/m$^2$ in terms of the total weight of all the metals in the plating layer.

To set the coating weight of the Fe—Ni—O film to be within that range, a length of time for treatment can be adjusted when a salt concentration is held constant in a treating liquid for use in film formation, and a salt concentration in the treating liquid can be adjusted when the treatment time is held constant from equipment standpoints and also with pH and temperature conditions controlled to advantage.

[Ratio of Fe Content to Sum of Fe and Ni Contents in Fe—Ni—O Film]

An appropriate content of Fe in a Fe—Ni—O film brings about improved adhesiveness. The better adhesiveness, the higher surface potential of a metal is. Fe is among such metals as of the highest surface potential, and thus, adhesiveness is further improved with increasing contents of Fe. In order to achieve improved adhesiveness, it is necessary that Fe be at least substantially present in the film. To this end, the ratio of a Fe content (wt. %) to the sum of a Fe content (wt. %) and a Ni content (wt. %) in the Fe—Ni—O film (hereunder called Fe/(Fe+Ni) in the film) should be more than 0. Also notably, above 0.004 of Fe/(Fe+Ni) in the film contributes greatly to enhanced adhesiveness.

On the other hand, Ni needs to be substantially contained in the film, and Fe/(Fe+Ni) should not exceed 1. Below 0.9 of Fe/(Fe+Ni) in the film further improves spot weldability.

Accordingly, Fe should be contained in the Fe—Ni—O film, preferably in a Fe/(Fe+Ni) of 0.004–0.9.

[Content of Oxygen in Fe—Ni—O Film]

An appropriate content of oxygen in the Fe—Ni—O film contributes to improved press formability and spot weldability. It is required, to this end, that oxygen be at least substantially contained in the film, and the oxygen content should be more than 0 wt. %. Oxygen contents of above 0.5 wt. % in the Fe—Ni—O film are conducive to highly improved press formability.

Oxygen contents if below 10 wt. % show further improvements in spot weldability and chemical treatability. Thus, oxygen should be contained in the Fe—Ni—O film preferably in a limited range of 0.5–10 wt. %.

Even if the Fe—Ni—O film contains oxides or hyroxides derivable from elements such as Zn, Co, Mn, Mo, Al, Ti, Sn, W, Si, Pb, Ta and the like, or metal themselves which are present in the undercoat or plating layer, the above noted advantages are satisfactorily achievable.

In addition, the Fe—Ni—O film disposed as an overcoat in accordance with the present invention is not restricted as to the preparation method. There may be suitably used various methods such as substitution plating, dip plating in an oxidizing agent-containing aqueous solution, cathodic or anodic electrolyzation in an oxidizing agent-containing aqueous solution, spraying of a given aqueous solution, roll coating and the like, laser assisted CVD, photon assisted CVD, vacuum deposition and gaseous phase plating such as sputtering deposition.

The Fe—Ni—O film discussed hereinabove is formed on a plating layer disposed on at least one surface of an alloyed zinc dip-plated steel sheet. Steel sheets having carried such a film on either one of the surfaces thereof, or such films on both of the surfaces may be selected depending upon the process step in which to employ the steel sheet in the manufacture of an automobile body and upon the region at which to shape the body.

EXAMPLES

The present invention is further described with reference to examples.

A 0.7 mm-thick, cold-rolled steel sheet was subjected to alloyed zinc dip-plating in known manner and with the coating weight, the content of Fe in a plating layer and the surface alloy phase adjusted to the desired parameters, whereby an alloyed zinc dip-plated steel sheet was produced. A Fe—Ni—O film was thereafter formed on the plating layer by any one of the following three preparation methods.

[Preparation Method A]

An alloyed zinc dip-plated steel sheet was cathodically electrolyzed in a solution composed of a mixture of ferrous sulfate and nickel sulfate and containing an oxidizing agent so that a desired Fe—Ni—O film was formed on the plating layer. Here, the concentration of ferrous sulfate in a 100 g/l was varied with that of nickel sulfate held constant. Furthermore, with the pH and temperature of the mixed solution held constant respectively at 2.5 and at 50° C., aqueous hydrogen peroxide was used as the oxidizing agent, and the oxygen content in the film was varied with various desirable concentrations of the oxidizing agent.

[Preparation Method B]

Sprayed on to an alloyed zinc dip-plated steel sheet was an aqueous solution containing nickel chloride in a 120 g/l concentration and ferrous chloride in varied desired concentrations. Drying was conducted in a mixed atmosphere of air and ozone with a Fe—Ni—O film adjusted in its oxygen content, whereby a desired Fe—Ni—O film was formed on the plating layer.

[Preparation Method C]

An alloyed zinc dip-plated steel sheet was immersed in an aqueous solution containing nickel chloride in a 120 g/l concentration and ferrous chloride in varied desired concentrations and having a pH of 2.5–3.5 and a temperature of 50° C. The coating weight of a Fe—Ni—O film was varied at a desired level by adjustment of dipping time. The content of oxygen in a Fe—Ni—O film was varied, through pH adjustment, within a desired range. To further adjust the oxygen content, a given oxidizing agent was incorporated in a given aqueous solution, and heating was done in a given oxidative atmosphere so that a desired Fe—Ni—O film was formed on the alloyed zinc dip-plated steel sheet.

By formation of Fe—Ni—O films on alloyed zinc dip-plated steel sheets using the above preparation methods, specimens according to the present invention and for comparative purposes were produced. These inventive and comparative specimens were obtained as two separate groups. A first test ("Example 1") was directed to examples related to manners 1 and 3 and a second test ("Example 2") to examples related to manners 2 and 4.

[First Test]

In Tables 40 and 41, the inventive and comparative specimens obtained in the first test are listed in regard to the contents of Fe in the alloyed zinc dip-plating layers, the surface alloy phases on the plating layers, the coating weight, and the preparation methods of Fe—Ni—O films and the presence or absence of the films.

TABLE 40

| | Alloyed Zinc Dip-Plated Layer | | | Fe—Ni—O Film | | Press Formability | | Powder- | | | | |
|---|---|---|---|---|---|---|---|---|---|---|---|---|
| Specimen No. | Fe Content wt. % | Surface Alloy Phase | Plating Deposit mg/m$^2$ | Film Forming Method | Presence/ Absence of Film | Friction Coefficient | Percentage Change of Diameter | ing Resistance | Spot Weldability | Adhesion | Chemical Treatment | |
| 1 | 5 | η | 30 | A | O | X | X | O | O | O | O | Comparative Example |
| 2 | 5 | η | 30 | — | X | X | X | O | X | X | X | Comparative Example |
| 3 | 6 | η | 60 | B | O | X | X | O | O | O | O | Comparative Example |
| 4 | 6 | η | 60 | — | X | X | X | O | X | X | X | Comparative Example |
| 5 | 6 | ξ | 45 | C | O | O | O | O | O | O | O | Example |
| 6 | 6 | ξ | 45 | — | X | X | X | O | X | X | X | Comparative Example |
| 7 | 7 | η | 30 | C | O | X | X | O | O | O | O | Comparative Example |
| 8 | 7 | η | 30 | — | X | X | X | O | X | X | X | Comparative Example |
| 9 | 7 | ξ | 60 | A | O | O | O | O | O | O | O | Example |
| 10 | 7 | ξ | 60 | — | X | X | X | O | X | X | X | Comparative Example |
| 11 | 8 | ξ | 60 | A | O | O | O | O | O | O | O | Example |
| 12 | 8 | ξ | 60 | — | X | X | X | O | X | X | X | Comparative Example |
| 13 | 9 | ξ | 45 | B | O | O | O | O | O | O | O | Example |
| 14 | 9 | ξ | 45 | — | X | X | X | O | X | X | X | Comparative Example |
| 15 | 9 | δl | 90 | A | O | O | O | O | O | O | O | Example |
| 16 | 9 | δl | 90 | — | X | X | X | X | X | X | X | Comparative Example |
| 17 | 10 | ξ | 30 | C | O | O | O | O | O | O | O | Example |
| 18 | 10 | ξ | 30 | — | X | X | X | O | X | X | X | Comparative Example |
| 19 | 10 | δl | 30 | B | O | O | O | O | O | O | O | Example |
| 20 | 10 | δl | 30 | — | X | X | X | X | X | X | X | Comparative Example |

O: Practically acceptable

X: Practically unacceptable

TABLE 41

| | Alloy | | | | | Press Formability | | | | | | |
|---|---|---|---|---|---|---|---|---|---|---|---|---|
| | Zinc Dip-Plated Layer | | | Fe—Ni—O Film | | | | | | | | |
| Specimen No. | Fe Content (wt. %) | Surface Alloy Phase | Plating Deposit mg/m$^2$ | Film Forming Method | Presence/Absence of Film | Friction Coefficient | Percentage Change of Outer Diameter | Powdering Resistance | Spot Weldability | Adhesion | Chemical Treatment | |
| 21 | 11 | ξ | 60 | C | ○ | ○ | ○ | ○ | ○ | ○ | ○ | Example |
| 22 | 11 | ξ | 60 | — | X | X | X | X | X | X | X | Comparative Example |
| 23 | 11 | δ1 | 60 | B | ○ | ○ | ○ | ○ | ○ | ○ | ○ | Example |
| 24 | 11 | δ1 | 60 | — | X | X | X | X | X | X | X | Comparative Example |
| 25 | 12 | ξ | 45 | A | ○ | ○ | ○ | X | ○ | ○ | ○ | Comparative Example |
| 26 | 12 | ξ | 45 | — | X | X | X | X | X | X | X | Comparative Example |
| 27 | 12 | δ1 | 60 | C | ○ | ○ | ○ | ○ | ○ | ○ | ○ | Example |
| 28 | 12 | δ1 | 60 | — | X | X | X | X | X | X | X | Comparative Example |
| 29 | 13 | ξ | 45 | A | ○ | ○ | ○ | X | ○ | ○ | ○ | Comparative Example |
| 30 | 13 | ξ | 45 | — | X | X | X | X | X | X | X | Comparative Example |
| 31 | 13 | δ1 | 45 | C | ○ | ○ | ○ | ○ | ○ | ○ | ○ | Example |
| 32 | 13 | δ1 | 45 | — | X | X | X | X | X | X | X | Comparative Example |
| 33 | 14 | ξ | 90 | A | ○ | ○ | ○ | X | ○ | ○ | ○ | Comparative Example |
| 34 | 14 | ξ | 90 | — | X | X | X | X | X | X | X | Comparative Example |
| 35 | 14 | δ1 | 90 | C | ○ | ○ | ○ | ○ | ○ | ○ | ○ | Example |
| 36 | 14 | δ1 | 90 | — | X | X | X | X | X | X | X | Comparative Example |
| 37 | 15 | ξ | 60 | A | ○ | ○ | ○ | X | ○ | ○ | ○ | Comparative Example |
| 38 | 15 | ξ | 60 | — | X | X | X | X | X | X | X | Comparative Example |
| 39 | 15 | δ1 | 60 | C | ○ | ○ | ○ | X | ○ | ○ | ○ | Comparative Example |
| 40 | 15 | δ1 | 60 | — | X | X | X | X | X | X | X | Comparative Example |

○: Practically acceptable
X: Practically unacceptable

Performance evaluation was made of the above specimens in respect of press formability, powdering resistance, spot weldability, adhesiveness and chemical treatability with use of the methods indicated below. Press formability was adjudged based on the friction coefficient of the specimen and also on the percentage change of an outer diameter by a cup deep drawing test.

[Cup Deep Drawing Test]

By a cup deep drawing test, the percentage changes of an outer diameter of a specimen was measured before and after the test.

A 110 mm-diameter disc was blanked from each specimen, followed by cylindrical forming into a die of 53 mm in diameter and 5 mm in shoulder radius at a crease pressing force of 3 tons by use of a punch of 50 mm in diameter and 5 mm in shoulder radius. Noxrust 550 HN manufactured by Nippon Parkerising Co., Ltd. was utilized as a lubricant.

Figure 17:
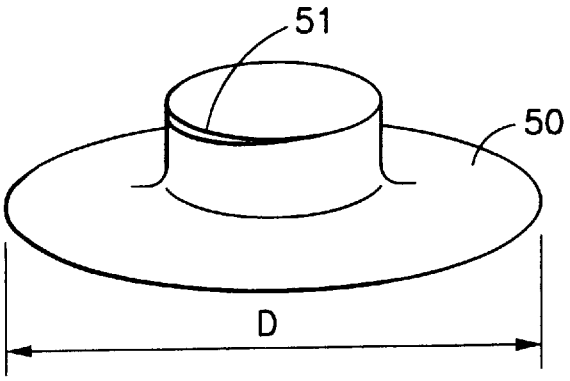
FIG. 17 is a schematic perspective view showing a specimen after being subjected to a cup deep drawing test.

FIG. 17 is a schematic perspective view of a specimen after being subjected to a cup deep drawing test. In this figure, designated at 50 is a flange, at D an outer diameter of the flange and at 51 a crack having taken place as a result of cylindrical forming.

The percentage change of the outer diameter of the flange after cup deep drawing was counted from equation below.

$$\text{percentage change of outer diameter (\%)}=\{(110-D)/110)\}\times 100 \quad (1)$$

where D: outer diameter of flange after testing (mm)

Based on a draw bead test, powdering resistance was evaluated from a peeling (hereunder called "a film peel amount") of a film (an alloyed zinc dip-plating layer and a Fe—Ni—O film) carried on a steel sheet.

[Draw Bead Test]

With use of the following method, the film disposed on the steel sheet was peeled by wiping of a specimen against a bead so that the peel amount was measured.

A test piece of a given shape and of a given dimension was blanked from each specimen, followed by peeling of a plating layer and a Fe—Ni—O film on an asymmetrical side through dissolution with dilute hydrochloric acid and by subsequent degreasing, after which the weight of of the test piece was measured. The test piece thus prepared was mounted on a testing machine indicated below.

Figure 18:
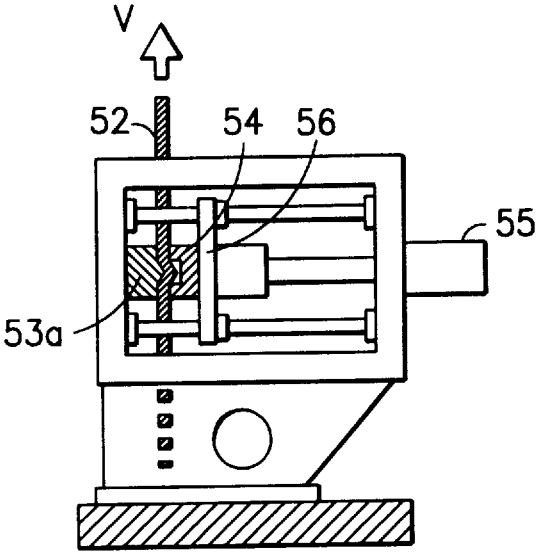
FIG. 18 is a cross-sectional view, shown schematically and vertically, of a draw bead testing machine used for examination of powdering resistance.

FIG. 18 is a schematic cross-sectional view of a draw bead testing machine used. In this figure, designated at 52 is a test piece, at 53 a bead, at 53*a* a bead frame, at 54 a die and at 55 a hydraulic device.

Figure 19:
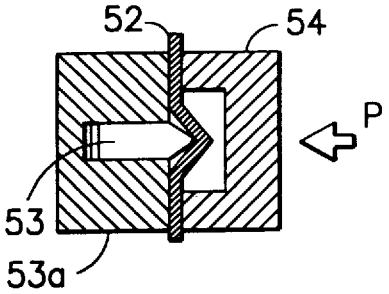
FIG. 19 is a partly enlarged view of FIG. 4.

FIG. 19 is an enlarged view of FIG. 18.

As seen in FIG. 19, the test piece 52 is positioned between the bead 53 and the bead frame 53*a* and the die 54 with a test surface (a surface subjected to testing) of the test piece 52 made to face toward the bead 53. Thereafter, upon foward pressing of a press plate 56 by actuation of the hydraulic device 55, the test piece 52 is interposed in pressed relation between the bead frame 13*a* and the die 54 and then is allowed to abut against a tip of the bead 53. A hydraulic press force P is 500 kgf. With the test surface of the test piece 12 thus abutted against the tip of the bead 13, such test piece is upwardly pulled at normal angle to a longitudinal direction of the bead 53 at a speed of 200 mm/min and in a length of 110 mm.

Figure 20:
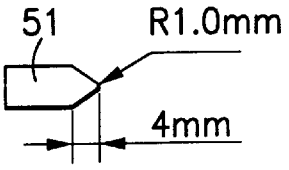
FIG. 20 is a schematic view for showing of the shape and dimension of a bead tip.

Illustrated in FIG. 20 are the shape and dimension of the bead tip. As is clear from this figure, the bead 53 is of a semi-spherical shape with a tip radius of 1.0 mm and a bead height of 4 mm. Testing was conducted with the test surface coated with a lubricant, Noxrust 550 HN, manufactured by Nippon Parkerising Co., Ltd.

Next, the test piece 52 was degreased and applied on its test surface with an adhesive tape, followed by peeling of the tape and by subsequent further degreasing, and the test piece 52 weight was then measured. The difference of weights before and after testing was counted, from which a peel amount of the film was determined.

From the results shown in Tables 40 and 41, the following facets have been revealed.

The alloyed zinc dip-plated steel sheets falling within the scope of the present invention offer reduced friction coefficient in their films and at the same time improved deep formability, thus showing press formability to a practically acceptable extent.

The film peel amount caused from wiping of a film is practically acceptably small and hence is highly resistant to powdering.

The number of spots when in spot welding is practically acceptably large and hence is highly satisfactory in regard to spot weldability.

The peeloff strength after adhesiveness by use of a resinous adhesive is at a practically acceptable level and hence is highly capable of exhibiting excellent adhesiveness.

The chemically treated zinc phosphate film provides a crystalline state at a practically acceptable level, thus leading to excellent chemical treatability.

In contrast to the inventive steel sheets, the alloyed zinc dip-plated steel sheets outside the scope of the invention are unsatisfactory with regard to all of friction coefficient, deep drawability, powdering resistance, spot weldability, adhesiveness and chemical treatability.

[Second Test]

A second test will follow with its conditions and results.

In the second test, the coating weight and chemical composition of a Fe—Ni—O film were examined under stricter conditions than in the first test.

In Tables 42–47, the inventive and comparative specimens prepared for use in the second test are listed as regards the content of Fe in an alloyed zinc dip-plating layer, the surface alloy phase in the plating layer, the plating deposit, the preparation method of a Fe—Ni—O film, the film coating weight (the reduced total of all of the metallic elements in the film, this being equally applicable to the test results described later), the Fe/(Fe+Ni) in the film and the content of oxygen in the film.

TABLE 42

| | Alloyed Zinc Dip-Plated Layer | | | Fe—Ni—O Film | | | | |
|---|---|---|---|---|---|---|---|---|
| Specimen No. | Fe Content wt. % | Surface Alloy Phase | Plating Deposit g/m$^2$ | Film Forming Method | Film Deposit mg/m$^2$ | Fe/Fe + Ni Content in Film | Oxygen Content wt. % | |
| 41 | 9 | ξ | 60 | A | 200 | 0 | 3.0 | Comparative Example |
| 42 | 9 | ξ | 60 | A | 200 | 0.002 | 3.0 | Example |
| 43 | 9 | ξ | 60 | A | 200 | 0.004 | 3.0 | Example |
| 44 | 9 | ξ | 60 | A | 200 | 0.01 | 3.0 | Example |
| 45 | 9 | ξ | 60 | A | 200 | 0.02 | 3.0 | Example |
| 46 | 9 | ξ | 60 | A | 200 | 0.04 | 3.0 | Example |
| 47 | 9 | ξ | 60 | A | 200 | 0.05 | 3.0 | Example |
| 48 | 9 | ξ | 60 | A | 200 | 0.08 | 3.0 | Example |
| 49 | 9 | ξ | 60 | A | 200 | 0.11 | 3.0 | Example |
| 50 | 9 | ξ | 60 | A | 200 | 0.14 | 3.0 | Example |
| 51 | 9 | ξ | 60 | A | 200 | 0.17 | 3.0 | Example |
| 52 | 9 | ξ | 60 | A | 200 | 0.2 | 3.0 | Example |
| 53 | 9 | ξ | 60 | A | 200 | 0.23 | 3.0 | Example |
| 54 | 9 | ξ | 60 | A | 200 | 0.24 | 3.0 | Example |
| 55 | 9 | ξ | 60 | A | 200 | 0.27 | 3.0 | Example |
| 56 | 9 | ξ | 60 | A | 200 | 0.3 | 3.0 | Example |
| 57 | 9 | ξ | 60 | A | 200 | 0.33 | 3.0 | Example |
| 58 | 9 | ξ | 60 | A | 200 | 0.4 | 3.0 | Example |
| 59 | 9 | ξ | 60 | A | 200 | 0.6 | 3.0 | Example |
| 60 | 9 | ξ | 60 | A | 200 | 0.8 | 3.0 | Example |
| 61 | 9 | ξ | 60 | A | 200 | 0.9 | 3.0 | Example |
| 62 | 9 | ξ | 60 | A | 200 | 0.95 | 3.0 | Example |
| 63 | 9 | ξ | 60 | A | 200 | 1 | 3.0 | Comparative Example |
| 64 | 9 | ξ | 60 | A | 200 | 0.2 | 0.0 | Comparative Example |
| 65 | 9 | ξ | 60 | A | 200 | 0.2 | 0.2 | Example |
| 66 | 9 | ξ | 60 | A | 200 | 0.2 | 0.4 | Example |
| 67 | 9 | ξ | 60 | A | 200 | 0.2 | 0.5 | Example |
| 68 | 9 | ξ | 60 | A | 200 | 0.2 | 1.5 | Example |
| 69 | 9 | ξ | 60 | A | 200 | 0.2 | 2 | Example |
| 70 | 9 | ξ | 60 | A | 200 | 0.2 | 4 | Example |
| 71 | 9 | ξ | 60 | A | 200 | 0.2 | 5 | Example |
| 72 | 9 | ξ | 60 | A | 200 | 0.2 | 6 | Example |
| 73 | 9 | ξ | 60 | A | 200 | 0.2 | 8 | Example |

TABLE 42-continued

| Specimen No. | Alloyed Zinc Dip-Plated Layer: Fe Content wt. % | Surface Alloy Phase | Plating Deposit g/m$^2$ | Fe—Ni—O Film: Film Forming Method | Film Deposit mg/m$^2$ | Fe/Fe + Ni Content in Film | Oxygen Content wt. % | |
|---|---|---|---|---|---|---|---|---|
| 74 | 9 | ξ | 60 | A | 200 | 0.2 | 10 | Example |
| 75 | 9 | ξ | 60 | A | 200 | 0.2 | 11 | Example |
| 76 | 9 | ξ | 60 | A | 200 | 0.2 | 22 | Example |

TABLE 43

| Specimen No. | Alloyed Zinc Dip-Plated Layer: Fe Content wt. % | Surface Alloy Phase | Plating Deposit g/m$^2$ | Fe—Ni—O Film: Film Forming Method | Film Deposit mg/m$^2$ | Fe/Fe + Ni Content in Film | Oxygen Content wt. % | |
|---|---|---|---|---|---|---|---|---|
| 77 | 9 | ξ | 60 | B | 200 | 0.2 | 0.0 | Comparative Example |
| 78 | 9 | ξ | 60 | B | 200 | 0.2 | 0.2 | Example |
| 79 | 9 | ξ | 60 | B | 200 | 0.2 | 0.4 | Example |
| 80 | 9 | ξ | 60 | B | 200 | 0.2 | 0.5 | Example |
| 81 | 9 | ξ | 60 | B | 200 | 0.2 | 1.5 | Example |
| 82 | 9 | ξ | 60 | B | 200 | 0.2 | 2 | Example |
| 83 | 9 | ξ | 60 | B | 200 | 0.2 | 4 | Example |
| 84 | 9 | ξ | 60 | B | 200 | 0.2 | 5 | Example |
| 85 | 9 | ξ | 60 | B | 200 | 0.2 | 6 | Example |
| 86 | 9 | ξ | 60 | B | 200 | 0.2 | 8 | Example |
| 87 | 9 | ξ | 60 | B | 200 | 0.2 | 10 | Example |
| 88 | 9 | ξ | 60 | B | 200 | 0.2 | 11 | Example |
| 89 | 9 | ξ | 60 | B | 200 | 0.2 | 22 | Example |

TABLE 44

| Specimen No. | Alloyed Zinc Dip-Plated Layer: Fe Content wt. % | Surface Alloy Phase | Plating Deposit g/m$^2$ | Fe—Ni—O Film: Film Forming Method | Film Deposit mg/m$^2$ | Fe/Fe + Ni Content in Film | Oxygen Content wt. % | |
|---|---|---|---|---|---|---|---|---|
| 90 | 9 | ξ | 60 | C | 0 | 0.2 | 1 | Comparative Example |
| 91 | 9 | ξ | 60 | C | 5 | 0.2 | 1 | Example |
| 92 | 9 | ξ | 60 | C | 8 | 0.2 | 1 | Example |
| 93 | 9 | ξ | 60 | C | 10 | 0.2 | 1 | Example |
| 94 | 9 | ξ | 60 | C | 30 | 0.2 | 1 | Example |
| 95 | 9 | ξ | 60 | C | 50 | 0.2 | 1 | Example |
| 96 | 9 | ξ | 60 | C | 100 | 0.2 | 1 | Example |
| 97 | 9 | ξ | 60 | C | 200 | 0.2 | 1 | Example |
| 98 | 9 | ξ | 60 | C | 300 | 0.2 | 1 | Example |
| 99 | 9 | ξ | 60 | C | 400 | 0.2 | 1 | Example |
| 100 | 9 | ξ | 60 | C | 500 | 0.2 | 1 | Example |
| 101 | 9 | ξ | 60 | C | 600 | 0.2 | 1 | Example |
| 102 | 9 | ξ | 60 | C | 800 | 0.2 | 1 | Example |
| 103 | 9 | ξ | 60 | C | 1000 | 0.2 | 1 | Example |
| 104 | 9 | ξ | 60 | C | 1200 | 0.2 | 1 | Example |
| 105 | 9 | ξ | 60 | C | 1500 | 0.2 | 1 | Example |
| 106 | 9 | ξ | 60 | C | 1600 | 0.2 | 1 | Example |
| 107 | 9 | ξ | 60 | C | 200 | 0.2 | 0.0 | Comparative Example |
| 108 | 9 | ξ | 60 | C | 200 | 0.2 | 0.2 | Example |
| 109 | 9 | ξ | 60 | C | 200 | 0.2 | 0.4 | Example |
| 110 | 9 | ξ | 60 | C | 200 | 0.2 | 0.5 | Example |
| 111 | 9 | ξ | 60 | C | 200 | 0.2 | 1.5 | Example |
| 112 | 9 | ξ | 60 | C | 200 | 0.2 | 2 | Example |
| 113 | 9 | ξ | 60 | C | 200 | 0.2 | 4 | Example |
| 114 | 9 | ξ | 60 | C | 200 | 0.2 | 5 | Example |
| 115 | 9 | ξ | 60 | C | 200 | 0.2 | 6 | Example |
| 116 | 9 | ξ | 60 | C | 200 | 0.2 | 8 | Example |
| 117 | 9 | ξ | 60 | C | 200 | 0.2 | 10 | Example |
| 118 | 9 | ξ | 60 | C | 200 | 0.2 | 11 | Example |
| 119 | 9 | ξ | 60 | C | 200 | 0.2 | 22 | Example |

TABLE 45

| Specimen No. | Alloyed Zinc Dip-Plated Layer: Fe Content wt. % | Surface Alloy Phase | Plating Deposit g/m$^2$ | Fe—Ni—O Film: Film Forming Method | Film Deposit mg/m$^2$ | Fe/Fe + Ni Content in Film | Oxygen Content wt. % | |
|---|---|---|---|---|---|---|---|---|
| 120 | 10 | δl | 60 | A | 200 | 0 | 3.0 | Comparative Example |
| 121 | 10 | δl | 60 | A | 200 | 0.002 | 3.0 | Example |
| 122 | 10 | δl | 60 | A | 200 | 0.004 | 3.0 | Example |
| 123 | 10 | δl | 60 | A | 200 | 0.01 | 3.0 | Example |
| 124 | 10 | δl | 60 | A | 200 | 0.02 | 3.0 | Example |
| 125 | 10 | δl | 60 | A | 200 | 0.04 | 3.0 | Example |
| 126 | 10 | δl | 60 | A | 200 | 0.05 | 3.0 | Example |
| 127 | 10 | δl | 60 | A | 200 | 0.08 | 3.0 | Example |
| 128 | 10 | δl | 60 | A | 200 | 0.11 | 3.0 | Example |
| 129 | 10 | δl | 60 | A | 200 | 0.14 | 3.0 | Example |
| 130 | 10 | δl | 60 | A | 200 | 0.17 | 3.0 | Example |
| 131 | 10 | δl | 60 | A | 200 | 0.2 | 3.0 | Example |
| 132 | 10 | δl | 60 | A | 200 | 0.23 | 3.0 | Example |
| 133 | 10 | δl | 60 | A | 200 | 0.24 | 3.0 | Example |
| 134 | 10 | δl | 60 | A | 200 | 0.27 | 3.0 | Example |
| 135 | 10 | δl | 60 | A | 200 | 0.3 | 3.0 | Example |
| 136 | 10 | δl | 60 | A | 200 | 0.33 | 3.0 | Example |
| 137 | 10 | δl | 60 | A | 200 | 0.4 | 3.0 | Example |
| 138 | 10 | δl | 60 | A | 200 | 0.6 | 3.0 | Example |
| 139 | 10 | δl | 60 | A | 200 | 0.8 | 3.0 | Example |
| 140 | 10 | δl | 60 | A | 200 | 0.9 | 3.0 | Example |
| 141 | 10 | δl | 60 | A | 200 | 0.95 | 3.0 | Example |
| 142 | 10 | δl | 60 | A | 200 | 1 | 3.0 | Comparative Example |
| 143 | 10 | δl | 60 | A | 200 | 0.2 | 0.0 | Example |
| 144 | 10 | δl | 60 | A | 200 | 0.2 | 0.2 | Example |
| 145 | 10 | δl | 60 | A | 200 | 0.2 | 0.4 | Example |
| 146 | 10 | δl | 60 | A | 200 | 0.2 | 0.5 | Example |
| 147 | 10 | δl | 60 | A | 200 | 0.2 | 1.5 | Example |
| 148 | 10 | δl | 60 | A | 200 | 0.2 | 2 | Example |
| 149 | 10 | δl | 60 | A | 200 | 0.2 | 4 | Example |
| 150 | 10 | δl | 60 | A | 200 | 0.2 | 5 | Example |
| 151 | 10 | δl | 60 | A | 200 | 0.2 | 6 | Example |
| 152 | 10 | δl | 60 | A | 200 | 0.2 | 8 | Example |
| 153 | 10 | δl | 60 | A | 200 | 0.2 | 10 | Example |
| 154 | 10 | δl | 60 | A | 200 | 0.2 | 11 | Example |
| 155 | 10 | δl | 60 | A | 200 | 0.2 | 22 | Example |

TABLE 46

| Specimen No. | Alloyed Zinc Dip-Plated Layer: Fe Content wt. % | Surface Alloy Phase | Plating Deposit g/m$^2$ | Fe—Ni—O Film: Film Forming Method | Film Deposit mg/m$^2$ | Fe/Fe + Ni Content in Film | Oxygen Content wt. % | |
|---|---|---|---|---|---|---|---|---|
| 156 | 10 | δl | 60 | A | 200 | 0.2 | 0.0 | Comparative Example |
| 157 | 10 | δl | 60 | B | 200 | 0.2 | 0.2 | Example |
| 158 | 10 | δl | 60 | B | 200 | 0.2 | 0.4 | Example |
| 159 | 10 | δl | 60 | B | 200 | 0.2 | 0.5 | Example |
| 160 | 10 | δl | 60 | B | 200 | 0.2 | 1.5 | Example |
| 161 | 10 | δl | 60 | B | 200 | 0.2 | 2 | Example |
| 162 | 10 | δl | 60 | B | 200 | 0.2 | 4 | Example |
| 163 | 10 | δl | 60 | B | 200 | 0.2 | 5 | Example |
| 164 | 10 | δl | 60 | B | 200 | 0.2 | 6 | Example |
| 165 | 10 | δl | 60 | B | 200 | 0.2 | 8 | Example |
| 166 | 10 | δl | 60 | B | 200 | 0.2 | 10 | Example |
| 167 | 10 | δl | 60 | B | 200 | 0.2 | 11 | Example |
| 168 | 10 | δl | 60 | B | 200 | 0.2 | 22 | Example |

TABLE 47

| Specimen No. | Alloyed Zinc Dip-Plated Layer: Fe Content wt. % | Surface Alloy Phase | Plating Deposit g/m² | Fe—Ni—O Film: Film Forming Method | Film Deposit mg/m² | Fe/Fe + Ni Content in Film | Oxygen Content wt. % | |
|---|---|---|---|---|---|---|---|---|
| 169 | 10 | δl | 60 | C | 0 | 0.2 | 1 | Comparative Example |
| 170 | 10 | δl | 60 | C | 5 | 0.2 | 1 | Example |
| 171 | 10 | δl | 60 | C | 8 | 0.2 | 1 | Example |
| 172 | 10 | δl | 60 | C | 10 | 0.2 | 1 | Example |
| 173 | 10 | δl | 60 | C | 30 | 0.2 | 1 | Example |
| 174 | 10 | δl | 60 | C | 50 | 0.2 | 1 | Example |
| 175 | 10 | δl | 60 | C | 100 | 0.2 | 1 | Example |
| 176 | 10 | δl | 60 | C | 200 | 0.2 | 1 | Example |
| 177 | 10 | δl | 60 | C | 300 | 0.2 | 1 | Example |
| 178 | 10 | δl | 60 | C | 400 | 0.2 | 1 | Example |
| 179 | 10 | δl | 60 | C | 500 | 0.2 | 1 | Example |
| 180 | 10 | δl | 60 | C | 600 | 0.2 | 1 | Example |
| 181 | 10 | δl | 60 | C | 800 | 0.2 | 1 | Example |
| 182 | 10 | δl | 60 | C | 1000 | 0.2 | 1 | Example |
| 183 | 10 | δl | 60 | C | 1200 | 0.2 | 1 | Example |
| 184 | 10 | δl | 60 | C | 1500 | 0.2 | 1 | Example |
| 185 | 10 | δl | 60 | C | 1600 | 0.2 | 1 | Example |
| 186 | 10 | δl | 60 | C | 200 | 0.2 | 0.0 | Comparative Example |
| 187 | 10 | δl | 60 | C | 200 | 0.2 | 0.2 | Example |
| 188 | 10 | δl | 60 | C | 200 | 0.2 | 0.4 | Example |
| 189 | 10 | δl | 60 | C | 200 | 0.2 | 0.5 | Example |
| 190 | 10 | δl | 60 | C | 200 | 0.2 | 1.5 | Example |
| 191 | 10 | δl | 60 | C | 200 | 0.2 | 2 | Example |
| 192 | 10 | δl | 60 | C | 200 | 0.2 | 4 | Example |
| 193 | 10 | δl | 60 | C | 200 | 0.2 | 5 | Example |
| 194 | 10 | δl | 60 | C | 200 | 0.2 | 6 | Example |
| 195 | 10 | δl | 60 | C | 200 | 0.2 | 8 | Example |
| 196 | 10 | δl | 60 | C | 200 | 0.2 | 10 | Example |
| 197 | 10 | δl | 60 | C | 200 | 0.2 | 11 | Example |
| 198 | 10 | δl | 60 | C | 200 | 0.2 | 22 | Example |

The measuring methods were indicated below in connection with the coating weight of a Fe—Ni—O film, the Fe/(Fe+Ni) in the film and the content of oxygen in each of the specimens.

[Coating weight of Fe—Ni—O Film and Fe/(Fe+Ni) in Film]

For quantitative analysis of a Fe—Ni—O film, the ICP method makes it difficult to completely separate the components of the Fe—Ni—O film as an overcoat from those of a plating layer as an undercoat. Thus, quantitative analysis based on the ICP method was performed to check those elements which were contained in the Fe—Ni—O film, but not contained in the undercoat or plating layer. Moreover, after sputtering of Ar ions, the XPS method was used to repetitively measure each component element in the Fe—Ni—O film from its surface so that a composition distribution of each component element was determined with respect to the depth of the plating layer. In this measuring method, the thickness of the Fe—Ni—O film was defined as (x+(y−x)/2 which was calculated from adding, to the depth (defined as x) extending from a surface at which the element present in the Fe—Ni—O film but absent in the plating layer shows its maximal concentration, the difference (y−x) between the depth (defined as y) extending from a surface at which the element could no longer be inspected and the first-mentioned depth (x), and then from dividing the resultant sum by 2; more specifically, as [(x+y)/2] which was taken to mean an average depth of the first-mentioned depth (x) and the last-mentioned depth (y). The coating weight and composition of the Fe—Ni—O film were computed from both of the results obtained by the ICP and XPS methods, and the Fe/(Fe+Ni) in the film was then computed.

[Content of Oxygen in Film]

The content of oxygen in the film was determined from analysis of film depths by auge electron spectroscopy (AES).

Subsequently, performance evaluation was made of the above specimens for press formability, powdering resistance, spot weldability, adhesiveness and chemical treatability. Their respective testing methods were the same as in the first test.

The results of the second test are listed in Tables 48–57.

TABLE 48

| Specimen No. | Press Formability: Friction Coefficient | Percentage Change of Outer Diameter % | Powdering Resistance Film Peeling g/m² | Spot Weldability Continuous Spotting | Weldability Peeling Strength kgf/25 mm | Chemical Treatment State of Film Crystal | |
|---|---|---|---|---|---|---|---|
| 41 | 0.130 | 8.01 | 6.45 | 7000 | 8.0 | O | Comparative Example |
| 42 | 0.126 | 8.33 | 6.25 | 7000 | 10.0 | O | Example |

TABLE 48-continued

| Specimen No. | Press Formability: Friction Coefficient | Percentage Change of Outer Diameter % | Powdering Resistance Film Peeling g/m$^2$ | Spot Weldability Continuous Spotting | Weldability Peeling Strength kgf/25 mm | Chemical Treatment State of Film Crystal | |
|---|---|---|---|---|---|---|---|
| 43 | 0.120 | 8.27 | 5.99 | 7000 | 12.0 | O | Example |
| 44 | 0.125 | 8.34 | 6.30 | 7000 | 12.1 | O | Example |
| 45 | 0.123 | 8.30 | 5.96 | 7000 | 12.1 | O | Example |
| 46 | 0.126 | 8.49 | 5.74 | 7000 | 12.1 | O | Example |
| 47 | 0.125 | 8.33 | 5.94 | 7000 | 12.2 | O | Example |
| 48 | 0.118 | 8.20 | 6.01 | 7000 | 12.1 | O | Example |
| 49 | 0.120 | 8.26 | 6.11 | 7000 | 12.3 | O | Example |
| 50 | 0.125 | 8.13 | 5.76 | 6500 | 12.5 | O | Example |
| 51 | 0.123 | 8.36 | 6.02 | 6500 | 12.5 | O | Example |
| 52 | 0.122 | 8.46 | 6.21 | 6500 | 12.5 | O | Example |
| 53 | 0.127 | 8.12 | 5.84 | 6500 | 12.5 | O | Example |
| 54 | 0.124 | 8.45 | 6.12 | 6500 | 12.5 | O | Example |
| 55 | 0.123 | 8.11 | 5.17 | 6500 | 12.5 | O | Example |
| 56 | O;121 | 8.06 | 5.03 | 6500 | 12.5 | O | Example |
| 57 | 0.118 | 8.27 | 6.34 | 6000 | 12.5 | O | Example |
| 58 | 0.125 | 8.14 | 5.92 | 6000 | 12.5 | O | Example |
| 59 | 0.127 | 8.49 | 6.13 | 5500 | 12.5 | O | Example |
| 60 | 0.125 | 8.03 | 5.75 | 5500 | 12.5 | O | Example |
| 61 | 0.124 | 8.47 | 6.07 | 5000 | 12.5 | O | Example |
| 62 | 0.120 | 8.14 | 6.62 | 4000 | 12.5 | O | Example |
| 63 | 0.123 | 8.24 | 6.62 | 3000 | 12.5 | O | Comparative Example |

TABLE 49

| | Press Formability: Friction Coefficient | Percentage Change of Outer Diameter % | Powdering Resistance Film Peeling g/m$^2$ | Spot Weldability Continuous Spotting | Weldability Peeling Strength kgf/25 mm | Chemical Treatment State of Film Crystal | |
|---|---|---|---|---|---|---|---|
| 64 | 0.150 | 6.38 | 7.20 | 7000 | 7.0 | O | Comparative Example |
| 65 | 0.145 | 6.86 | 7.18 | 7000 | 8.0 | O | Example |
| 66 | 0.140 | 7.03 | 6.67 | 7000 | 9.0 | O | Example |
| 67 | 0.130 | 7.95 | 6.32 | 6500 | 12.0 | O | Example |
| 68 | 0.122 | 8.05 | 6.33 | 6500 | 12.5 | O | Example |
| 69 | 0.122 | 8.44 | 5.31 | 6500 | 12.5 | O | Example |
| 70 | 0.123 | 8.37 | 6.79 | 6500 | 12.5 | O | Example |
| 71 | 0.124 | 8.49 | 7.37 | 6500 | 12.5 | O | Example |
| 72 | 0.122 | 8.17 | 6.47 | 6500 | 12.5 | O | Example |
| 73 | 0.124 | 8.15 | 6.85 | 6000 | 12.5 | O | Example |
| 74 | 0.123 | 8.10 | 5.53 | 6000 | 12.5 | O | Example |
| 75 | 0.122 | 8.02 | 6.04 | 5000 | 11.0 | X | Example |
| 76 | 0.120 | 8.12 | 6.48 | 4000 | 11.0 | X | Example |

TABLE 50

| Specimen No. | Press Formability: Friction Coefficient | Percentage Change of Outer Diameter % | Powdering Resistance Film Peeling g/m$^2$ | Spot Weldability Continuous Spotting | Weldability Peeling Strength kgf/25 mm | Chemical Treatment State of Film Crystal | |
|---|---|---|---|---|---|---|---|
| 77 | 0.150 | 6.60 | 7.14 | 7000 | 7.0 | O | Comparative Example |
| 78 | 0.145 | 6.81 | 6.83 | 7000 | 8.0 | O | Example |
| 79 | 0.140 | 7.07 | 6.60 | 7000 | 9.0 | O | Example |
| 80 | 0.130 | 7.90 | 6.32 | 6500 | 12.0 | O | Example |
| 81 | 0.122 | 8.39 | 6.46 | 6500 | 12.5 | O | Example |
| 82 | 0.122 | 8.23 | 6.32 | 6500 | 12.5 | O | Example |
| 83 | 0.123 | 8.10 | 6.36 | 6500 | 12.5 | O | Example |
| 84 | 0.124 | 8.44 | 6.18 | 6500 | 12.5 | O | Example |
| 85 | 0.122 | 8.24 | 6.77 | 6500 | 12.5 | O | Example |
| 86 | 0.124 | 8.20 | 6.48 | 6000 | 12.5 | O | Example |
| 87 | 0.123 | 8.34 | 6.46 | 6000 | 12.5 | O | Example |

TABLE 50-continued

| Specimen No. | Press Formability: Friction Coefficient | Percentage Change of Outer Diameter % | Powdering Resistance Film Peeling g/m$^2$ | Spot Weldability Continuous Spotting | Weldability Peeling Strength kgf/25 mm | Chemical Treatment State of Film Crystal | |
|---|---|---|---|---|---|---|---|
| 88 | 0.122 | 8.47 | 6.21 | 5000 | 11.0 | X | Example |
| 89 | 0.120 | 8.11 | 6.22 | 4000 | 11.0 | X | Example |

TABLE 51

| Specimen No. | Press Formability: Friction Coefficient | Percentage Change of Outer Diameter % | Powdering Resistance Film Peeling g/m$^2$ | Spot Weldability Continuous Spotting | Weldability Peeling Strength kgf/25 mm | Chemical Treatment State of Film Crystal | |
|---|---|---|---|---|---|---|---|
| 90 | 0.170 | 4.55 | 7.54 | 3000 | 7.0 | X | Comparative Example |
| 91 | 0.150 | 4.76 | 7.27 | 3200 | 8.0 | O | Example |
| 92 | 0.140 | 5.36 | 7.22 | 4000 | 9.0 | O | Example |
| 93 | 0.130 | 6.28 | 7.24 | 5500 | 12.0 | O | Example |
| 94 | 0.128 | 7.45 | 6.14 | 6500 | 12.0 | O | Example |
| 95 | 0.127 | 7.98 | 6.85 | 7000 | 12.0 | O | Example |
| 96 | 0.115 | 8.04 | 5*34 | 7000 | 12.5 | O | Example |
| 97 | 0.125 | 8.15 | 7.23 | 7000 | 12.5 | O | Example |
| 98 | 0.123 | 8.22 | 7.0O | 7000 | 12.5 | O | Example |
| 99 | 0.123 | 8.29 | 5.90 | 7500 | 12.5 | O | Example |
| 100 | 0.122 | 8.39 | 7.36 | 7500 | 12.4 | O | Example |
| 101 | 0.122 | 8.54 | 6.37 | 8000 | 12.4 | O | Example |
| 102 | 0.122 | 8.56 | 5.31 | 8000 | 12.4 | O | Example |
| 103 | 0.121 | 8.79 | 5.21 | 8000 | 12.2 | O | Example |
| 104 | 0.121 | 9.03 | 5.99 | 8000 | 12.0 | O | Example |
| 105 | 0.120 | 9.16 | 6.31 | 8500 | 11.5 | O | Example |
| 106 | 0.120 | 9.17 | 6.55 | 9000 | 8.0 | O | Example |

TABLE 52

| | Press Formability: Friction Coefficient | Percentage Change of Outer Diameter % | Powdering Resistance Film Peeling g/m$^2$ | Spot Weldability Continuous Spotting | Weldability Peeling Strength kgf/25 mm | Chemical Treatment State of Film Crystal | |
|---|---|---|---|---|---|---|---|
| 107 | 0.150 | 6.51 | 7.25 | 7000 | 7.0 | O | Comparative Example |
| 108 | 0.145 | 6.81 | 7.34 | 7000 | 8.0 | O | Example |
| 109 | 0.140 | 7.02 | 6.55 | 7000 | 9.0 | O | Example |
| 110 | 0.130 | 7.95 | 6.59 | 6500 | 12.0 | O | Example |
| 111 | 0.122 | 8.19 | 6.43 | 6500 | 12.5 | O | Example |
| 112 | 0.122 | 8.02 | 6.42 | 6500 | 12.5 | O | Example |
| 113 | 0.123 | 8.37 | 6.36 | 6500 | 12.5 | O | Example |
| 114 | 0.124 | 8.36 | 6.44 | 6500 | 12.5 | O | Example |
| 115 | 0.122 | 8.40 | 6.28 | 6500 | 12.5 | O | Example |
| 116 | 0.124 | 8.20 | 6.37 | 6000 | 12.5 | O | Example |
| 117 | 0.123 | 8.18 | 6.08 | 6000 | 12.5 | O | Example |
| 118 | 0.122 | 8.47 | 6.57 | 5000 | 11.0 | X | Example |
| 119 | 0.120 | 8.32 | 6.27 | 4000 | 11.0 | X | Example |

TABLE 53

| Specimen No. | Press Formability: Friction Coefficient | Percentage Change of Outer Diameter % | Powdering Resistance Film Peeling g/m$^2$ | Spot Weldability Continuous Spotting | Weldability Peeling Strength kgf/25 mm | Chemical Treatment State of Film Crystal | |
|---|---|---|---|---|---|---|---|
| 120 | 0.130 | 8.65 | 7.90 | 7000 | 8.0 | O | Comparative Example |
| 121 | 0.126 | 8.83 | 7.10 | 7000 | 10.0 | O | Example |
| 122 | 0.120 | 8.83 | 7.78 | 7000 | 12.0 | O | Example |
| 123 | 0.125 | 9.91 | 7.71 | 7000 | 12.1 | O | Example |

TABLE 53-continued

| Specimen No. | Press Formability: Friction Coefficient | Press Formability: Percentage Change of Outer Diameter % | Powdering Resistance Film Peeling g/m$^2$ | Spot Weldability Continuous Spotting | Weldability Peeling Strength kgf/25 mm | Chemical Treatment State of Film Crystal | |
|---|---|---|---|---|---|---|---|
| 124 | 0.123 | 9.56 | 7.75 | 7000 | 12.1 | O | Example |
| 125 | 0.126 | 8.51 | 7.32 | 7000 | 12.1 | O | Example |
| 126 | 0.125 | 8.25 | 7.03 | 7000 | 12.2 | O | Example |
| 127 | 0.118 | 8.33 | 7.11 | 7000 | 12.1 | O | Example |
| 128 | 0.120 | 8.24 | 6.92 | 7000 | 12.3 | O | Example |
| 129 | 0.125 | 9.31 | 7.34 | 6500 | 12.5 | O | Example |
| 130 | 0.123 | 10.03 | 7.12 | 6500 | 12.5 | O | Example |
| 131 | 0.122 | 8.78 | 7.63 | 6500 | 12.5 | O | Example |
| 132 | 0.127 | 9.50 | 7.42 | 6500 | 12.5 | O | Example |
| 133 | 0.124 | 9.49 | 7.03 | 6500 | 12.5 | O | Example |
| 134 | 0.123 | 9.68 | 7.39 | 6500 | 12.5 | O | Example |
| 135 | 0.121 | 8.99 | 7.43 | 6500 | 12.5 | O | Example |
| 136 | 0.118 | 8.76 | 7.27 | 6000 | 12.5 | O | Example |
| 137 | 0.125 | 8.72 | 7.31 | 6000 | 12.5 | O | Example |
| 138 | 0.127 | 8.45 | 6.94 | 5500 | 12.5 | O | Example |
| 139 | 0.125 | 8.38 | 7.32 | 5500 | 12.5 | O | Example |
| 140 | 0.124 | 8.86 | 7.77 | 5000 | 12.5 | O | Example |
| 141 | 0.120 | 9.26 | 7.38 | 4000 | 12.5 | O | Example |
| 142 | 0.123 | 9.75 | 7.38 | 3000 | 12.5 | O | Comparative Example |

TABLE 54

| | Press Formability: Friction Coefficient | Press Formability: Percentage Change of Outer Diameter % | Powdering Resistance Film Peeling g/m$^2$ | Spot Weldability Continuous Spotting | Weldability Peeling Strength kgf/25 mm | Chemical Treatment State of Film Crystal | |
|---|---|---|---|---|---|---|---|
| 143 | 0.150 | 6.38 | 8.82 | 7000 | 7.0 | O | Comparative Example |
| 144 | 0.145 | 6.58 | 8.89 | 7000 | 8.0 | O | Example |
| 145 | 0.140 | 6.66 | 8.24 | 7000 | 9.0 | O | Example |
| 146 | 0.130 | 7.07 | 7.85 | 6500 | 12.0 | O | Example |
| 147 | 0.122 | 8.53 | 7.36 | 6500 | 12.5 | O | Example |
| 148 | 0.122 | 8.81 | 7.24 | 6500 | 12.5 | O | Example |
| 149 | 0.123 | 9.73 | 7.10 | 6500 | 12.5 | O | Example |
| 150 | 0.124 | 8.51 | 7.10 | 6500 | 12.5 | O | Example |
| 151 | 0.122 | 8.98 | 7.32 | 6500 | 12.5 | O | Example |
| 152 | 0.124 | 9.87 | 7.54 | 6000 | 12.5 | O | Example |
| 153 | 0.123 | 9.01 | 6.98 | 6000 | 12.5 | O | Example |
| 154 | 0.122 | 8.42 | 7.01 | 5000 | 11.0 | X | Example |
| 155 | 0.120 | 9.21 | 7.33 | 4000 | 11.0 | X | Example |

TABLE 55

| Specimen No. | Press Formability: Friction Coefficient | Press Formability: Percentage Change of Outer Diameter % | Powdering Resistance Film Peeling g/m$^2$ | Spot Weldability Continuous Spotting | Weldability Peeling Strength kgf/25 mm | Chemical Treatment Stat of Film Crystal | |
|---|---|---|---|---|---|---|---|
| 156 | 0.150 | 5.66 | 8.79 | 7000 | 7.0 | ○ | Comparative Example |
| 157 | 0.145 | 6.01 | 8.64 | 7000 | 8.0 | ○ | Example |
| 158 | 0.140 | 6.44 | 8.13 | 7000 | 9.0 | ○ | Example |
| 159 | 0.130 | 7.73 | 8.15 | 6500 | 12.0 | ○ | Example |
| 160 | 0.122 | 9.47 | 7.60 | 6500 | 12.5 | ○ | Example |
| 161 | 0.122 | 8.05 | 7.16 | 6500 | 12.5 | ○ | Example |
| 162 | 0.123 | 8.61 | 7.19 | 6500 | 12.5 | ○ | Example |
| 163 | 0.124 | 8.86 | 6.70 | 6500 | 12.5 | ○ | Example |
| 164 | 0.122 | 9.55 | 6.94 | 6500 | 12.5 | ○ | Example |
| 165 | 0.124 | 9.99 | 7.33 | 6000 | 12.5 | ○ | Example |
| 166 | 0.123 | 9.75 | 6.90 | 6000 | 12.5 | ○ | Example |
| 167 | 0.122 | 8.68 | 6.83 | 5000 | 11.0 | X | Example |
| 168 | 0.120 | 8.96 | 6.94 | 4000 | 11.0 | X | Example |

TABLE 56

| Specimen No. | Press Formability: Friction Coefficient | Press Formability: Percentage Change of Outer Diameter % | Powdering Resistance: Film Peeling g/m$^2$ | Spot Weldability: Continuous Spotting | Weldability: Peeling Strength kgf/25 mm | Chemical Treatment: Stat of Film Crystal | |
|---|---|---|---|---|---|---|---|
| 169 | 0.170 | 5.07 | 9.17 | 3000 | 7.0 | X | Comparative Example |
| 170 | 0.150 | 5.19 | 8.99 | 3200 | 8.0 | ○ | Example |
| 171 | 0.140 | 5.21 | 8.74 | 4000 | 9.0 | ○ | Example |
| 172 | 0.130 | 6.00 | 8.46 | 5500 | 12.0 | ○ | Example |
| 173 | 0.128 | 7.22 | 7.77 | 6500 | 12.0 | ○ | Example |
| 174 | 0.127 | 7.77 | 7.64 | 7000 | 12.0 | ○ | Example |
| 175 | 0.115 | 8.49 | 7.88 | 7000 | 12.5 | ○ | Example |
| 176 | 0.125 | 8.62 | 7.36 | 7000 | 12.5 | ○ | Example |
| 177 | 0.123 | 8.99 | 7.80 | 7000 | 12.5 | ○ | Example |
| 178 | 0.123 | 9.81 | 7.49 | 7500 | 12.5 | ○ | Example |
| 179 | 0.122 | 9.87 | 7.10 | 7500 | 12.4 | ○ | Example |
| 180 | 0.122 | 10.79 | 7.01 | 8000 | 12.4 | ○ | Example |
| 181 | 0.122 | 11.07 | 6.84 | 8000 | 12.4 | ○ | Example |
| 182 | 0.121 | 11.13 | 6.73 | 8000 | 12.2 | ○ | Example |
| 184 | 0.120 | 11.67 | 7.30 | 8500 | 11.5 | ○ | Example |
| 185 | 0.120 | 11.95 | 7.26 | 9000 | 8.0 | ○ | Example |

TABLE 57

| Specimen No. | Press Formability: Friction Coefficient | Press Formability: Percentage Change of Outer Diameter % | Powdering Resistance: Film Peeling g/m$^2$ | Spot Weldability: Continuous Spotting | Weldability: Peeling Strength kgf/25 mm | Chemical Treatment: Stat of Film Crystal | |
|---|---|---|---|---|---|---|---|
| 186 | 0.150 | 5.84 | 9.07 | 7000 | 7.0 | ○ | Comparative Example |
| 187 | 0.145 | 6.43 | 8.87 | 7000 | 8.0 | ○ | Example |
| 188 | 0.140 | 7.35 | 8.11 | 7000 | 9.0 | ○ | Example |
| 189 | 0.130 | 8.33 | 7.91 | 6500 | 12.0 | ○ | Example |
| 190 | 0.122 | 9.29 | 7.27 | 6500 | 12.5 | ○ | Example |
| 191 | 0.122 | 8.74 | 7.26 | 6500 | 12.5 | ○ | Example |
| 192 | 0.123 | 9.85 | 6.99 | 6500 | 12.5 | ○ | Example |
| 193 | 0.124 | 8.90 | 7.29 | 6500 | 12.5 | ○ | Example |
| 194 | 0.122 | 8.35 | 6.90 | 6500 | 12.5 | ○ | Example |
| 195 | 0.124 | 8.91 | 7.01 | 6000 | 12.5 | ○ | Example |
| 196 | 0.123 | 8.91 | 7.27 | 6000 | 12.5 | ○ | Example |
| 197 | 0.122 | 8.89 | 7.23 | 5000 | 11.0 | X | Example |
| 198 | 0.120 | 9.67 | 7.09 | 4000 | 11.0 | X | Example |

As is evident from the results of Tables 48–57, various facets have been found which are similar to those obtained in the first test. As for press formability, powdering resistance, spot weldability and adhesiveness the inventive specimens have also proved clearly distinct from the comparative specimens. The following facts have been further elucidated.

Coating weights of the Fe—Ni—O film falling within the scope of the present invention lead to higher press formability as the coating weight lies far to an upper limit. Less than 10 mg/m$^2$ of the Fe—Ni—O film as an overcoat is less effective to improve press formability, and more than 1500 mg/m$^2$ produces no better results in improving such physical property.

Coating weights of the Fe—Ni—O film within the scope of the invention are conducive to higher spot weldability as the coating weight is greater.

If Fe/(Fe+Ni) in the Fe—Ni—O film is below 0.004 wt. %, then no sufficient improvement in adhesiveness is attainable. Conversely, if Fe/(Fe+Ni) exceeds 0.9 wt. %, the content of Ni in that film becomes small, failing to improve spot weldability.

Below 0.5 wt. % in the content of oxygen in the Fe—Ni—O film fails to adequately improve press formability and spot weldability. Above 10 wt. % deteriorates chemical treatability.

Because the present invention is constructed as noted and specified hereinabove, a Fe—Ni—O film formed on a plating layer of an alloyed zinc dip-plated steel sheet is rigid in nature and high in melting point as compared to a zinc- or zinc alloy-plating layer. This means that when the alloyed zinc dip-plated steel sheet is press molded, sliding resistance is reduced between the plating layer and the mating pressure mold with eventual easy flowing of the steel sheet into the mold. Furthermore, the presence of the Fe—Ni—O film, especially the content of Ni in a specified amount, ensures that the ratio of a high-melting Zn—Ni alloy to be formed be held at a desired level when in welding, and hence, wasted electrode be prevented, and continuous spot-weldability be improved in the case of spot welding. Also advantageously, Fe is contained in a specified amount, which element is capable of generating high surface potential suited for improving adhesiveness so that an adhesive-bonded plate is obtainable with enhanced peeloff strength. To add to those advantages, chemical treatability causes Ni and Fe of the Fe—Ni—O film to incorporate into a phosphate crystal, ultimately producing high adhesiveness and also forming a dense, uniform phosphate crystal, hence excellent secondary adhesiveness in warm water.

In consequence, the present invention provides an alloyed zinc dip-plated steel sheet which is highly satisfactory in respect of press formability, spot weldability, adhesiveness and chemical treatability, and industrially useful with significant benefits.

What is claimed is:

1. A zinciferous plated steel sheet comprising:

a steel sheet;

a zinciferous plating layer which is formed on the steel sheet; and an Fe—Ni—O film which is formed on the zinciferous plating layer;

said Fe—Ni—O film having an island form or a mosaic form;

said Fe—Ni—O film having a coating weight of 10 to 1500 mg/m$^2$ in terms of the total weight of metallic elements in the Fe—Ni—O film; and said Fe—Ni—O film having a coverage of surface coating of 30 to 90%.

2. The zinciferous plated steel sheet of claim 1, wherein said Fe—Ni—O film has a ratio of the Fe content (wt %) to the total of the Fe content (wt %) and a Ni content (wt %) which is within the range of 0.004 to 0.9; and said Fe—Ni—O film has an oxygen content which is within the range of 0.5 to 10 wt %.

3. A zinciferous plated steel sheet comprising:

a steel sheet;

a zinciferous plating layer which is formed on the steel sheet; and an Fe—Ni—O film which is formed on the zinciferous plating layer;

said zinciferous plating layer being an alloyed zinc dip-plating layer;

said alloyed zinc dip-plating layer comprising 6 to 11 wt. % Fe and the balance being Zn and inevitable impurities;

said alloyed zinc dip-plating layer having a surface layer, the surface layer consisting essentially of ζ phase; and said alloyed zinc dip-plating layer having a coating weight of 20 to 100 g/m$^2$.

4. A zinciferous plated steel sheet comprising:

a steel sheet;

a zinciferous plating layer which is formed on the steel sheet;

an Fe—Ni—O film which is formed on the zinciferous plating layer;

said zinciferous plating layer being an alloyed zinc dip-plating layer;

said alloyed zinc dip-plating layer comprising 9 to 14 wt. % Fe and the balance being Zn and inevitable impurities;

said alloyed zinc dip-plating layer having a surface layer, the surface layer consisting essentially of ζ1 phase; and said alloyed zinc dip-plating layer having a coating weight of 20 to 100 g/m$^2$.

5. The zinciferous plated steel sheet of claim 3, wherein said Fe—Ni—O film has a coating weight within the range of 10 to 1500 mg/m$^2$ in terms of the total weight of metallic elements in the Fe—Ni—O film; and said Fe—Ni—O film has a ratio of the Fe content (wt %) to the total of the Fe content (wt %) and a Ni content (wt %) which is within the range of 0.004 to 0.9; and said Fe—Ni—O film has an oxygen content which is within the range of 0.5 to 10 wt %.

6. The zinciferous plated steel sheet of claim 5, wherein said zinciferous plating layer is an alloyed zinc dip-plating layer;

said alloyed zinc dip-plating layer comprises 6 to 11 wt. % Fe and the balance being Zn and inevitable impurities; and said alloyed zinc dip-plating layer has a coating weight of 20 to 100 g/m$^2$.

7. The zinciferous plated steel sheet of claim 5, wherein said zinciferous plating layer is an alloyed zinc dip-plating layer;

said alloyed zinc dip-plating layer comprises 9 to 14 wt. % Fe and the balance being Zn and inevitable impurities;

said alloyed zinc dip-plating layer has a surface alloy phase which is δ1 alloy phase; and said alloyed zinc dip-plating layer has a coating weight of 20 to 100 g/m$^2$.

8. The zinciferous plated steel sheet of claim 6, wherein said Fe—Ni—O film has an island or mosaic form;

said Fe—Ni—O film has a coating weight within the range of 10 to 1500 mg/m$^2$ in terms of the total weight of metallic elements in the Fe—Ni—O film; and said Fe—Ni—O film has a coverage of surface coating within the range of 30 to 90%.

9. The zinciferous plated steel sheet of claim 7, wherein said Fe—Ni—O film has an island or mosaic form;

said Fe—Ni—O film has a coating weight within the range of 10 to 1500 mg/m$^2$ in terms of the total weight of metallic elements in the Fe—Ni—O film; and said Fe—Ni—O film has a coverage of surface coating within the range of 30 to 90%.

10. The zinciferous plated steel sheet of claim 4, wherein said Fe—Ni—O film has a coating weight of 10 to 1500 mg/m$^2$ in terms of the total weight of metallic elements in the Fe—Ni—O film;

said Fe—Ni—O film has a ratio of Fe content (wt. %) to the total of Fe content (wt. %) and Ni content (wt. %) of 0.004 to 0.9; and said Fe—Ni—O film having an oxygen content of 0.5 to 10 wt. %.

11. A method for manufacturing the zinciferous plated steel sheet as claimed in claim 1, comprising the steps of:

forming a zinciferous plating layer on a steel sheet, and forming an Fe—Ni—O film on the zinciferous plating layer.

12. The method of claim 11, wherein said step of forming the Fe—Ni—O film comprises carrying out electrolysis with the steel sheet, on which the zinciferous plating layer is formed, as a cathode in an aqueous solution containing nickel sulfate, ferrous sulfate and ferric sulfate; and said aqueous solution has a total concentration of the nickel sulfate, the ferrous sulfate and the ferric sulfate, a ratio of concentration (mol/l) of an $Fe^{3+}$ to a sum of concentration of an $Fe^{2+}$ and the $Fe^{3+}$ and a pH, said total concentration is within a range of from 0.3 to 2 mol/l, said ratio of concentration (mol/l) is within a range of from 0.5 to less than 1.0, and a pH is within a range of from 1 to 2.

13. The method of claim 11, wherein said zinciferous plating layer is an alloyed zinc dip-plating layer having an iron content within a range of from 7 to 15 wt. %.

14. The method of claim 11, wherein said zinciferous plating layer is a zinc electroplating layer.

15. The method of claim 11, wherein said zinciferous plating layer is a zinc dip-plating layer.

16. The method of claim 11, wherein said step of forming the Fe—Ni—O film comprises carrying out electrolysis with the steel sheet, on which the zinciferous plating layer is formed, as a cathode in a plating solution containing nickel sulfate and ferrous sulfate; and said plating solution has a total concentration of the nickel sulfate and the ferrous sulfate and a pH, the total concentration is within a range of from 0.1 to 2 mol/l and the pH is within a range of from 1 to 3; and the electrolysis is carried out on conditions satisfying the following equation:

$$50 \leqq I_K/(U^{1/2} \cdot M) \leqq 150$$

where

M represents a sum of the concentrations (mol/l) of nickel ions and ferrous ions in the plating solution;

U represents a mean flow rate (m/s) of the plating solution; and $I_K$ represents a current density ($A/dm^2$) in the electrolysis.

17. The method of claim 16, wherein said zinciferous plating layer is an alloyed zinc dip-plating layer having an iron content within a range of from 7 to 15 wt. %.

18. The method of claim 16, wherein said zinciferous plating layer is a zinc electroplating layer.

19. The method of claim 16, wherein said zinciferous plating layer is a zinc dip-plating layer.

20. The method of claim 11, wherein said step of forming the Fe—Ni—O film comprises dipping the steel sheet, on which the zinciferous plating layer is formed, in an aqueous solution containing at least one of ferrous sulfate and ferrous nitrate and at least one of nickel sulfate and nickel nitrate; and a sum of an iron content (mol/l) and a nickel content (mol/l) in the aqueous solution is within a range of from 0.1 to 3.0 mol/l, a ratio of the iron content (mol/l) to the sum of the iron content (mol/l) and the nickel content (mol/l) in the aqueous solution is within a range of from 0.004 to 0.9, pH is within a range of from 1.0 to 3.5, and temperature is within a range of from 20° to 70° C.

21. The method of claim 11, after the step of forming a zinciferous plating layer on the steel sheet and before the step of forming an Fe—Ni—O film on the zinciferous plating layer, further comprising the step of treating the steel sheet, on which the zinciferous plating layer is formed, in an alkaline solution having a pH of at least 10 for a period within a range of from 2 to 30 seconds.

22. The method of claim 21, wherein said step of forming the Fe—Ni—O film comprises treating the steel sheet, on which the zinciferous plating layer is formed, in an aqueous solution containing $FeCl_2$ and $NiCl_2$ and having a pH within a range of from 2.0 to 3.5 and a temperature within a range of from 20° to 70° C.

23. The method of claim 21, wherein said step of forming the Fe—Ni—O film comprises treating the steel sheet, on which the zinciferous plating layer is formed, in an aqueous solution containing $FeCl_2$ and $NiCl_2$ and having a pH within a range of from 2.0 to 3.5, a temperature within a range of from 20° to 70° C., and a ratio of Fe content (wt. %) to the sum of the Fe content (wt. %) and a Ni content (wt. %) being within a range of from 0.004 to 0.9.

24. The method of claim 11, wherein said step of forming the Fe—Ni—O film comprises:

spraying a mist solution containing Fe ions and Ni ions and having pH of 1 to 3.5 on a surface of the zinciferous plating layer which is formed on the steel sheet;

maintaining the steel sheet at a temperature of 20° to 70° C. for 1 second or more; and heating the steel sheet;

thereby the Fe—Ni—O film having a coating weight within the range of 10 to 1500 $mg/m^2$ in terms of the total weight of the metallic elements, a rate of coating within the range of 30 to 90%, and an island-like or mosaic distribution being formed on the zinciferous plating layer.

25. The method of claim 24, wherein said mist solution has a ratio of a Fe content (g/l) to the total of the Fe content (g/l) and a Ni content (g/l) and said ratio is 0.004 to 0.9.

26. The method of claim 24, wherein said heating of the zinciferous plated steel sheet is carried out at a temperature of 80° to 500° C.

27. The method of claim 11, wherein said step of forming the Fe—Ni—O film comprises:

temper rolling the steel sheet, on which the zinciferous plating layer is formed, to form fine irregularities on the zinciferous plating layer; and forming the Fe—Ni—O film on the zinciferous plating layer, thereby the Fe—Ni—O film having a coating weight within the range of 10 to 1500 $mg/m^2$ in terms of the total weight of the metallic elements, a rate of coating within the range of 30 to 90%, and an island-like or mosaic distribution being formed on the zinciferous plating layer.

28. The method of claim 27, wherein the Fe—Ni—O film is formed by anodic electrolysis using the electrolytic solution containing nickel sulfate, ferrous sulfate and ferric sulfate in a total amount of 0.3 to 2.0 mol/l, and having a pH of 1 to 2.

29. The method of claim 28, wherein said electrolytic solution satisfies the conditions that a ratio of a Fe content (g/l) to the total of the Fe content (g/l) and a Ni content (g/l) is within the range of 0.004 to 0.9, and a molar ratio of ferrous sulfate (mol/l) to the total of the ferrous sulfate (mol/l) and ferric sulfate (mol/l) is 0.5 to less than 1.0.

30. The method of claim 27, wherein said step of forming the Fe—Ni—O film comprises treating the steel sheet, on which the zinciferous plating layer is formed, by using an aqueous solution, the aqueous solution containing $FeCl_2$ and $NiCl_2$, and satisfying the conditions that the pH is 2.0 to 3.5, and the temperature is 20° to 70° C.

31. The method of claim 27, wherein said step of forming the Fe—Ni—O film comprises treating the steel sheet, on which the zinciferous plating layer is formed, by using an aqueous solution, the aqueous solution containing $FeCl_2$ and $NiCl_2$, and satisfying the conditions that a ratio of a Fe content (g/l) to the total of the Fe content (g/l) and a Ni content (g/l) is 0.004 to 0.9, a pH is 2.0 to 3.5, and the temperature is 20° to 70° C.

32. The method of claim 11, wherein said step of forming the Fe—Ni—O film comprises:

temper rolling the steel sheet, on which the zinciferous plating layer is formed, to form a new surface on the zinciferous plating layer; and forming the Fe—Ni—O film on the zinciferous plating layer, thereby the Fe—Ni—O film having a coating weight within the range of 10 to 1500 $mg/m^2$ in terms of the total weight of the metallic elements, a rate of coating within the range of 30 to 90%, and an island-like or mosaic distribution being formed on the zinciferous plating layer.

33. The method of claim 32, wherein the Fe—Ni—O film is formed by anodic electrolysis using the electrolytic solution containing nickel sulfate, ferrous sulfate and ferric sulfate in a total amount of 0.3 to 2.0 mol/l, and having a pH of 1 to 2.

34. The method of claim 32, wherein said electrolytic solution satisfies the conditions that a ratio of a Fe content (g/l) to the total of the Fe content (g/l) and a Ni content (g/l) is within the range of 0.004 to 0.9, and a molar ratio of ferrous sulfate (mol/l) to the total of the ferrous sulfate (mol/l) and ferric sulfate (mol/l) is 0.5 to less than 1.0.

35. The method of claim 32, wherein said step of forming the Fe—Ni—O film comprises treating the steel sheet, on which the zinciferous plating layer is formed, by using an aqueous solution, the aqueous solution containing $FeCl_2$ $NiCl_2$, and satisfying the conditions that the pH is 2.0 to 3.5, and the temperature is 20° to 70° C.

36. The method of claim 32, wherein said step of forming the Fe—Ni—O film comprises treating the steel sheet, on which the zinciferous plating layer is formed, by using an aqueous solution, the aqueous solution containing $FeCl_2$ and $NiCl_2$, and satisfying the conditions that a ratio of a Fe content (g/l) to the total of the Fe content (g/l) and a Ni content (g/l) is 0.004 to 0.9, a pH is 2.0 to 3.5, and the temperature is 20° to 70° C.

37. The method of claim 11, wherein said step of forming the Fe—Ni—O film comprises:

dipping the steel sheet, on which the zinciferous plating layer is formed, in an acid solution or an alkaline solution to dissolve an air oxide film existing on a surface of the zinciferous plating layer and to form active and inactive portions on the surface of the zinciferous plating layer; and forming the Fe—Ni—O film on the zinciferous plating layer on which the active and inactive portions are formed, thereby the Fe—Ni—O film having a coating weight within the range of 10 to 1500 mg/m$^2$ in terms of the total weight of the metallic elements, a rate of coating within the range of 30 to 90%, and an island-like or mosaic distribution being formed on the zinciferous plating layer.

38. The method of claim 37, wherein the Fe—Ni—O film is formed by anodic electrolysis using the electrolytic solution containing nickel sulfate, ferrous sulfate and ferric sulfate in a total amount of 0.3 to 2.0 mol/l, and having a pH of 1 to 2.

39. The method of claim 38, wherein said electrolytic solution satisfies the conditions that a ratio of a Fe content (g/l) to the total of the Fe content (g/l) and a Ni content (g/l) is within the range of 0.004 to 0.9, and a molar ratio of ferrous sulfate (mol/l) to the total of the ferrous sulfate (mol/l) and ferric sulfate (mol/l) is 0.5 to less than 1.0.

40. The method of claim 37, wherein said step of forming the Fe—Ni—O film comprises treating the steel sheet, on which the zinciferous plating layer is formed, by using an aqueous solution, the aqueous solution containing $FeCl_2$ and $NiCl_2$, and satisfying the conditions that the pH is 2.0 to 3.5, and the temperature is 20° to 70° C.

41. The method of claim 37, wherein said step of forming the Fe—Ni—O film comprises treating the steel sheet, on which the zinciferous plating layer is formed, by using an aqueous solution, the aqueous solution containing $FeCl_2$ and $NiCl_2$, and satisfying the conditions that a ratio of a Fe content (g/l) to the total of the Fe content (g/l) and a Ni content (g/l) is 0.004 to 0.9, a pH is 2.0 to 3.5, and the temperature is 20° to 70° C.

42. The method of claim 11, wherein said step of forming the Fe—Ni—O film comprises:

performing an anodic electrolysis in an acid solution or an alkaline solution to the steel sheet, on which the zinciferous plating layer is formed, to dissolve an air oxide film existing on a surface of the zinciferous plating layer and to form active and inactive portions on the surface of the zinciferous plating layer; and forming the Fe—Ni—O film on the zinciferous plating layer on which the active and inactive portions are formed, thereby the Fe—Ni—O film having a coating weight within the range of 10 to 1500 mg/m$^2$ in terms of the total weight of the metallic elements, a rate of coating within the range of 30 to 90%, and an island-like or mosaic distribution being formed on the zinciferous plating layer.

43. The method of claim 42, wherein the Fe—Ni—O film is formed by anodic electrolysis using the electrolytic solution containing nickel sulfate, ferrous sulfate and ferric sulfate in a total amount of 0.3 to 2.0 mol/l, and having a pH of 1 to 2.

44. The method of claim 43, wherein said electrolytic solution satisfies the conditions that a ratio of a Fe content (g/l) to the total of the Fe content (g/l) and a Ni content (g/l) is within the range of 0.004 to 0.9, and a molar ratio of ferrous sulfate (mol/l) to the total of the ferrous sulfate (mol/l) and ferric sulfate (mol/l) is 0.5 to less than 1.0.

45. The method of claim 42, wherein said step of forming the Fe—Ni—O film comprises treating the steel sheet, on which the zinciferous plating layer is formed, by using an aqueous solution, the aqueous solution containing $FeCl_2$ and $NiCl_2$, and satisfying the conditions that the pH is 2.0 to 3.5, and the temperature is 20° to 70° C.

46. The method of claim 42, wherein said step of forming the Fe—Ni—O film comprises treating the steel sheet, on which the zinciferous plating layer is formed, by using an aqueous solution, the aqueous solution containing $FeCl_2$ and $NiCl_2$, and satisfying the conditions that a ratio of a Fe content (g/l) to the total of the Fe content (g/l) and a Ni content (g/l) is 0.004 to 0.9, a pH is 2.0 to 3.5, and the temperature is 20° to 70° C.

47. The method of claim 11, wherein said step of forming the Fe—Ni—O film comprises:

temper rolling the steel sheet, on which the zinciferous plating layer is formed, within the range of an elongation ratio of 0.3 to 5.0%;

performing an alkali treatment to the temper-rolled steel sheet in an alkaline solution having a pH of 10 or more for the period of 2 to 30 seconds; and forming the Fe—Ni—O film on the surface of the zinciferous plating layer for which the alkali treatment is performed.

48. The method of claim 47, wherein said step of forming the Fe—Ni—O film comprises treating the steel sheet, on which the zinciferous plating layer is formed, by using an aqueous solution, the aqueous solution containing $FeCl_2$ and $NiCl_2$, and having a pH of 2.0 to 3.5, and a temperature of 20° to 70° C.

49. The method of claim 47, wherein said step of forming the Fe—Ni—O film comprises treating the steel sheet, on which the zinciferous plating layer is formed, by using an aqueous solution, the aqueous solution containing $FeCl_2$ and $NiCl_2$, and satisfying the conditions that a ratio of a Fe content (g/l) to the total of the Fe content (g/l) and a Ni content (g/l) is 0.004 to 0.9, a pH is 2.0 to 3.5, and the temperature is 20° to 70° C.

50. The method of claim 11, wherein said step of forming the Fe—Ni—O film comprises:

performing an alkali treatment to the steel sheet, on which the zinciferous plating layer is formed, in an alkaline solution having a pH of 10 or more for the period of 2 to 30 seconds;

temper rolling the steel sheet, for which the alkali treatment is performed, within the range of an elongation ratio of 0.3 to 5.0%; and forming the Fe—Ni—O film on the surface of the plating layer of the temper rolled steel sheet.

51. The method of claim 50, wherein said step of forming the Fe—Ni—O film comprises treating the steel sheet, on which the zinciferous plating layer is formed, by using an aqueous solution, the aqueous solution containing $FeCl_2$ and $NiCl_2$, and having a pH of 2.0 to 3.5, and a temperature of 20° to 70° C.

52. The method of claim 50, wherein said step of forming the Fe—Ni—O film comprises treating the steel sheet, on which the zinciferous plating layer is formed, by using an aqueous solution, the aqueous solution containing $FeCl_2$ and $NiCl_2$, and satisfying the conditions that a ratio of a Fe content (g/l) to the total of the Fe content (g/l) and a Ni content (g/l) is 0.004 to 0.9, a pH is 2.0 to 3.5, and the temperature is 20° to 70° C.

* * * * *